US011371299B2

(12) United States Patent
Naesgaard et al.

(10) Patent No.: US 11,371,299 B2
(45) Date of Patent: Jun. 28, 2022

(54) ROBOTIC PIPE HANDLER AND PIPE STORAGE

(71) Applicant: CANRIG ROBOTIC TECHNOLOGIES AS, Sandnes (NO)

(72) Inventors: Kjetil Naesgaard, Røyneberg (NO); Kenneth Mikalsen, Sandnes (NO)

(73) Assignee: CANRIG ROBOTIC TECHNOLOGIES AS, Sandnes (NO)

( * ) Notice: Subject to any disclaimer, the term of this patent is extended or adjusted under 35 U.S.C. 154(b) by 0 days.

(21) Appl. No.: 17/445,795

(22) Filed: Aug. 24, 2021

(65) Prior Publication Data

US 2022/0065053 A1 Mar. 3, 2022

Related U.S. Application Data

(60) Provisional application No. 63/073,341, filed on Sep. 1, 2020.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/14; E21B 19/16; E21B 19/20
USPC ..... 414/22.51–22.71, 745.9, 746.6; 198/774.2
See application file for complete search history.

(56) References Cited

U.S. PATENT DOCUMENTS 3,501,027 A 3/1970 Dea et al.
3,895,677 A 7/1975 Bokenkamp
4,051,775 A * 10/1977 Watson ..... B41F 15/0872 101/40.1
4,129,221 A 12/1978 Moller
4,235,566 A 11/1980 Beeman et al.
(Continued)

FOREIGN PATENT DOCUMENTS

AU 2008202799 A1 1/2009
CN 109477362 B 9/2021
(Continued)

OTHER PUBLICATIONS

International Search Report from PCT Application No. PCT/US2021/068259 dated Sep. 30, 2021, 1 pg.
(Continued)

*Primary Examiner* — Lynn E Schwenning
(74) *Attorney, Agent, or Firm* — Abel Schillinger, LLP

(57) ABSTRACT

A horizontal pipe handling system that can include a base with a center longitudinal axis, an intermediate storage location comprising a cradle configured to support a first tubular in a horizontal orientation, a first horizontal pipe handler with a first feeder arm rotationally attached to the base at a first axis on a first side of the center longitudinal axis, wherein the first feeder arm extends from the first axis, past the cradle, and to a second side of the center longitudinal axis, and a second horizontal pipe handler with a first ramp arm rotationally attached to the base at a second axis which is disposed on the second side of the center longitudinal axis, wherein the first ramp arm is configured to support one or more tubulars in the horizontal orientation which is substantially parallel to the center longitudinal axis.

20 Claims, 40 Drawing Sheets

(56) References Cited

U.S. PATENT DOCUMENTS

| | | | | |
|---|---|---|---|---|
| 4,371,302 | A * | 2/1983 | Frias | E21B 19/155 414/22.61 |
| 4,494,899 | A | 1/1985 | Hoang et al. | |
| 5,451,129 | A | 9/1995 | Boyadjieff et al. | |
| 5,492,436 | A | 2/1996 | Suksumake | |
| 6,220,807 | B1 | 4/2001 | Sorokan | |
| 6,242,892 | B1 | 6/2001 | Arnaud et al. | |
| 6,926,488 | B1 | 8/2005 | Bolding et al. | |
| 7,473,065 | B2 * | 1/2009 | Wells | E21B 19/155 414/22.57 |
| 7,802,636 | B2 | 9/2010 | Childers et al. | |
| 7,837,426 | B2 * | 11/2010 | Lesko | E21B 19/15 414/746.4 |
| 8,033,779 | B2 | 10/2011 | Gerber | |
| 8,113,762 | B2 | 2/2012 | Belik | |
| 8,186,926 | B2 | 6/2012 | Littlely | |
| 8,192,128 | B2 | 6/2012 | Orgeron | |
| 8,240,968 | B2 | 8/2012 | Hopkins et al. | |
| 8,469,085 | B2 | 6/2013 | Orgeron | |
| 8,695,522 | B2 | 4/2014 | Wijning et al. | |
| 8,949,416 | B1 | 2/2015 | Barnes et al. | |
| 9,091,126 | B2 | 7/2015 | Thiessen et al. | |
| 9,249,635 | B2 | 2/2016 | Ferrari | |
| 9,677,298 | B2 | 6/2017 | Konduc et al. | |
| 9,932,784 | B2 | 4/2018 | Wang et al. | |
| 10,214,976 | B2 | 2/2019 | Chang et al. | |
| 10,385,634 | B2 * | 8/2019 | Pover | E21B 19/14 |
| 10,465,456 | B2 * | 11/2019 | Gupta | E21B 19/15 |
| 10,711,540 | B2 | 7/2020 | Holand | |
| 10,808,465 | B2 | 10/2020 | Mikalsen et al. | |
| 10,837,238 | B2 | 11/2020 | Gupta et al. | |
| 11,118,415 | B2 | 9/2021 | Eriksen | |
| 11,118,416 | B2 | 9/2021 | Vu | |
| 2001/0025727 | A1 | 10/2001 | Byrt et al. | |
| 2003/0159854 | A1 | 8/2003 | Simpson et al. | |
| 2003/0170095 | A1 | 9/2003 | Slettedal | |
| 2006/0045655 | A1 | 3/2006 | Wells | |
| 2006/0285941 | A1 * | 12/2006 | Fikowski | E21B 19/155 414/22.54 |
| 2008/0253866 | A1 | 10/2008 | Lops et al. | |
| 2011/0188973 | A1 | 8/2011 | Baumler | |
| 2013/0087387 | A1 | 4/2013 | Hacker | |
| 2013/0195583 | A1 | 8/2013 | Rodgers | |
| 2013/0336748 | A1 | 12/2013 | Hilton | |
| 2015/0152697 | A1 | 6/2015 | Gustavsson | |
| 2016/0017673 | A1 | 1/2016 | Roodenburg et al. | |
| 2016/0160587 | A1 | 6/2016 | Mission et al. | |
| 2016/0186495 | A1 | 6/2016 | Flusche | |
| 2016/0208566 | A1 | 7/2016 | Bowley et al. | |
| 2016/0230481 | A1 | 8/2016 | Mission et al. | |
| 2017/0305510 | A1 | 10/2017 | Roodenburg et al. | |
| 2019/0119995 | A1 | 4/2019 | Gullaksen et al. | |
| 2019/0128077 | A1 | 5/2019 | Holand et al. | |
| 2019/0128078 | A1 | 5/2019 | Doyon | |
| 2019/0136669 | A1 | 5/2019 | Wiedecke et al. | |
| 2019/0330935 | A1 | 10/2019 | Mikalsen et al. | |
| 2019/0330937 | A1 | 10/2019 | Mikalsen | |
| 2020/0199949 | A1 | 6/2020 | Magnuson | |
| 2022/0003053 | A1 | 1/2022 | Burke | |
| 2022/0003054 | A1 | 1/2022 | Mikalsen | |
| 2022/0003055 | A1 | 1/2022 | Petrello et al. | |

FOREIGN PATENT DOCUMENTS

| | | | |
|---|---|---|---|
| EP | 0646694 | A2 | 4/1995 |
| EP | 2521834 | B1 | 12/2013 |
| EP | 2799661 | B1 | 2/2016 |
| GB | 2264736 | A | 9/1993 |
| WO | 2006128300 | A1 | 12/2006 |
| WO | 2012165951 | A2 | 12/2012 |
| WO | 2014047055 | A1 | 3/2014 |
| WO | 2014146759 | A2 | 9/2014 |
| WO | 2022008266 | A1 | 1/2022 |
| WO | 2022008352 | A1 | 1/2022 |
| WO | 2022010619 | A1 | 1/2022 |

OTHER PUBLICATIONS

International Search Report from PCT Application No. PCT/US2021/067545 dated Sep. 30, 2021, 1 pg.

International Search Report from PCT Application No. PCT/US2021/037218 dated Sep. 29, 2021, 1 pg.

International Search Report from PCT Application No. PCT/EP2021/073131 dated Nov. 26, 2021, 2 pg.

Partial International Search Report from PCT Application No. PCT/EP2021/073137 dated Dec. 22, 2021, 1 pg.

* cited by examiner

6

VIEWED FROM LINE 27-27

VIEWED FROM LINE 27-27

VIEWED FROM LINE 27-27

ROBOTIC PIPE HANDLER AND PIPE STORAGE

CROSS-REFERENCE TO RELATED APPLICATION(S)

This application claims priority under 35 U.S.C. § 119(e) to U.S. Patent Application No. 63/073,341, entitled "ROBOTIC PIPE HANDLER," by Kjetil NAESGAARD et al., filed Sep. 1, 2020, which application is assigned to the current assignee hereof and incorporated herein by reference in its entirety.

TECHNICAL FIELD

The present invention relates, in general, to the field of drilling and processing of wells. More particularly, present embodiments relate to a system and method for manipulating tubulars during subterranean operations.

BACKGROUND

In subterranean operations, a segmented tubular string can be used to access hydrocarbon reserves in an earthen formation. The segmented tubular string can be made up of individual tubular segments or stands of tubular segments. As tubular segments or tubular stands are assembled together to form the tubular string, the tubular string can be extended further into the wellbore at the well site, which can be referred to as "tripping in" the tubular string. When the tubular string needs to be at least partially removed from the wellbore, individual tubular segments or tubular stands can be removed from the top end of the tubular string as the tubular string is pulled up from the wellbore. This can be referred to as "tripping out" the tubular string.

Due to the large number of tubular segments needed during the tripping operations, tubular storage areas near or on the rig can be utilized to improve efficiency of rig operations. Many rigs can have a horizontal storage area positioned on a V-door side of the rig with tubulars stored in a horizontal orientation. The rigs can also include a fingerboard vertical storage normally on the rig floor for holding tubulars in a vertical orientation. As used herein, a "horizontal orientation" or "horizontal position" refers to a horizontal plane that is generally parallel to a horizontal plane of a rig floor, where the horizontal plane can be any plane that is within a range of "0" degrees+/−10 degrees from the horizontal plane of the rig floor. As used herein, a "vertical orientation" or "vertical position" refers to a vertical plane that is generally perpendicular to the horizontal plane of the rig floor, where the vertical plane can be any plane that is within a range of 90 degrees+/−10 degrees from the horizontal plane of the rig floor. As used herein, an "inclined orientation" or "inclined position" refers to a plane that is generally angled relative to the horizontal plane of the rig floor, where the inclined plane can be any plane that is within a range from 10 degrees up to and including 80 degrees rotated from the horizontal plane of the rig floor.

Pipe handler systems are used to move the tubulars between the horizontal storage area, the vertical storage area, and the well center as needed during rig operations. The efficiency of these pipe handler systems can greatly impact the overall efficiency of the rig during subterranean operations. Therefore, improvements in these pipe handler systems are continually needed.

SUMMARY

One general aspect can include a system for performing a subterranean operation a pipe handler may include: a base; a support rotatably attached to the base at one end of the support; a first actuator configured to telescopically extend the support into engagement with a structure (e.g., a rig or other structure to which the pipe handler may need to be coupled); and a pipe handler mechanism rotatably attached to the support proximate an opposite end of the support, the pipe handler mechanism being configured to grip and transport an object from a pick-up location to a delivery location.

One general aspect can include a system for performing a subterranean operation. The system also includes a base; a support rotatably attached to the base at one end and configured to engage a rig at an opposite end; a pipe handler mechanism rotatably attached to the support proximate the opposite end of the support, the pipe handler mechanism may include: a first arm rotationally coupled to one or more grippers; and a plurality of lift beams rotationally coupled at one end to the support and rotationally coupled at an opposite end to the first arm, where the first arm is configured to rotate independently of the plurality of lift beams.

One general aspect can include a method for performing a subterranean operation. The method also includes rotating a support, via a first actuator, from a stowed position on a base to a vertical position relative to the base; vertically extending the support, via a second actuator, into engagement with a first rig; and rotating a pipe handler mechanism relative to the support from a stowed position to a deployed position, the pipe handler mechanism being rotationally coupled to the support and being configured to grip and transport an object from a pick-up location to a delivery location.

One general aspect can include a system for performing a subterranean operation a pipe handler may include: a support fixedly mounted to a rig floor; and a pipe handler mechanism rotatably attached to the support, the pipe handler mechanism being configured to grip and transport an object from a pick-up location to a delivery location.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Figure 1:
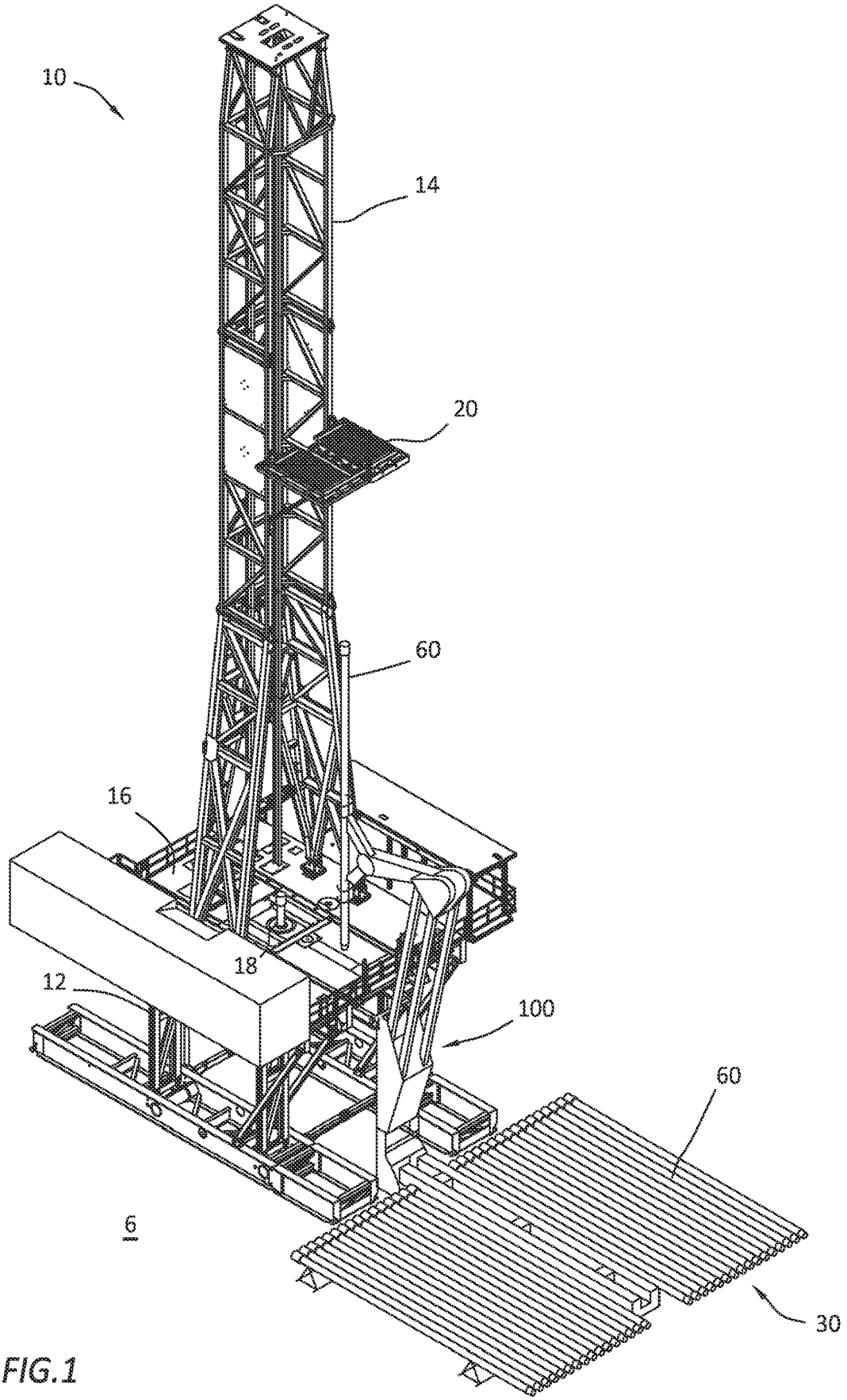
FIG. 1 is a representative perspective view of a rig with a pipe handler, in accordance with certain embodiments.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about," "approximately," or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

As used herein, "EX certified" indicates that the article (such as the pipe handler 100) is approvable for either or both "ATEX certified" and "IECEx certified." ATEX is an abbreviation for "Atmosphere Explosible". IECEx stands for the certification by the International Electrotechnical Commission for Explosive Atmospheres. ATEX is the name commonly given to two European Directives for controlling explosive atmospheres: 1) Directive 99/92/EC (also known as 'ATEX 137' or the 'ATEX Workplace Directive') on minimum requirements for improving the health and safety protection of workers potentially at risk from explosive atmospheres. 2) Directive 94/9/EC (also known as 'ATEX 95' or 'the ATEX Equipment Directive') on the approximation of the laws of Member States concerning equipment and protective systems intended for use in potentially explosive atmospheres. Therefore, as used herein "ATEX certified" indicates that the article (such as the pipe handler 100) meets the requirements of the two stated directives ATEX 137 and ATEX 95 for Explosive (EX) Zone 1 environments. IECEx is a voluntary system which provides an internationally accepted means of proving compliance with IEC standards. IEC standards are used in many national approval schemes and as such, IECEx certification can be used to support national compliance, negating the need in most cases for additional testing. Therefore, as used herein, "IECEx certified" indicates that the article (such as the pipe handler 100) meets the requirements defined in the IEC standards for EX Zone 1 environments.

FIG. 1 is a representative perspective view of a rig 10 with a robotic pipe handler 100 that can be used to transport tubulars 60 between a horizontal storage area 30 and a well center 58 on a rig floor 16 (or other locations such as a vertical storage 20, or a pipe handler, not shown, that manages the vertical storage). The rig 10 is depicted as a land-based rig, but the principles of this disclosure can also be utilized for an off-shore rig, with possible variations in conveying the pipe handler to/from a rig. Even though the pipe handler 100 can be used in off-shore rigs, it is well suited for land-based rigs. As used herein, "rig" refers to all surface structures (e.g., platform, derrick, vertical storage area, horizontal storage area, drill floor, etc.) used during a subterranean operation.

The rig 10 can have a platform 12 that can be transported to a well site in a stowed position, and erected at the well site by rotating the platform 12 supports to elevate the rig floor 16 above the base by rotating (arrows 99) the supports about one or more pivots (e.g., pivot 89). It should be understood that the current robotic pipe handler 100 is not limited to any one type of rig 10. The rig 10 can include rigs built-up on site, moved in and erected by rotating a platform (similar to the rig 10 in FIG. 1), walked to well site from a previous well site, floated to a well site via a shipping vessel, etc. The rig 10 can be rigs with rig floors that are various heights from a horizontal storage area. The rig 10 should have an engagement means that engages the robotic pipe handler 100 when the pipe handler 100 is deployed at the well site.

The rig floor 16 can include a derrick 14 which provides structural support for other equipment, such as a top drive, a vertical storage 20, etc. With the platform 12 and derrick 14 erected to their working positions, the rig 10 can be used to assemble and extend a segmented tubular string 66 into a wellbore 50 (tripping in) or disassemble and retract the segmented tubular string 66 from the wellbore 50 (tripping out).

Figure 2:
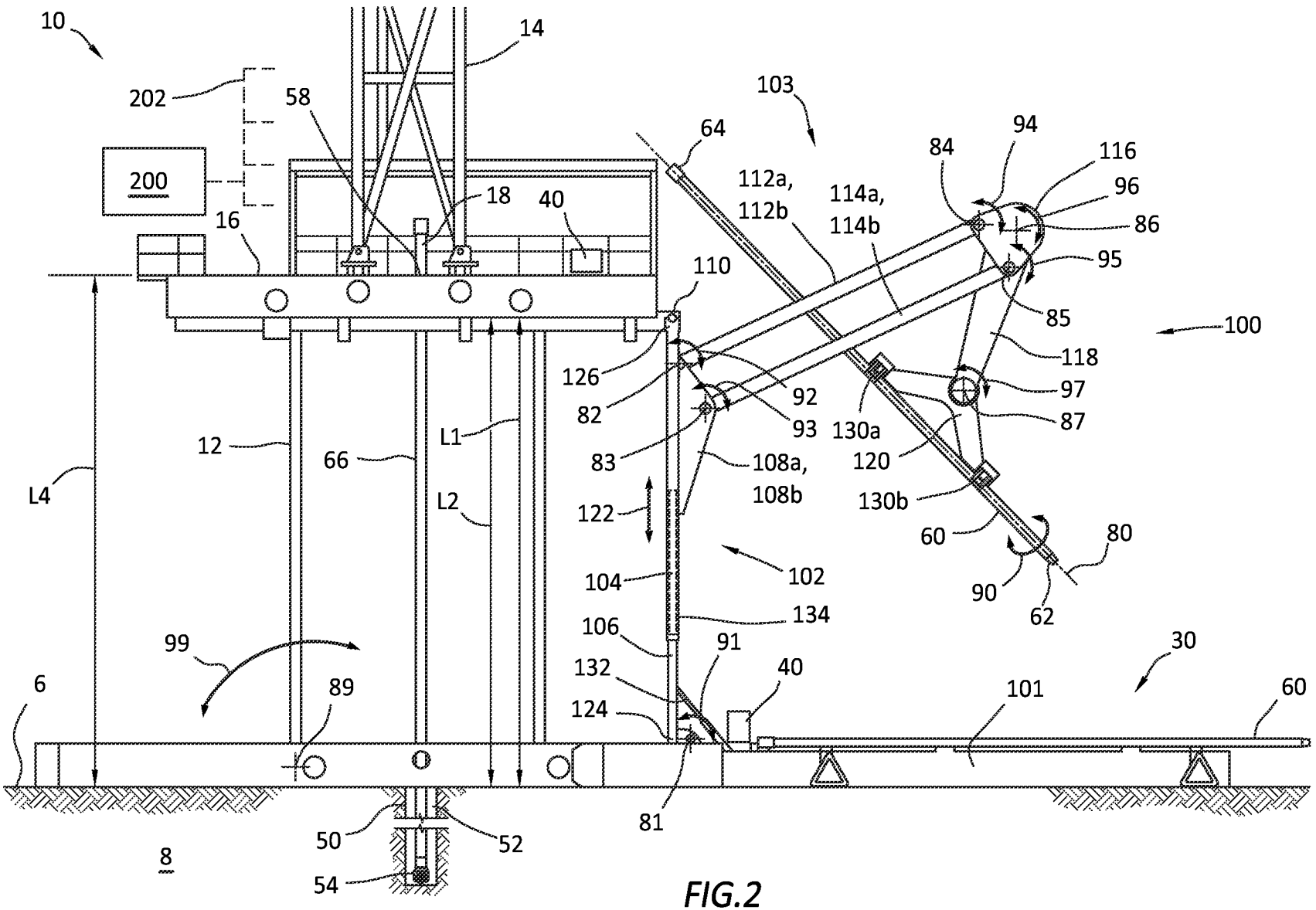
FIG. 2 is a representative side view of a rig with a pipe handler, in accordance with certain embodiments.
Figure 3:
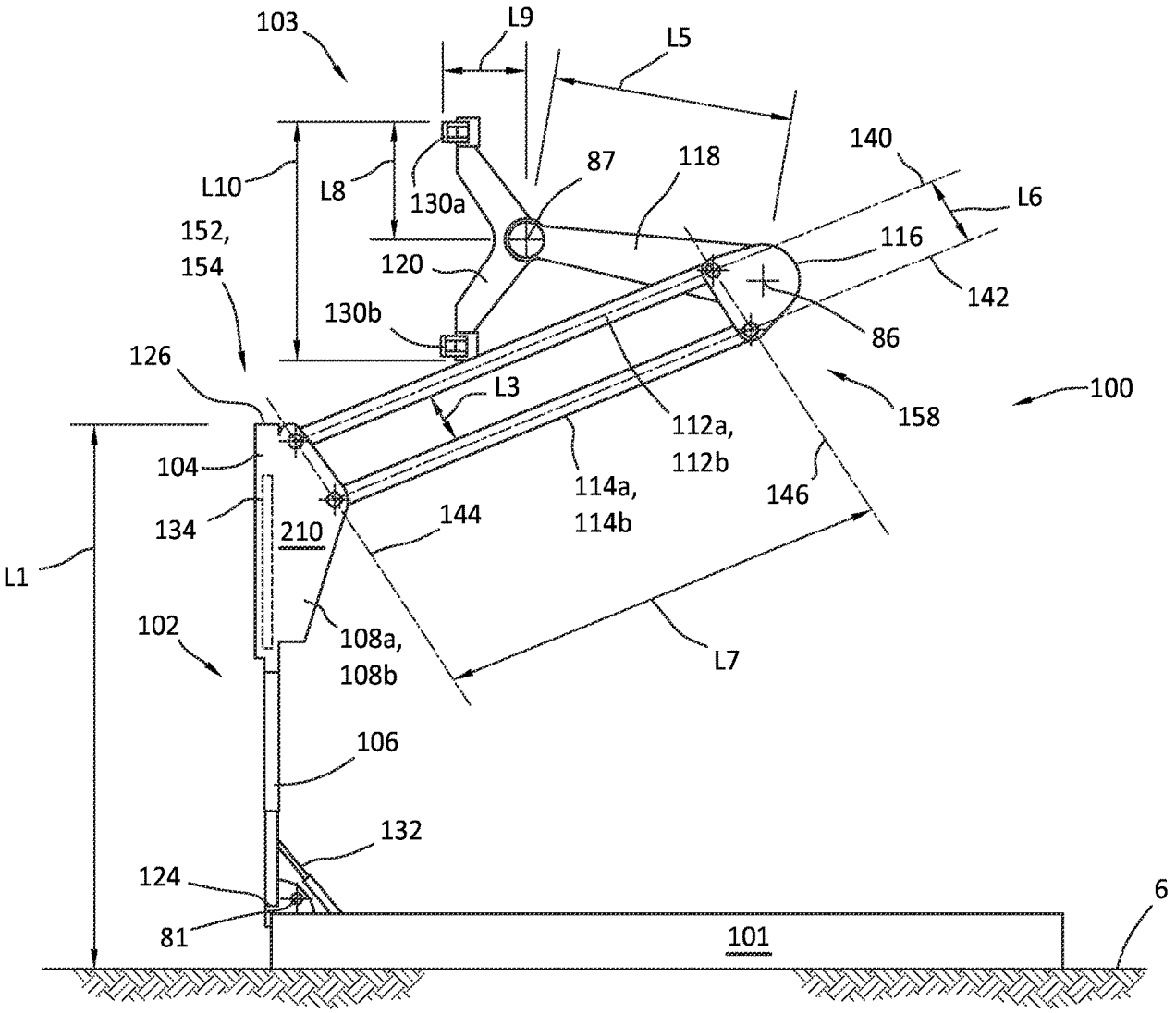
FIG. 3 is a representative side view of a pipe handler in a deployed position, in accordance with certain embodiments.
Figure 4:
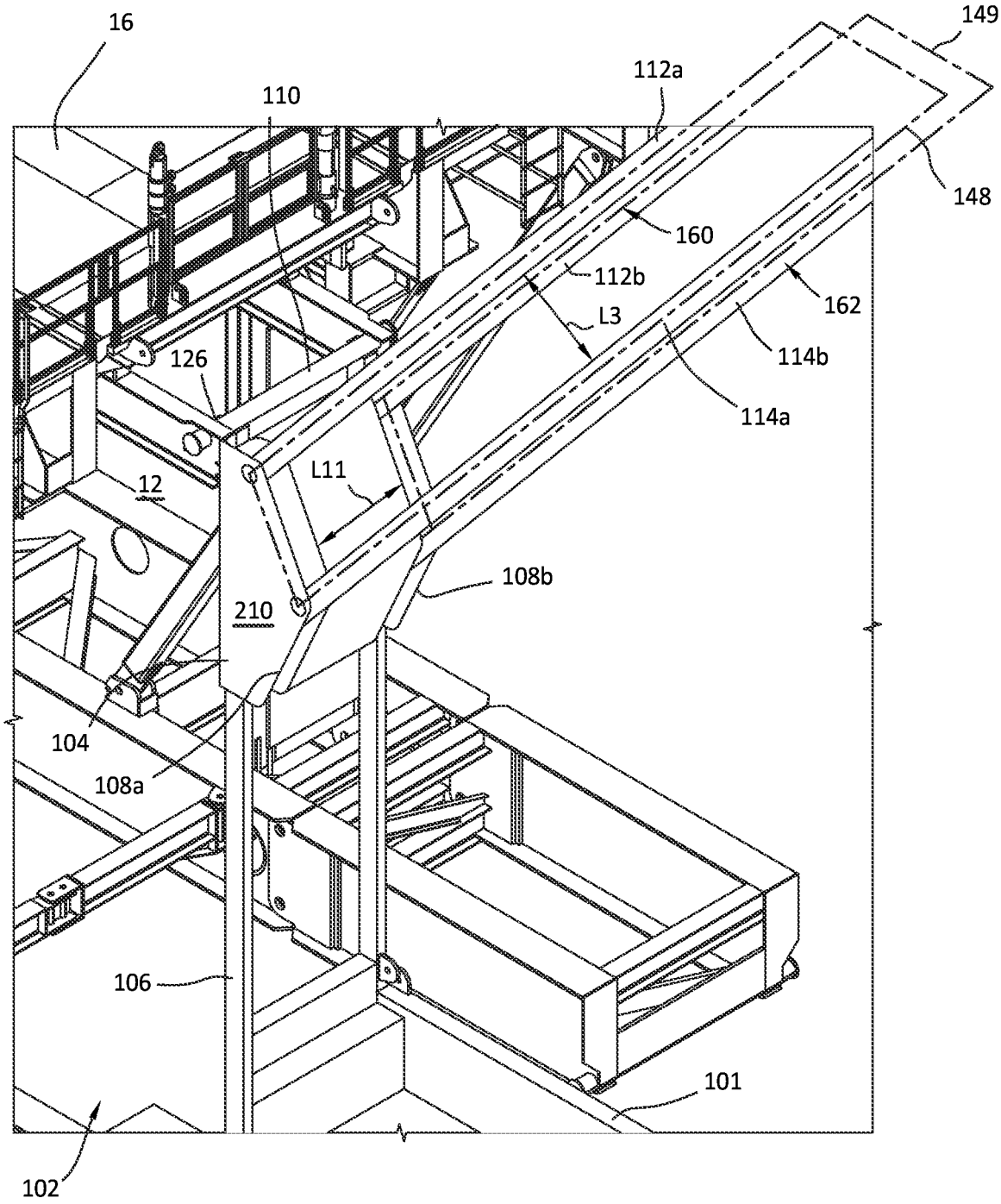
FIG. 4 is a representative partial perspective view of a pipe handler engaged with a rig after deployment, in accordance with certain embodiments.

Referring to FIGS. 2-4, the elements of the pipe handler 100 will be described. FIG. 2 is a representative side view of a rig 10 with a pipe handler 100. FIG. 3 is a representative side view of a pipe handler 100 in a deployed position. FIG. 4 is a representative partial perspective view of a pipe handler 100 engaged with a rig 10 after deployment. While tripping in, tubulars 60 can be collected from the horizontal storage area 30 and presented to a delivery location (e.g., well center 58, vertical storage 20, another pipe handler, top drive, elevator, casing running tool, mouse hole, slips, stick up, etc.). The pipe handler 100 can align the new tubular 60 with the stickup 18 and spin the tubular 60 onto the top end of the tubular string 66, release the tubular 60 and return to the horizontal storage area 30 to collect another tubular 60. The vertical storage 20 can have another pipe handling apparatus that transfers the tubular 60 between the pipe handler 100 and the vertical storage 20. The tubular string 66 can be a drill string which can be used to extend the wellbore 50 through the earthen formation 8 by rotating drill bit 54. The drilling mud can flow down through the tubular string 66, through the drill bit 54, and into the annulus 52 where the drilling mud flowing up through the annulus 52 can carry away the cuttings.

While tripping out, the pipe handler 100 can spin a tubular 60 off of the top end of the tubular string 66 and transport the tubular 60 to another delivery location (e.g., vertical storage 20, horizontal storage area 30, another pipe handler, etc.). During either tripping in or tripping out, the pipe handler 100 can be used to clean, dry, and dope the pin end 62 and box end 64 of the tubular 60 via the doping buckets 40, which can be positioned on the rig floor 16, or in horizontal storage area 30, or anywhere else proximate the rig 10 that is suitable for the pipe handler 100 to access the doping bucket 40. The pipe handler 100 can insert the pin end 62 or the box end 64 into a doping bucket 40 and spin the end (arrows 90 around axis 80) while it is in the doping bucket 40 to clean, dry, and apply a uniform coating of dope to the threads.

The pipe handler 100 can include a base 101 that rests on a surface (such as surface 6 of the earthen formation 8) and supports a horizontal storage area 30 that can be assembled on one of more sides of the base 101. The pipe handler 100 can further include a telescopic support 102 for engagement with the rig 10 and a pipe handler mechanism 103 for manipulating tubulars.

One of the doping buckets 40 can be positioned proximate to one end of the base 101 (as shown) or an opposite end of the base 101 from the one that is shown with the doping bucket 40. The telescopic support 102 that can have lower supports 106 that are telescopically coupled to the upper supports 104. One end 124 of the telescopic support 102 can be rotationally coupled to the base 101 at the pivot 81. The telescopic support 102 can be rotated between stowed and deployed positions about the pivot 81 (arrows 91) by one or more actuators 132, which can be a hydraulically, electrically, pneumatically, or manually (e.g., by a winch) actuated type actuator.

When the pipe handler 100 is moved into position proximate a rig 10 and deposited on the surface 6 (or another surface, if desired), the telescopic support 102 can be rotated to a substantially vertical position (as shown in FIG. 2) by actuating the actuator 132 and rotating the telescopic support 102 (arrows 91) about the pivot 81. When in the substantially vertical position, one or more actuators 134 can be used to telescopically extend the upper supports 104 (arrows 122) relative to the lower supports 106 until the end 126 of the telescopic support 102 engages the rig engagement means 110. The actuator(s) 134 can hold the telescopic support 102 engaged with the engagement means 110 while the pipe handler 100 is deployed and operated to move tubulars between the rig 10 and the horizontal storage area 30. The engagement means 110 can also include a locking mechanism (not shown) to positively secure the end 126 to the engagement means 110 without the actuator(s) 134 being required to maintain the extended position of the telescopic support 102.

It should be understood that it is not a requirement that the telescopic support 102 be rotated to a substantially vertical orientation relative to the base. It is envisioned that the telescopic support 102 can be deployed in an inclined orientation to accommodate a rig floor 16 (and possibly the rig 10) that is moveable relative to the base 101 of the pipe handler 100. In an inclined orientation, the telescopic support 102 may be restricted to a horizontal depth below the rig floor 16 based on the rotation of the support brackets **108*a*, 108*b* with the telescopic support 102 and relative to the base 101. A plane 144 formed by the pivots 82, 83 can alter the vertical depth accessible to the pipe handler 100 based on the operation of the four-bar linkage (see FIG. 3). If the telescopic support 102 and the plane 144 are rotated counterclockwise, then the pipe handler 100 can access a greater distance along the rig floor 16 but can have a reduced vertical distance and reduced horizontal distance from the rig floor that would be accessible to the pipe handler 100. Conversely, if the telescopic support 102 and the plane 144 are rotated clockwise, then the pipe handler 100 may have a reduced accessible distance along the rig floor 16 but can have an increased vertical distance and increased horizontal distance from the rig floor that would be accessible to the pipe handler 100**.

The pipe handler mechanism 103 can include the upper beams 112*a*, 112*b*, the lower beams 114*a*, 114*b*, a coupling structure 116, an arm 118, an arm 120, and grippers 130*a*, 130*b*. The telescopic support 102 can include support brackets 108*a*, 108*b* that can be seen as generally triangularly shaped, with the base of the triangle being positioned along the upper supports 104, and the sides of the triangle extending out to form an angled connection of the upper beams 112*a*, 112*b* and lower beams 114*a*, 114*b* to the support brackets 108*a*, 108*b* at the pivots 82, 83. One or more actuators (e.g., electric motors in a housing capable of being EX Certified, not shown) can be used to rotate the upper beams 112*a*, 112*b* about the pivot 82 (arrows 92) and rotate the lower beams 114*a*, 114*b* about the pivot 83 (arrows 93). One end of each of the upper beams 112*a*, 112*b* and the lower beams 114*a*, 114*b* can be rotationally connected to the support brackets 108*a*, 108*b*, with the other end of each of the upper beams 112*a*, 112*b*, and the lower beams 114*a*, 114*b* rotationally connected to the coupling structure 116. The support brackets 108*a*, 108*b*, the upper beams 112*a*, 112*b*, the lower beams 114*a*, 114*b*, and the coupling structure 116 can form two side-by-side four bar parallelograms used to control the height and orientation of the coupling structure 116.

The support bracket 108*a*, the upper beam 112*a*, the lower beam 114*a*, and the coupling structure 116 can form one of the side-by-side four bar parallelograms, with the support bracket 108*b*, the upper beam 112*b*, the lower beam 114*b*, and the coupling structure 116 forming another one of the side-by-side four bar parallelograms. As the actuators rotate the upper beams 112*a*, 112*b* and the lower beams 114*a*, 114*b* about the pivots 82, 83, the upper beams 112*a*, 112*b* remain substantially parallel to the lower beams 114*a*, 114*b*, with a vertical space between the upper beams 112*a*, 112*b*, and the lower beams 114*a*, 114*b* changing as they are rotated.

A plane defined by the pivots 82, 83 can also be substantially parallel to a plane formed by the pivots 84, 85. Therefore, the upper beams 112*a*, 112*b*, the lower beams 114*a*, 114*b*, the plane 144 formed by the pivots 82, 83 (see FIG. 3), and the plane 146 formed by the pivots 84, 85 form the two parallelograms used to raise and lower the coupling structure 116. As the upper beams 112*a*, 112*b*, and the lower beams 114*a*, 114*b* are rotated relative to the support brackets 108*a*, 108*b*, the coupling structure 116 can be raised or lowered relative to the horizontal storage area 30, with the coupling structure 116 maintaining its orientation relative to the support brackets 108*a*, 108*b* such that the planes 144, 146 remain parallel to each other. The upper beams 112*a*, 112*b* and the lower beams 114*a*, 114*b* rotate relative to the coupling structure 116 about pivots 84, 85 (respective arrows 94, 95) to maintain the parallelograms as the upper beams 112*a*, 112*b*, and the lower beams 114*a*, 114*b* rotate up and down relative to the support brackets 108*a*, 108*b*.

An arm 118 can be rotationally coupled to the coupling structure 116 at pivot 86 and can be rotated (arrows 96) about the pivot 86 by one or more actuators (e.g., electric motors in a housing capable of being EX Certified, not shown). The arm 118 can rotate up to 160 degrees about the pivot 86, with the arm 118 configured to pass through a first horizontal space between the pair of upper beams 112*a*, 112*b* and to pass through a second horizontal space between the pair of lower beams 114*a*, 114*b*, with the first and second horizontal spaces being vertically aligned to allow the arm 118 to rotate therethrough. It should be understood that the arm 118 can rotate about the pivot 86 independent of movements of the upper beams 112*a*, 112*b* and the lower beams 114*a*, 114*b*. For example, if the upper beams 112*a*, 112*b*, and the lower beams 114*a*, 114*b* are stationary, the arm 118 can still rotate about the pivot 86. Conversely, when the upper beams 112*a*, 112*b* and the lower beams 114*a*, 114*b* are rotated about the pivots 82, 83, the arm 118 can remain in its azimuthal orientation relative to the pivot 86. It should also be understood that the upper beams 112*a*, 112*b*, and the lower beams 114*a*, 114*b* can rotate simultaneously with the arm 118, but rotation of one is not dependent upon the rotation of the other.

The length of the arm 118 can be sized to support engaging tubulars 60 in the horizontal storage area 30 and carrying tubulars between the pairs of the upper beams 112*a*, 112*b* and the lower beams 114*a*, 114*b* with the necessary clearances between the tubulars 60 and the telescopic support 102, which can be dependent upon the lengths of the upper beams 112*a*, 112*b* and the lower beams 114*a*, 114*b*. The distance L5 represents the longitudinal distance between the pivot 86 and the pivot 87, which generally represents the length of the arm 118. The distance L6 between the planes 140, 142 provides the needed clearance in the parallelograms to allow the pipe handler 100 to access both the well center 58 and the horizontal storage area 30. As the upper beams 112*a*, 112*b* and the lower beams 114*a*, 114*b* of the parallelograms are rotated, the distance L3 between the upper beams 112*a*, 112*b* and the lower beams 114*a*, 114*b* varies, and it must be equal to or greater than a distance that allows the coupling structure 116 to be moved from a position over the horizontal storage area 30 to a position proximate the well center 58 so that the grippers 130*a*, 130*b* coupled to the arm 118 can access tubulars in either the horizontal storage area 30 or at well center 58. The lengths of the upper beams 112*a*, 112*b*, and the lower beams 114*a*, 114*b* can be derived from the distance L7 between the planes 144, 146.

An arm 120 can be rotationally coupled to the arm 118 at the pivot 87 and can rotate 140 degrees about the pivot 87 (arrows 97). The arm 120 can have two portions that extend from the pivot 87 at an obtuse angle relative to each other, with each portion having a gripper 130*a* or 130*b* attached to an end. The grippers 130*a*, 130*b* can be used to engage a tubular 60 and rotate the tubular 60 (arrows 90) about its central axis 80, while being engaged by the grippers 130*a*, 130*b*. It should also be understood that each individual gripper 130*a*, 130*b* can be used to engage and transport smaller objects such as subs, tools, etc. The grippers are spaced apart at a suitable distance to provide stability and control when moving a tubular 60 between the horizontal storage area 30 and the well center 58. Each gripper 130*a*, 130*b* is positioned at the end of one of the portions of the arm 120, with each being (with reference to the orientation in FIG. 3) a horizontal distance L9 from the pivot 87 and a vertical distance L8 from the pivot 87. Therefore, the distance from the outside of gripper 130*a* to the outside of gripper 130*b* can be represented as 2 times distance L8 or distance L10.

It should be understood that the arm 120 can rotate about the pivot 87 independent of rotation of the arm 118 about pivot 86. For example, if the arm 120 is stationary relative to the pivot 87, the arm 118 can still rotate about the pivot 86. Conversely, if the arm 118 is stationary relative to the pivot 86, the arm 120 can still rotate about the pivot 87. It should be understood that the arm 120 can rotate simultaneously with the arm 118, but rotation of one is not dependent upon the rotation of the other. The discussion of the pipe handler 100 (including the telescopic support 102 and the pipe handler mechanism 103) can similarly apply to any embodiments described in this disclosure.

When the telescopic support 102 is raised to its deployed position 152 and extended to the engaged position 154 with the rig 10, the end 126 of the telescopic support 102 (at height L1) can engage the rig engagement means 110, which is at a height of L2 from the surface (e.g., surface 6) that the rig is resting upon. When L1 substantially equals L2, the telescopic support 102 can be seen as being engaged with the engagement means 110. The height L2 of the engagement means 110 can be at a different height than the rig floor 16 which is shown to be at a height L4. The pipe handler 100 of the current disclosure can accommodate rigs 10 with rig floors at various heights by merely extending the telescopic support 102 to the desired height L1 to engage the engagement means 110.

It may be desirable that the minimum height L2 of the engagement means 110 supported by the pipe handler 100 is slightly larger than the minimum height L1 of the telescopic support 102 when it is rotated to the deployed position 152, such that the surface of the rig is resting upon is common with the surface the pipe handler 100 is resting upon. However, the pipe handler 100 can be made to rest on a surface that is lower than the surface (e.g., surface 6) that the rig 10 is resting upon. By vertically lowering the pipe handler 100 below the surface the rig 10 is resting upon, then pipe handler 100 can accommodate heights of the engagement means 110 that are less than the minimum height L1 when the upper supports 104 are not extended from their stowed positions relative to the lower supports 106.

Referring back to FIG. 2, the equipment on the rig 10, can be communicatively coupled to a rig controller 200 via a network 202, with the network 202 being wired or wirelessly connected to the equipment and other rig resources. It should be understood that the rig controller 200 can include one or more processors, non-transitory memory storage that can store data and executable instructions, where the one or more processors are configured to execute the executable instructions, one or more human machine interfaces (HMI), one or more input devices, one or more displays, and a communication link to a remote location. The rig controller 200 can also include processors disposed in the robots (e.g., controller 210 of the robotic pipe handler 100) for local control of the robots or distributed about the rig 10. Each processor can include non-transitory memory storage that can store data and executable instructions.

However, it should be understood that the local controller 210 in the pipe handler 100 (300, 400, see FIGS. 19-25) can operate autonomously and control the pipe handler 100 (300, 400) to rotate the upper beams 112*a*, 112*b*, the lower beams 114*a*, 114*b*, the arm 118, the arm 120, and the grippers 130*a*, 130*b* to selectively engage objects (e.g., tubulars 60, BHAs, tools 68, or other rig equipment), manipulate these objects from a pickup location to a delivery location, and deposit the objects at the delivery location. The controller 210 can autonomously control the pipe handler 100 to rotate the upper beams 112*a*, 112*b*, the lower beams 114*a*, 114*b*, the arm 118, the arm 120, and the grippers 130*a*, 130*b*, such that the controller 210 avoids collision of the pipe handler 100 (300, 400) with components of the pipe handler 100 (300, 400), as well as knowing the parameters of the object (e.g., tubular 60, tool 68, etc.) being manipulated, picked up, or delivered by the pipe handler 100, 300, 400, such that the controller 210 automatically avoids collision of the object with components of the pipe handler 100, 300, 400, other rig equipment, personnel, other objects, etc.

Knowing the parameters of the object (e.g., length, diameter, weight, shape, size, gripping zones, non-gripping zones, etc.), the controller 210 (or rig controller 200) can autonomously determine the orientation and path with which to transport the object from pickup location to delivery location to avoid collisions and minimize loads (if possible) on the pipe handler components. The parameters can also include the desired pickup location or engagement location of the one or more grippers of the pipe handler such that the object is delivered in the correct orientation and at a desired clearance. The pipe handler controller 210 can also know, from data inputs, the location of the well center and a stickup so it can stab a tubular into a top end of a tubular string 66 and spin the tubular 60 into a threaded connection with the tubular string 66. It is not required that the pipe handler 100, 300, 400 stab and spin in a tubular onto a tubular string, but it is capable of doing this. The pipe handler 100, 300, 400 can also hand the tubular 60 off to other rig equipment (top drive, another pipe handler, elevator, roughneck, drill floor robot, etc.) and the other rig equipment can threadably connect the tubular 60 to the tubular string 66 or store the tubular 60 in vertical storage for later use.

A control program being executed by the pipe handler controllers 210 can perform the tasks described in this disclosure or at least direct the tasks to be performed by the pipe handler 100. The pipe handler controller 210 can communicate with other controllers on the rig (e.g., rig controller 200) to facilitate handing off and picking up objects at the delivery locations and pickup locations. The controller 210 can be disposed in the support 102 or in locations in the pipe handler mechanism 103 as desired. The controller 210 can also include multiple controllers disposed in the support 102 or in locations in the pipe handler mechanism 103 as desired.

Referring specifically to FIG. 4, an example of the engagement means 110 is shown being engaged with the top end 126 of the telescopic support 102. It should be understood that the position of the support brackets 108*a*, 108*b* relative to the top end 126 of the telescopic support 102 can be adjusted as needed when the telescopic support 102 is being fabricated to allow for proper clearances for the upper beams 112*a*, 112*b*, when the upper beams 112*a*, 112*b* are rotated toward the well center 58 to deliver a tubular or another item (e.g., tool, sub, etc.) to the well center 58 or the rig floor 16.

FIG. 4 also shows the arrangement of the upper beams 112*a*, 112*b* and the lower beams 114*a*, 114*b* as they can be connected to the support brackets 108*a*, 108*b*. The upper beams 112*a*, 112*b* are horizontally spaced apart by a distance L11 (i.e., space 160), and the lower beams 114*a*, 114*b* are also horizontally spaced apart by the distance L11 (i.e., space 162), which remains generally constant throughout the operation of the pipe handler 100. The arms 118, 120, and grippers 130*a*, 130*b* are transported through the spaces 160, 162 when the tubulars 60 or other items (e.g., tools, subs, bottom hole assemblies (BHA), etc.) are transported between the rig floor 16 and the horizontal storage area 30.

The upper beam 112*a* can be positioned vertically above the lower beam 114*a*, and spaced apart from the lower beam 114*a* by a distance L3, which can vary as the pipe handler 100 manipulates tubulars 60. The upper beam 112*b*, can be positioned vertically above the lower beam 114*b* and spaced apart from the lower beam 114*b* by a distance L3, which can vary as the pipe handler 100 manipulates tubulars 60. FIG. 4 clearly shows the arrayed positions of the upper beams 112*a*, 112*b*, and the lower beams 114*a*, 114*b* as connected to the support brackets 108*a*, 108*b*. It should be understood that the other end of the upper beams 112*a*, 112*b*, and the lower beams 114*a*, 114*b* are similarly arrayed when connected to the coupling structure 116. The parallelogram formed by beams 112*a*, 114*a*, support bracket 108*a*, and the coupling structure 116 can form a vertical plane 148. The parallelogram formed by beams 112*b*, 114*b*, support bracket 108*b*, and the coupling structure 116 can form a vertical plane 149, with the vertical planes 148, 149 being parallel and horizontally spaced apart.

Figure 5:
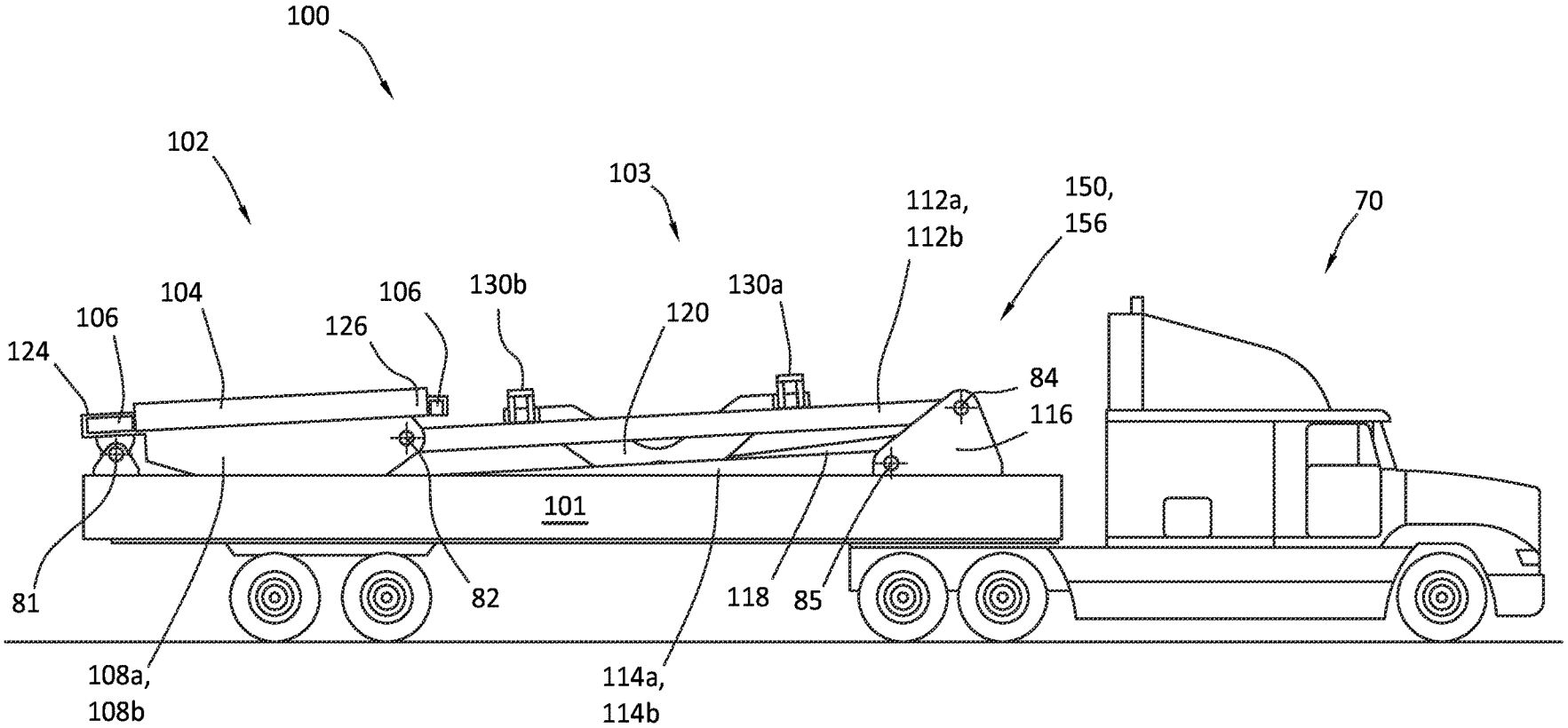
FIG. 5 is a representative side view of a pipe handler in a stowed position on a conveyance, in accordance with certain embodiments.
Figure 6:
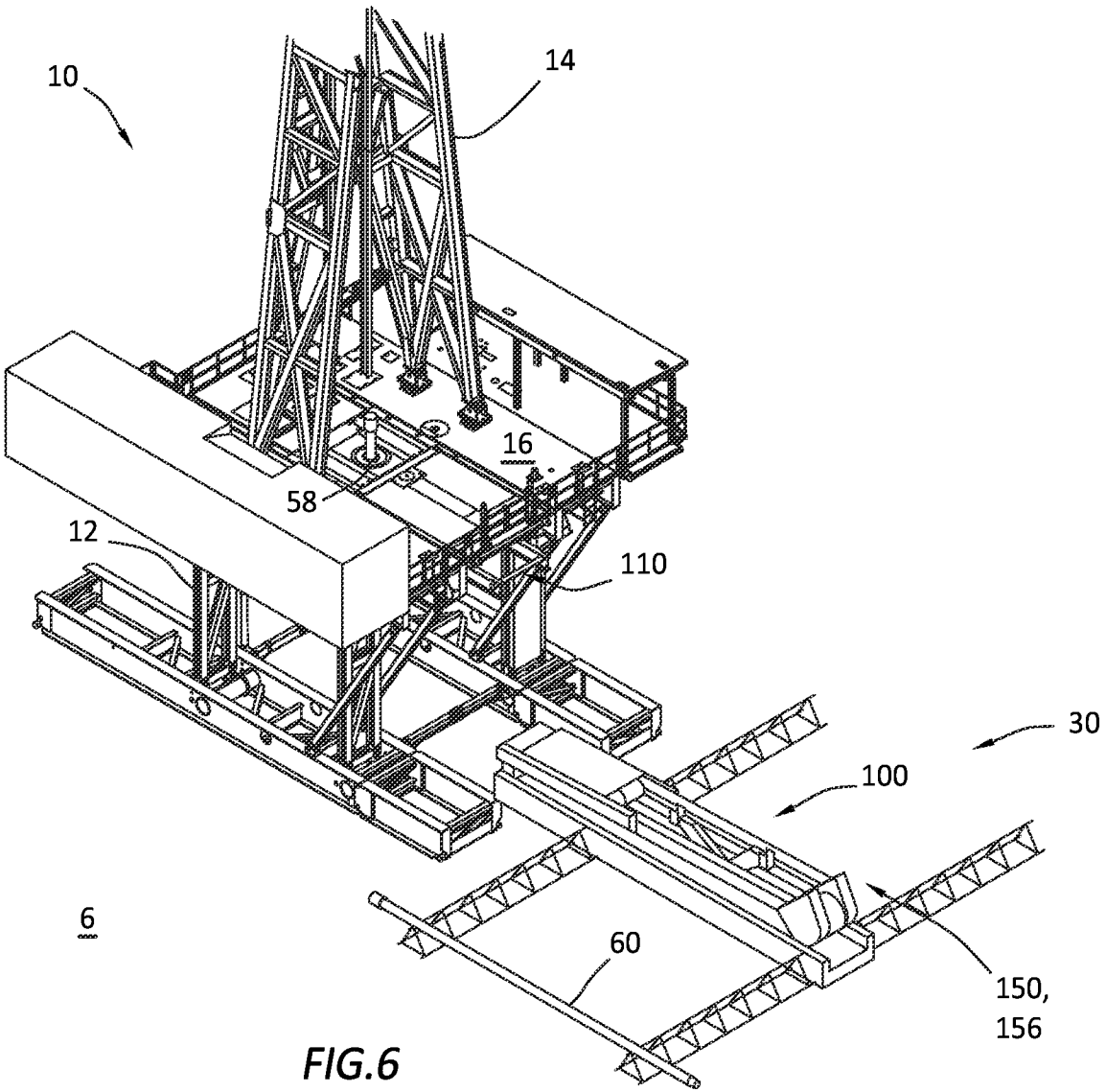
FIG. 6 is a representative perspective view of a rig with a pipe handler in a stowed position proximate the rig ready for deployment, in accordance with certain embodiments.

FIGS. 5-10 illustrate various operations for deploying a pipe handler 100 proximate a rig 10 to be used to manipulate and transport tubulars 60 or other items (e.g., tools, subs, BHA assemblies, etc.) between the rig floor 16 and the horizontal storage area 30. FIG. 5 is a representative side view of a pipe handler 100 in a stowed position 150, 156 on a conveyance 70. FIG. 6 is a representative perspective view of a rig 10 with a pipe handler 100 in a stowed position 150, 156 proximate the rig 10 and ready for deployment. FIGS. 7-10 are representative side views of a pipe handler 100 proximate a rig 10, the pipe handler 100 being shown in various positions from stowed 150, 156 to deployed positions 152, 154, 158.

Referring to FIG. 5, the pipe handler 100 can be transported by a conveyance 70 (e.g., 18-wheeler tractor trailer vehicle) to a well site where the pipe handler 100 can be off-loaded from the conveyance 70 proximate a rig 10. The telescopic support 102 and the pipe handler mechanism 103 of the pipe handler 100 are shown in their stowed positions 150, 156. The base 101 is resting on the conveyance 70, with the pipe handler mechanism 103 rotated into the stowed position 156 and resting on the base 101. The upper supports 104 of the telescopic support 102 are retracted relative to the lower supports 106 to their minimum (or stowed) position, and the telescopic support 102 is rotated about pivot 81 such that the pipe handler mechanism 103 rests on the base 101.

Referring to FIG. 6, the pipe handler 100 can be off-loaded from the conveyance 70 in the stowed 150, 156 positions and positioned proximate the V-door side of the rig 10. A horizontal storage area 30 for tubulars and other equipment can be constructed around the pipe handler 100. The pipe handler 100 should be positioned such that when the telescopic support 102 is rotated to a vertical position, it can be extended to engage the engagement means 110 on the rig 10.

Figure 7:
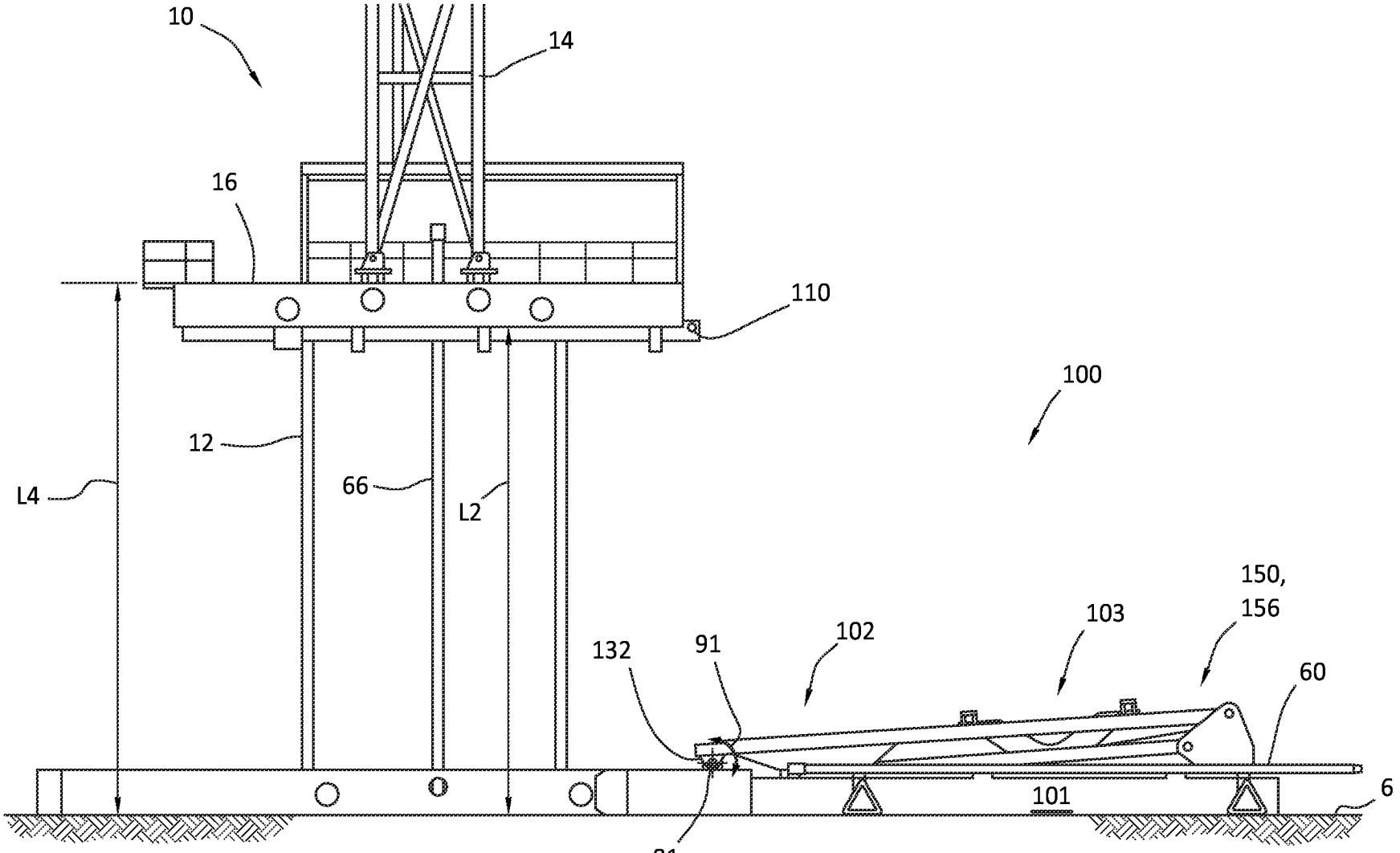
FIGS. 7-10 are representative side views of a pipe handler proximate a rig, the pipe handler being shown in various positions from stowed to deployed positions, in accordance with certain embodiments.

Referring to FIG. 7, the telescopic support 102 is in the stowed position 150 and the pipe handler mechanism 103 is in the stowed position 156. Rotating the telescopic support 102 (arrows 91) about the pivot 81 can raise the telescopic support 102, and along with it the pipe handler mechanism 103, from the base 101. The rig floor 16 can be positioned a distance L4 from the surface 6, with the engagement means 110 positioned a distance L2 from the surface 6.

Figure 8:
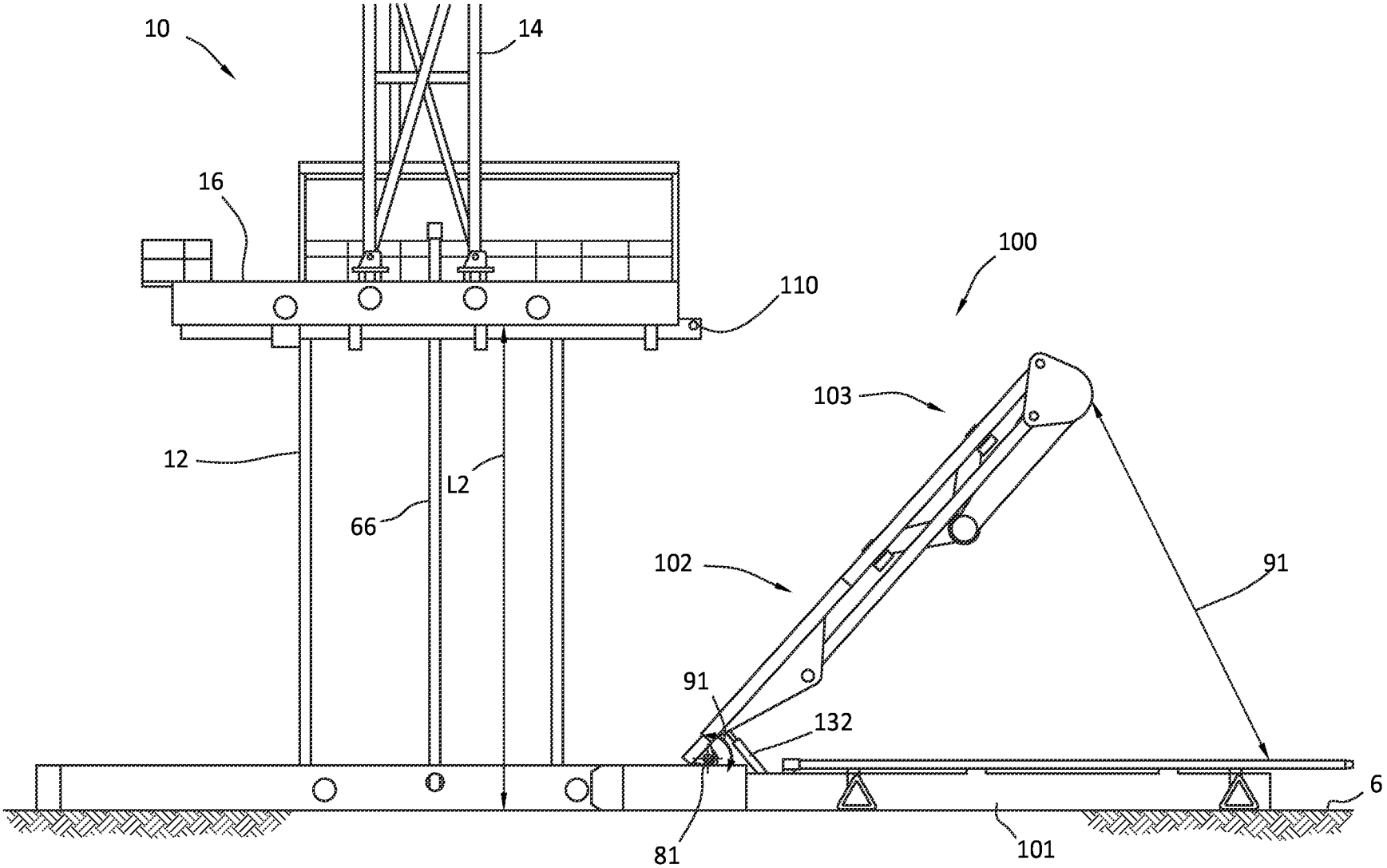

Referring to FIG. 8, the telescopic support 102 has been raised, via one or more actuators 132 (arrows 91) to an inclined position between the stowed position 150 and the deployed position 152. The pipe handler mechanism 103 remains in the stowed position 156 as the telescopic support 102 is being raised.

Figure 9:
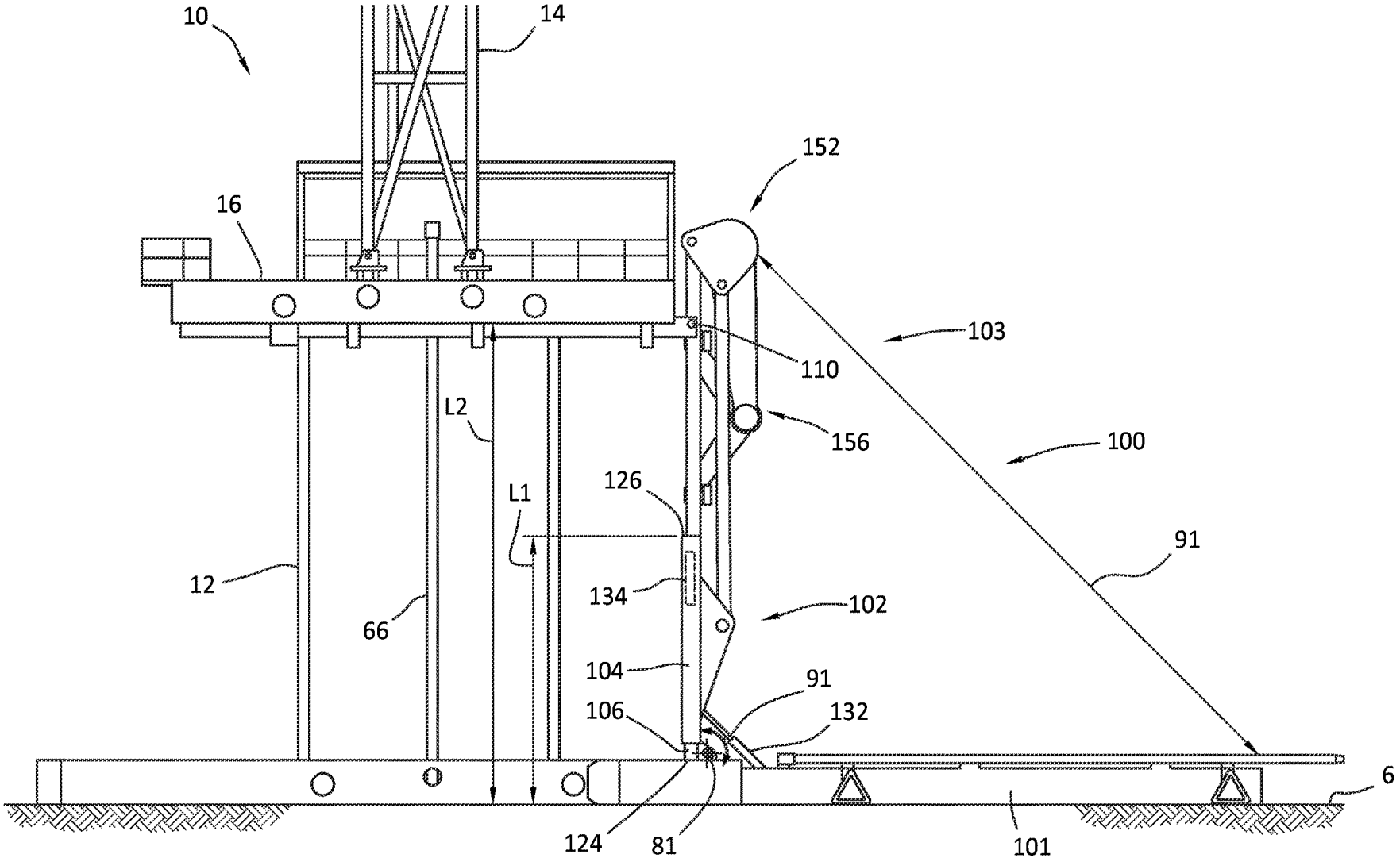

Referring to FIG. 9, the telescopic support 102 has been raised, via one or more actuators 132 (arrows 91) to a deployed position 152, which is generally vertical relative to the base 101. The pipe handler mechanism 103 remains in the stowed position 156 as the telescopic support 102 is being raised.

Figure 10:
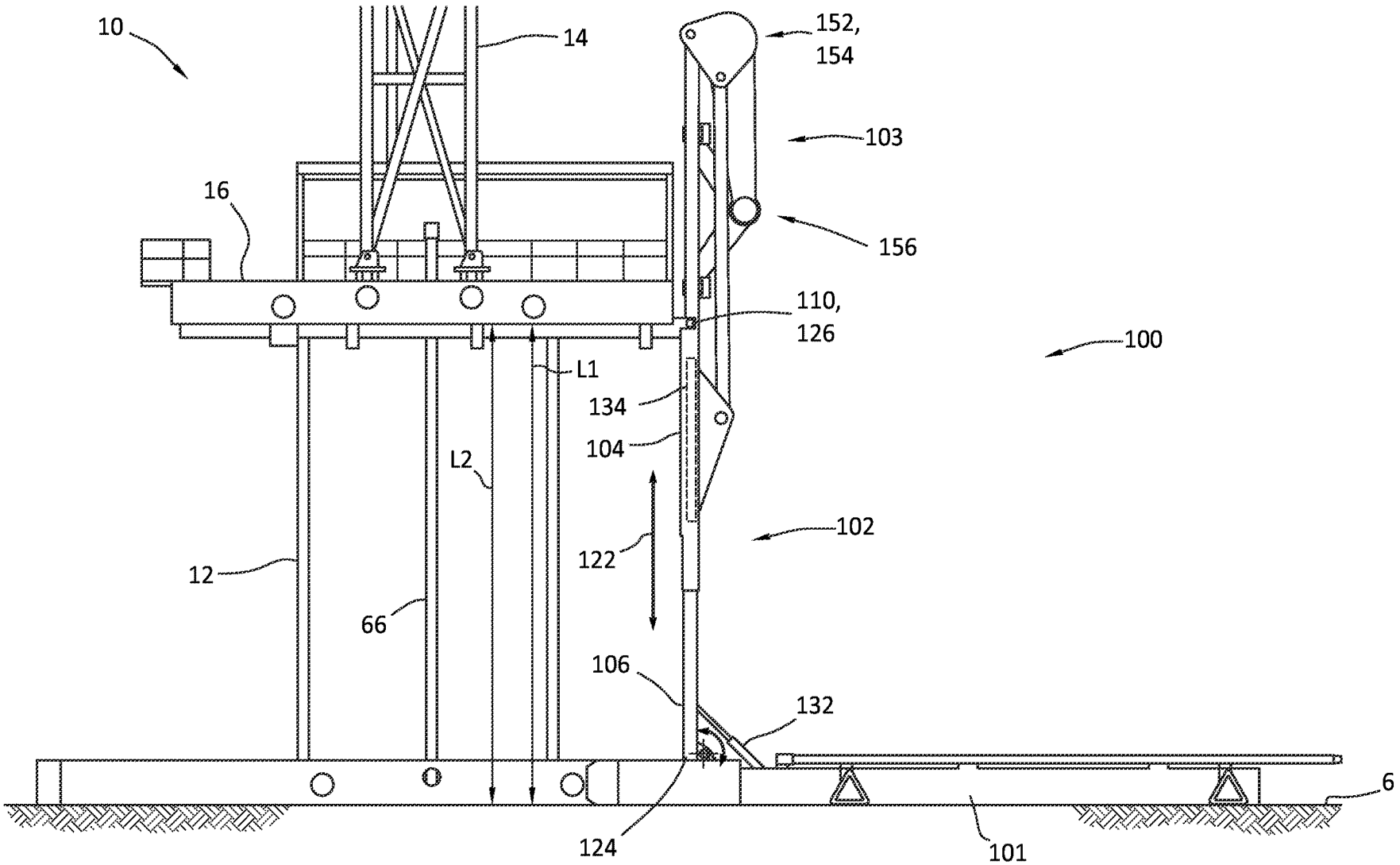

Referring to FIG. 10, while the telescopic support 102 is in the deployed position 152, one or more actuators 134 can be used to telescopically extend (arrows 122) the upper supports 104 relative to the lower supports 106, thereby extending the end 126 from the initial height L1 above the surface 6 (i.e., after the telescopic support 102 has been raised to the deployed position 152) to an engagement height L1 from the surface to the end 126 when the end 126 engages the engagement means 110. The telescopic support 102 is seen to be in its final deployed position 154 when it is vertical relative to the base 101 and extended into engagement with the engagement means 110.

FIGS. 11-16 illustrate various deployed positions 158 of the pipe handler mechanism 103 after the telescopic support 102 has been moved to the final deployed position 154. Once the telescopic support 102 has been moved to the final deployed position 154, the pipe handler mechanism 103 can be moved from its stowed position 156 to any deployed positions 158 between the deployed position that allows access to the horizontal storage area 30 and the deployed position that allows access to the well center 58.

Figure 11:
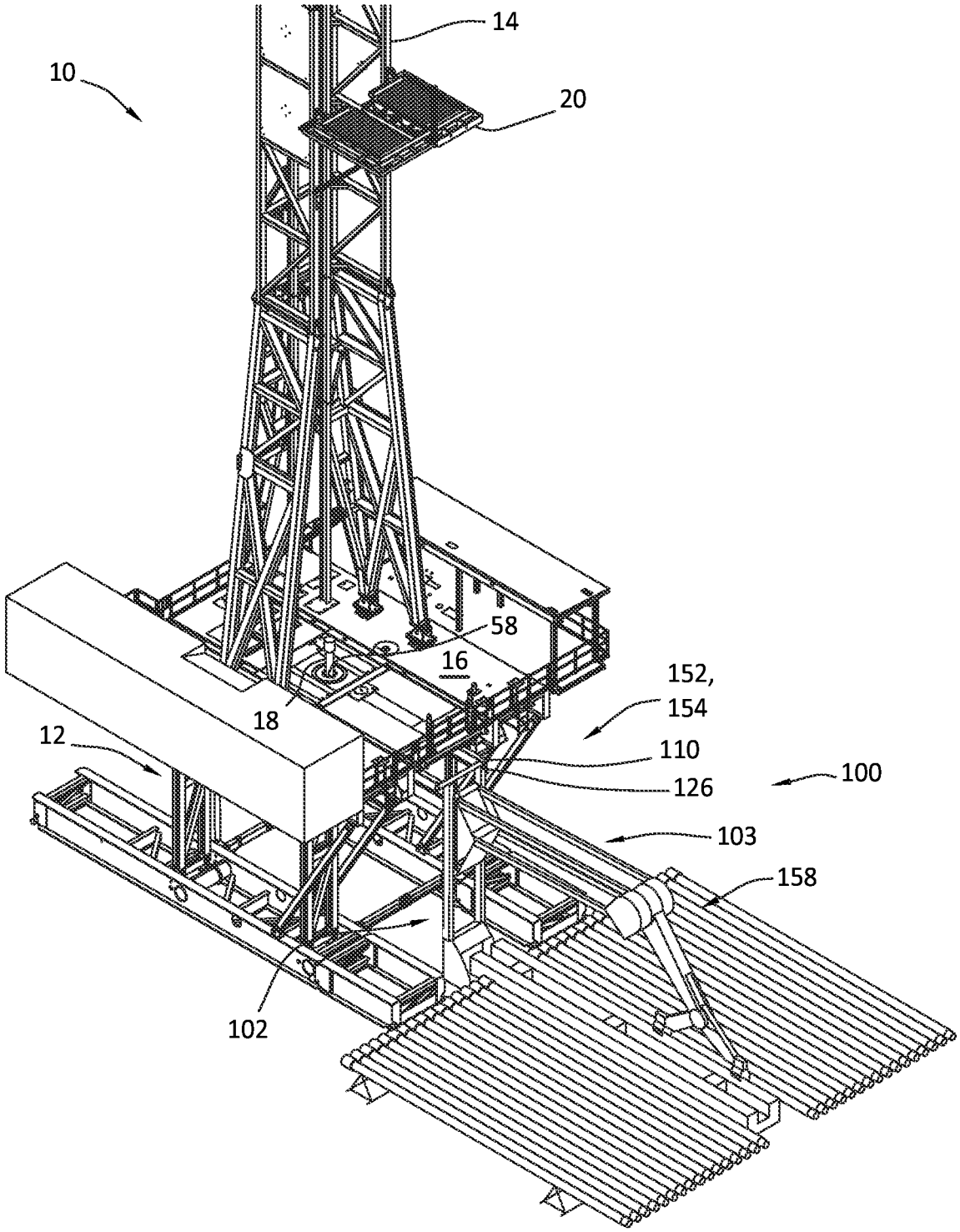
FIG. 11 is a representative perspective view of a pipe handler deployed at a rig and positioned just after collecting a tubular from a horizontal storage area or just before depositing the tubular in the horizontal storage, in accordance with certain embodiments.

FIG. 11 is a representative perspective view of a pipe handler 100 deployed at a rig 10 and positioned just after collecting a tubular 60 from a horizontal storage area 30 or just before depositing the tubular 60 in the horizontal storage area 30. FIGS. 12-15 are a representative side views of a pipe handler 100 deployed at a rig 10, the pipe handler 100 being shown in various deployed positions 158 from being positioned over the horizontal storage area 30 to being positioned at a well center 58. FIG. 16 is a representative perspective view of a pipe handler 100 deployed at a rig 10 and positioned just after collecting a tubular 60 from a well center 58 or just before delivering the tubular 60 to the well center 58. Using the elements of the pipe handler 100 described above regarding FIGS. 1-4, the upper beams 112*a*, 112*b*, the lower beams 114*a*, 114*b*, the arm 118, and the arm 120 can be rotated relative to the support brackets 108*a*, 108*b* to position the pipe handler 100 in any of the deployed positions 158 between accessing to the horizontal storage area 30 and accessing to the well center 58.

Referring to FIG. 11, the upper beams 112*a*, 112*b* and the lower beams 114*a*, 114*b* can be rotated relative to the support brackets 108*a*, 108*b* to lower the coupling structure 116 toward the horizontal storage area 30, which also lowers the arms 118 and 120. The arms 118, 120 can be rotated into position as shown to align the grippers 130*a*, 130*b* with a tubular 60 in the horizontal storage area 30, grip the tubular 60 with the grippers 130*a*, 130*b*, and lift the tubular 60 from the horizontal storage area 30. Deployed position 158 can also be used to deliver a tubular 60 to the horizontal storage area 30 by releasing the tubular 60 from the grippers 130*a*, 130*b* and depositing the tubular 60 in the horizontal storage area 30.

Figure 12:
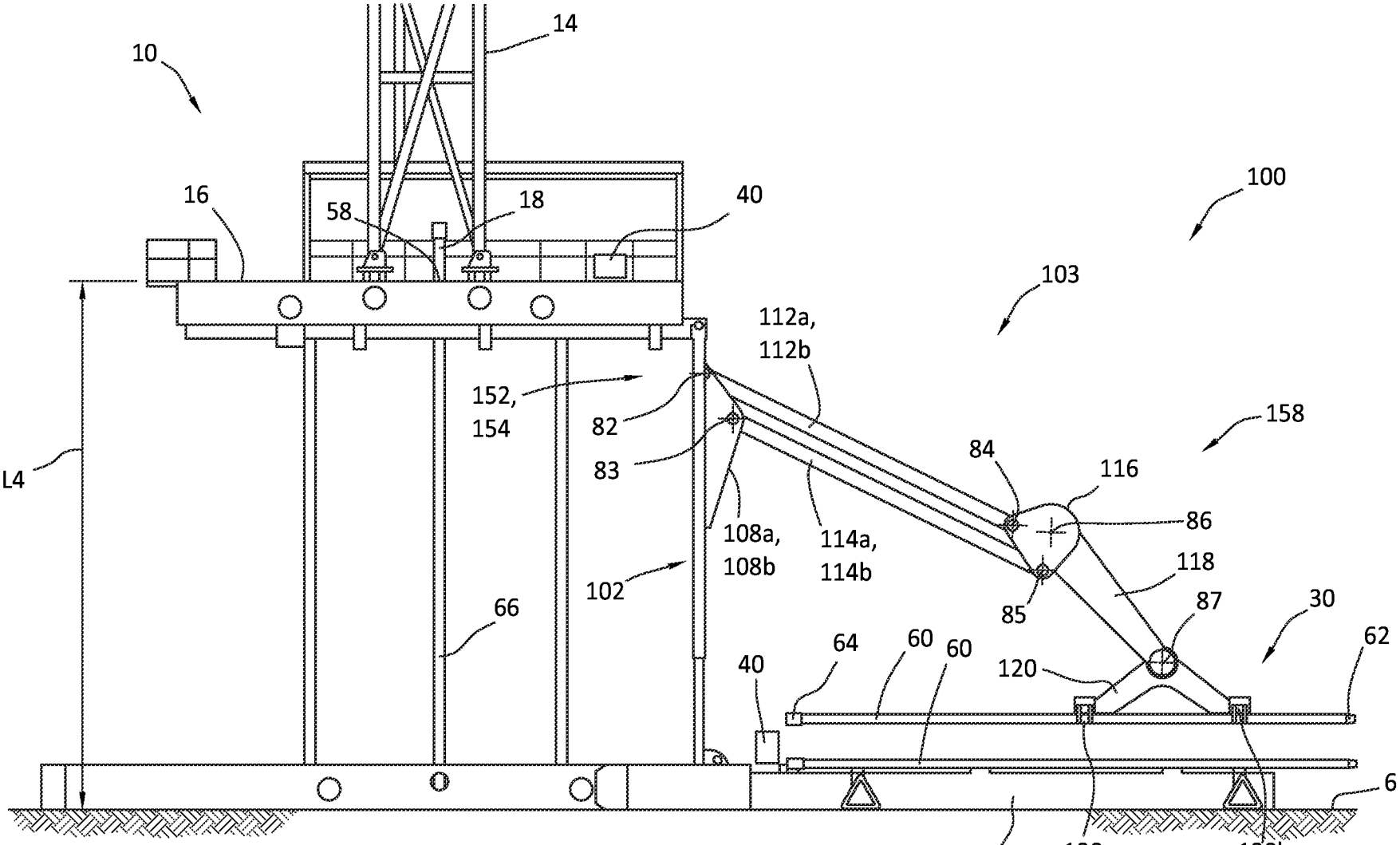
FIGS. 12-15 are representative side views of a pipe handler deployed at a rig, the pipe handler being shown in various positions from positioned over a horizontal storage area to positioned at a well center, in accordance with certain embodiments.

Referring to FIG. 12, it illustrates a side view of the pipe handler 100 in a deployed position 158 with a tubular 60 being positioned just above the tubulars 60 in the horizontal storage area 30, with the grippers 130*a*, 130*b* holding the tubular 60 in the elevated position. It can easily be seen how the parallelograms of the pipe handler 100 operate to lower the arms 118, 120. The pipe handler 100 can be controlled to insert the tubular 60 into the doping bucket 40 and rotate an end of the tubular 60 in the doping bucket 40 to clean, dry, and dope the threads on the end 62 or 64 of the tubular 60.

Figure 13:
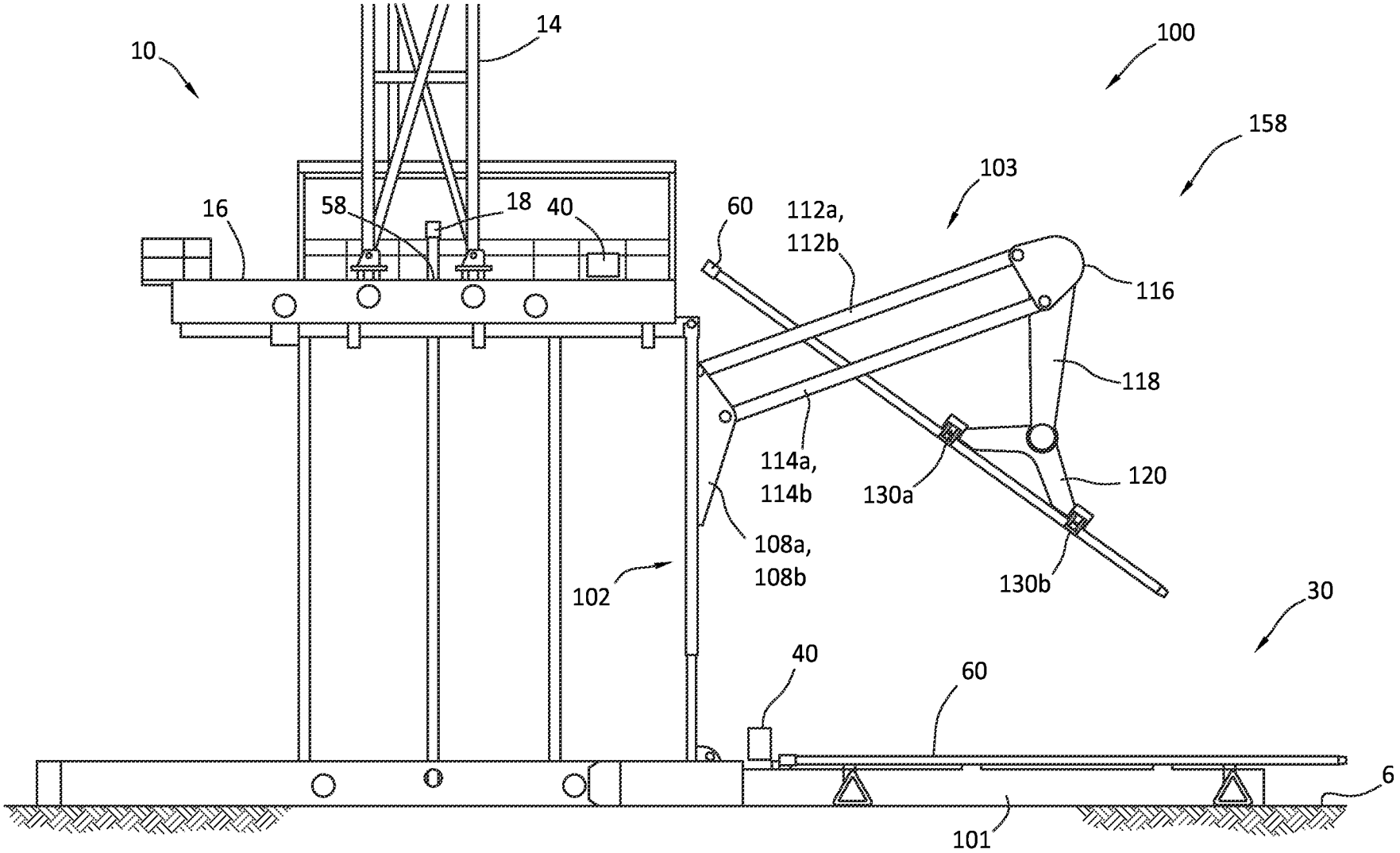

Referring to FIG. 13, it illustrates a side view of the pipe handler 100 in a deployed position 158 with the upper beams 112*a*, 112*b* and the lower beams 114*a*, 114*b* rotated upward relative to the horizontal storage area 30, thereby widening the space L3 between the pair of upper beams 112*a*, 112*b* and the pair of lower beams 114*a*, 114*b*. The arm 120, with grippers 130*a*, 130*b* engaged with the tubular 60, and the arm 118 have rotated the tubular 60 into the horizontal space 160 between the beams 112*a*, 112*b* (see FIG. 4), and the horizontal space 162 between the beams 114*a*, 114*b*. The pipe handler 100 is controlled to avoid collision of the tubular 60 with other equipment, the rig 10, or rig personnel, as the tubular 60 is moved between the horizontal storage area 30 and the well center 58.

Figure 14:
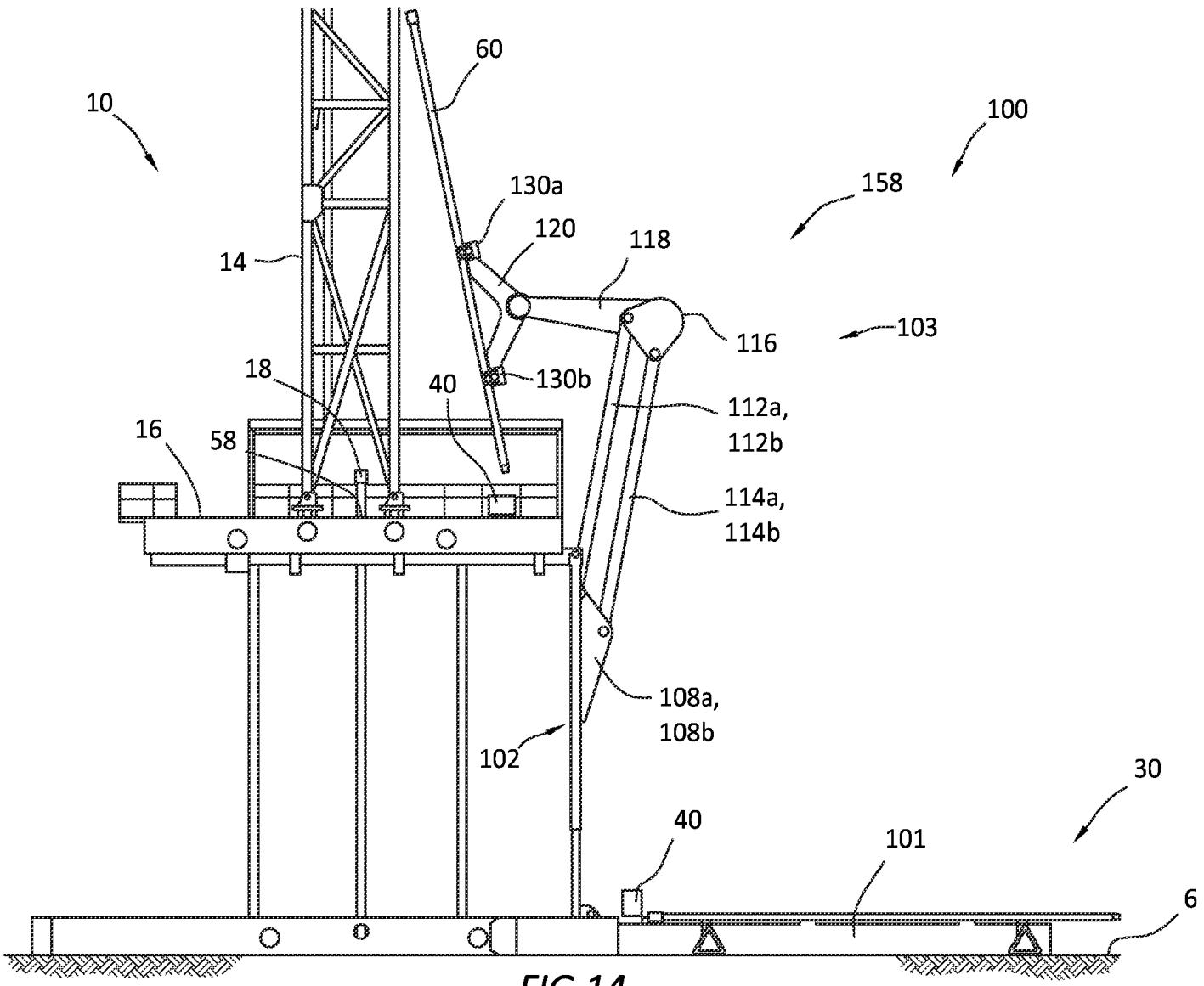

Referring to FIG. 14, it illustrates a side view of the pipe handler 100 in a deployed position 158 with the upper beams 112*a*, 112*b* and the lower beams 114*a*, 114*b* rotated further upward relative to the horizontal storage area 30, where the space L3 between the pair of upper beams 112*a*, 112*b* and the pair of lower beams 114*a*, 114*b* is narrowing from its maximum distance when the parallelograms formed a rectangular shape. The arms 118, 120 have been rotated toward the well center 58. In this position, or a deployed position 158 near this position, the pipe handler 100 can insert another end 62 or 64 into a doping bucket 40 to clean, dry, and dope the threads on the end. It should be understood that the doping buckets 40 are shown in possible locations that can provide access by the pipe handler 100, however, other locations on the rig 10 and in the horizontal storage area 30 are also possible. The doping buckets are not limited to the two indicated locations in FIG. 14.

Figure 15:
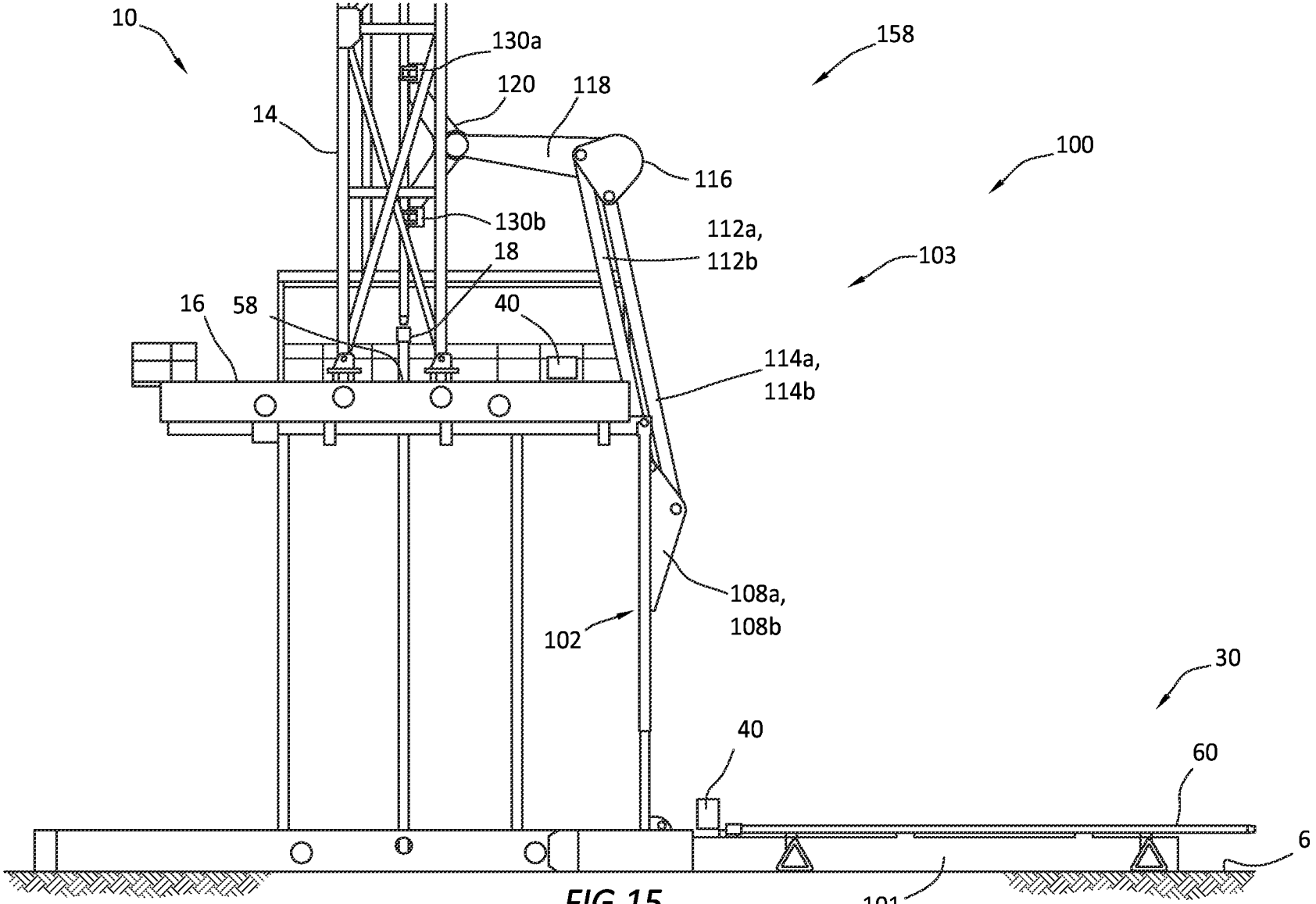
Figure 16:
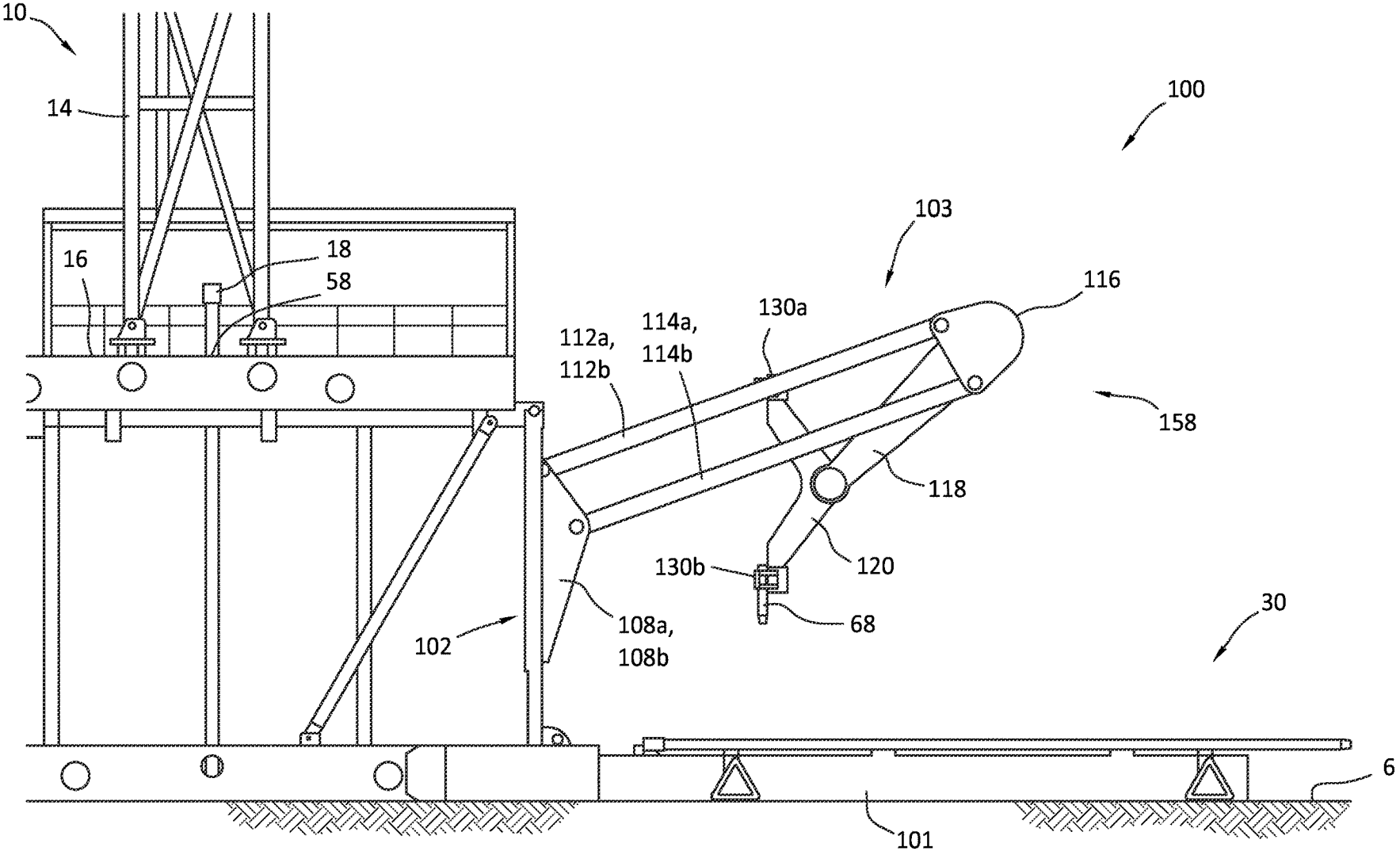
FIGS. 16-17 are representative side views of a pipe handler deployed at a rig, the pipe handler being shown in various positions when transporting a tool between a horizontal storage area and a rig floor or well center, in accordance with certain embodiments.

Referring to FIG. 15, it illustrates a side view of the pipe handler 100 in a deployed position 158 with the upper beams 112*a*, 112*b* and the lower beams 114*a*, 114*b* rotated further toward the well center 58, where the space L3 between the pair of upper beams 112*a*, 112*b* and the pair of lower beams 114*a*, 114*b* is further narrowed as the grippers 130*a*, 130*b* holding the tubular 60 are moved closer to the well center 58. In this deployed position 158, the grippers 130*a*, 130*b* can be used to spin the tubular 60 onto the stickup 18 at the well center 58 or used to spin the tubular 60 off of the tubular string 66 leaving a stickup 18 at well center 58. The arms 118, 120 can accommodate tubular strings 66 that may be angled at the well center 58 by angling the tubular 60 being attached to the stickup to match the stickup angle relative to the rig floor 16, or the arms 118, 120 can be used to angle the grippers 130*a*, 130*b* to engage a tubular 60 attached to the top end of the tubular string 66 that may be angled relative to the rig floor 16.

Alternatively, the pipe handler 100 can align the tubular 60 with a top drive (not shown) and hand-off the tubular 60 to the top drive, which can then lower the tubular 60 onto the stickup 18 and spin the tubular 60 onto the stickup 18. The pipe handler 100 can also receive a tubular 60 that has been disconnected from the top end of the tubular string 66 by the top drive (or other rig equipment) and collect the tubular 60 from the top drive (or other rig equipment), then transport the tubular 60 to the horizontal storage area 30 (or other delivery location).

Figure 17:
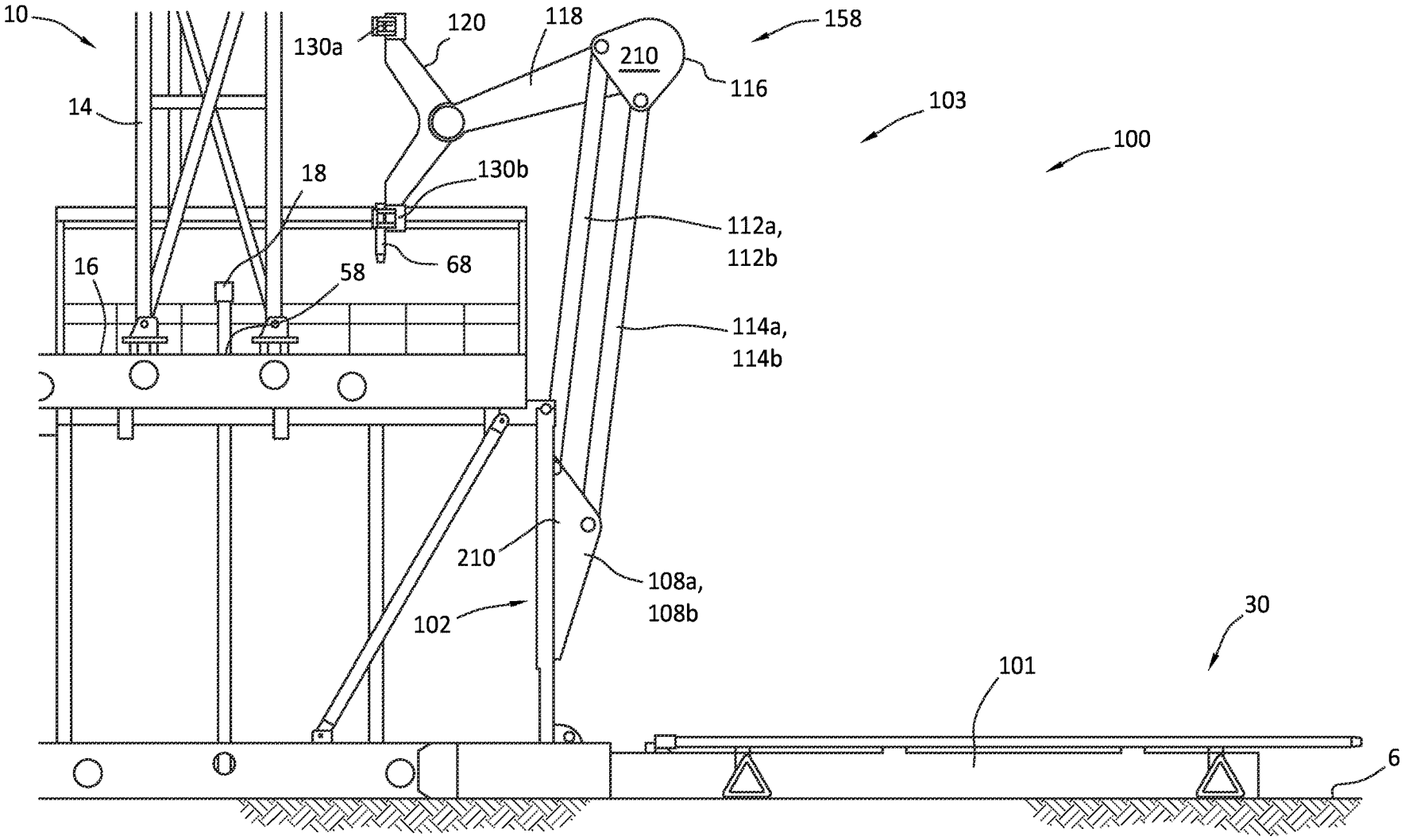

FIGS. 16-17 illustrate various deployed positions 158 of the pipe handler mechanism 103 transporting a tool 68 (or other small equipment that can be carried by only one gripper 130*a* or 130*b*) between the rig floor 16 and the horizontal storage area 30. The arms 118, 120 can be rotated to accommodate picking up a vertically oriented tool 68 from a pickup location (e.g., the horizontal storage area 30, the rig floor 16, vertical storage on rig floor, another pipe handler, top drive, elevator, casing running tool, mouse hole, slips, stick up, etc.) and transporting the tool 68 (or other small equipment) to a delivery location (e.g., the horizontal storage area 30, the rig floor 16, vertical storage on the rig floor, another pipe handler, top drive, elevator, casing running tool, mouse hole, slips, stick up, etc.). FIG. 16 shows that arms 118, 120 rotated into the horizontal spaces 160, 162 between the beams as the arms 118, 120 transport the tool 68 up to the rig floor 16 or down to the horizontal storage area 30. It should be understood that the tool 68 can also be stored in a horizontal orientation or an inclined orientation in any of the pickup locations. The pipe handler 100 can align with the tool 68, or tubulars 60, or BHA's, or other objects, as needed to engage and manipulate them about the rig 10. FIG. 17 is a representative side view of the rig 10 and pipe handler 100 in a deployed position 158 with the arms 118, 120 over the rig floor 16 to deposit the tool 68 to a delivery location or just after the pipe handler 100 has collected the tool 68 from a pickup location. It should be understood that the local controller 210 of the pipe handler 100 can be disposed at one or more locations in or on the pipe handler 100. The controller 210 (or also the rig controller 200) can control the pipe handler 100 to pickup or deliver objects (e.g., tubulars, tools, rig equipment, etc.) between delivery and pickup locations. By receiving information (i.e., measurements, size, weight, length, position in the pickup area, location of no grip zones and grippable zones on the object, etc.) regarding the object to be gripped and transported by the pipe handler 100, the controller 210 (or the rig controller 200) can operate the pipe handler 100 to automatically adapt to various horizontal locations and various vertical locations of the objects relative to the rig floor 16 to pickup and deliver the object between pickup and delivery locations. For example, FIG. 13 has a rig floor that is vertically higher than the rig floor in FIG. 16. Due to the adaptability of the pipe handler 100, the pipe handler 100 can adapt autonomously to various vertical distances between the horizontal storage area 30 and the rig floor 16 (or stickup 18). It can also be shown (described in more detail below) that the pipe handler 100 can adapt autonomously to various horizontal distances between the horizontal storage area 30 and the rig floor 16 (or stickup 18).

Figure 18:
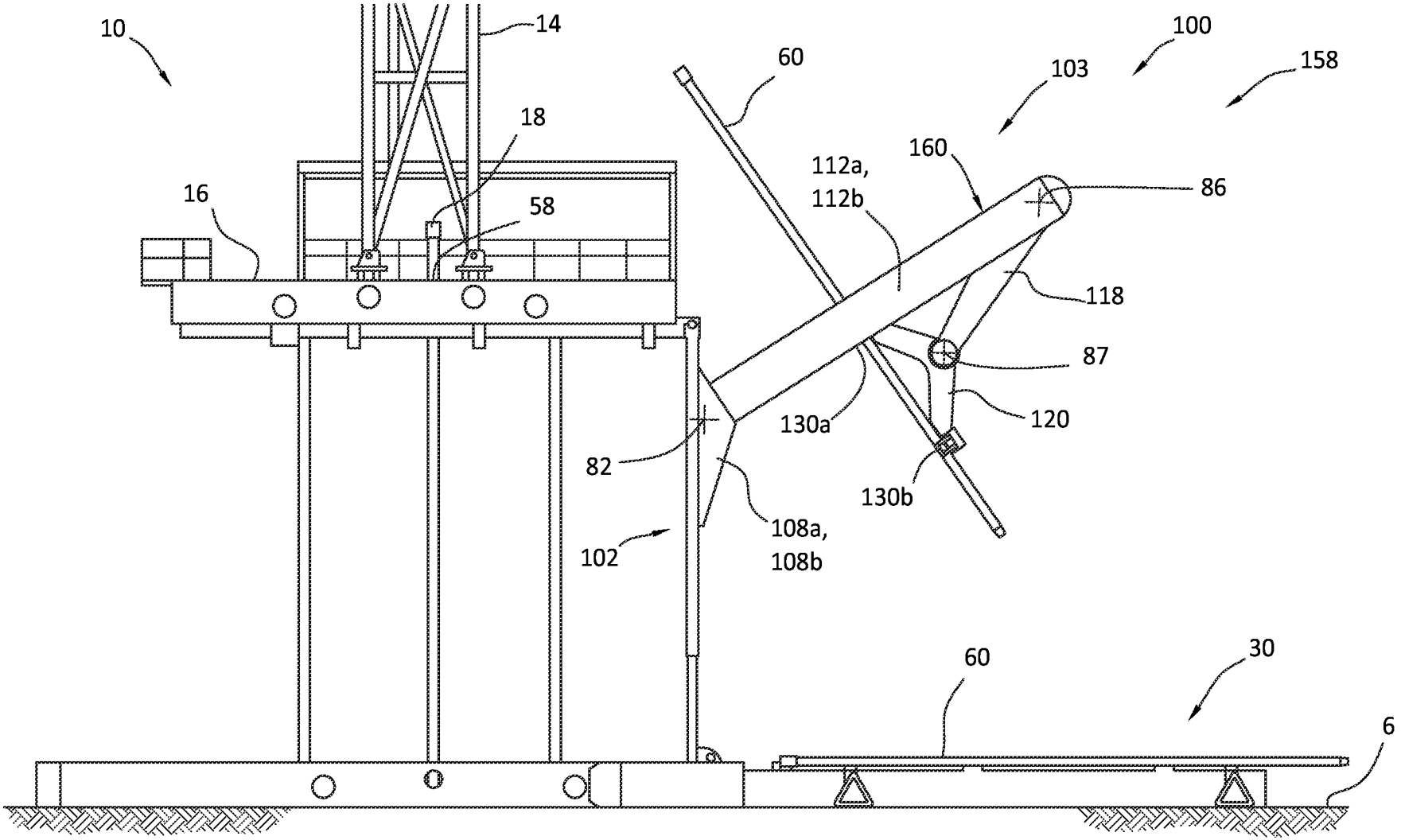
FIG. 18 is a representative side view of another pipe handler at a rig, the pipe handler being in a deployed position transporting a tubular, in accordance with certain embodiments.

FIG. 18 is a representative side view of a pipe handler 100 at a rig 10, with the pipe handler depicted in a deployed position 158 transporting a tubular 60 to or from a horizontal storage area 30. This pipe handler 100 embodiment is very similar to the previously described pipe handler 100 embodiments, except that it does not have an array of beams that form the two parallelograms. This pipe handler 100 can include only two beams 112*a*, 112*b* that are horizontally spaced apart by a space 160 and are parallel with respect to each other. One end of each beam 112*a*, 112*b* can be rotationally coupled to a respective support bracket 108*a*, 108*b* at pivot 82, with the other end of each beam 112*a*, 112*b* being rotationally coupled to the arm 118 at pivot 86. The arm 118 is rotationally coupled to a pivot 87 of the arm 120, with the pivot 87 being substantially located in the middle of the arm 120 between the two grippers 130*a*. 130*b*.

As the beams 112*a*, 112*b* are rotated up or down, the arms 118, 120 can be rotated to access the horizontal storage area 30 or the rig floor 16 (or any other desired location along a path between the horizontal storage area 30 and the well center 58 on the rig floor 16). The arms 118, 120 can be rotated through the horizontal space 160 between the beams 112*a*, 112*b* to transport an object (e.g., a tubular 60, tool 68, sub, BHA, etc.) between the horizontal storage area 30 and the well center 58. The pipe handler 100 with the single pair of beams 112*a*, 112*b* can operate similar to the previously described pipe handlers 100, including being transported in the stowed positions 150, 156 and being deployed into the deployed positions (e.g., 152, 154, 158), and operating to transport objects between horizontal storage area 30 or the rig floor 16.

The rig controller 200 can include non-transitory memory for storing executable commands and one or more processors for reading and executing the commands of a control program to perform any of the operations (or methods) described in this disclosure. The controller 200 can include local controllers in the pipe handler 100 that coordinate together to rotate the upper beams 112*a*, 112*b*, the lower beams 114*a*, 114*b*, the arm 118, the arm 120, and the grippers 130*a*, 130*b* to selectively engage objects (e.g., tubulars 60, BHAs, tools 68, or other rig equipment), manipulate these objects from a pickup location to a delivery location and deposit the objects at the delivery location. A control program being executed by the rig controller 200 coordinates the elements of the pipe handler 100 to perform the tasks described in this disclosure.

However, it should be understood that the local controller 210 in the pipe handler 100 can operate autonomously and control the pipe handler 100 to rotate the upper beams 112*a*, 112*b*, the lower beams 114*a*, 114*b*, the arm 118, the arm 120, and the grippers 130*a*, 130*b* to selectively engage objects (e.g., tubulars 60, BHAs, tools 68, or other rig equipment), manipulate these objects from a pickup location to a delivery location and deposit the objects at the delivery location. A control program being executed by the pipe handler controller 210 can perform the tasks described in this disclosure or direct the tasks to be performed by the pipe handler 100.

The pipe handler 100 can receive characteristics of the tubulars 60, BHAs, tools 68, or other rig equipment via data from ground operations (e.g., the horizontal storage area operations), rig operations for other delivery and pickup locations, as well as operator inputs to communicate the characteristics to the pipe handler controllers.

FIGS. 19-24 illustrate various deployed positions 158 of the pipe handler mechanism 303 of the pipe handler 300 according to certain embodiments. The pipe handler 300 operates similarly to the operation described above regarding the pipe handler 100, with elements having the same reference numeral being configured to operate the same as those like numbered elements of the pipe handler 100. Therefore, the descriptions above related to the like numbered items directly apply to the pipe handler 300, which also applies to related elements to the like numbered elements that are not specifically identified in the FIGS. 19-24. For example, the upper beams 112*a*, 112*b*, the lower beams 114*a*, 114*b*, the coupling structure 116, the arms 118 and 120, and the grippers 130*a*, 130*b* elements include the related pivots 82, 83, 84, 85, 86, 87 even though the pivots are not explicitly indicated with reference numerals in FIGS. 19-24, but they are nevertheless included in the pipe handler 300. Additionally, FIGS. 19-24 illustrate the pipe handler 300 manipulating a tubular from a pickup location in the horizontal storage area 30 to a delivery location at well center 58*a*, 58*b*. However, the pipe handler 300 is not limited to the operations depicted in FIGS. 19-24. For example, the pickup location can be the well center 58*a*, 58*b* and the delivery location can be the horizontal storage area 30. The object can be a tool 68 or any other object suitable for transport by the pipe handler 300, other than the tubular 60. The FIGS. 19-24 merely illustrate an example of transporting an object using the pipe handler 300 and the moving parts controlled by the pipe handler controller 210 (or rig controller 200) to facilitate the autonomous operation of the pipe handler 300 (which also applies to pipe handlers 100, 400, in that they are not limited by the embodiments shown in the figures).

Figure 19:
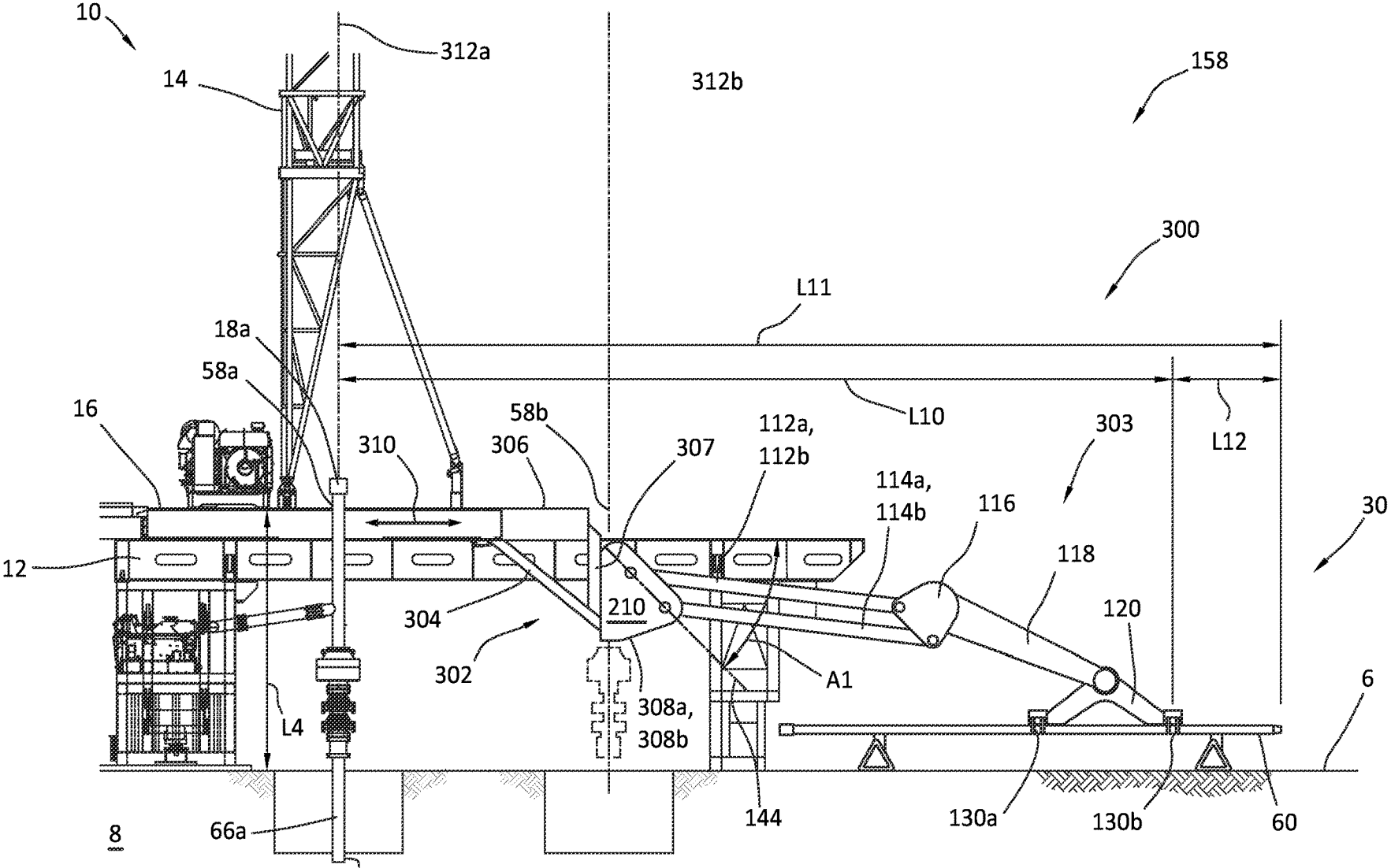
FIGS. 19-24 are representative side views of another pipe handler at a rig, the pipe handler being in various deployed positions transporting a tubular, in accordance with certain embodiments.

FIG. 19 is a representative side view of a pipe handler 300 attached to a rig 10, the pipe handler 300 being in a deployed position 158 shown stretched out over a horizontal storage area 30. The rig 10 in this configuration can include a platform 12 that supports a derrick 14 with a moveable rig floor 16 that can move along the platform 12 between two spaced apart well centers 58*a*, 58*b*. The rig floor 16 can move laterally (arrows 310) along a top surface of the platform 12 between well center 58*a* (i.e., well A with center axis 312*a*) and well center 58*b* (i.e., well B with center axis 312*b*) as needed to perform subterranean operations on wells A and B. The pipe handler 300, being attached to a side of the rig floor 16 via a support 302, can move with the rig floor 16 relative to the platform 12. The pipe handler 300 is configured to access the stationary horizontal storage area 30 from either of the well A or well B locations.

The pipe handler 300 can be attached to the rig floor 16 via the support 302, which can include a pair of support brackets 308*a*, 308*b*, a coupling 306, and a vertical end support 307, and one or more angled braces 304 to stabilize the end support 307 to the coupling 306 or the rig floor 16. The pair of support brackets 308*a*, 308*b* can be fixedly attached to the end support 307 and rotationally attached to one end of the upper beams 112*a*, 112*b*, and to one end of the lower beams 114*a*, 114*b* at respective pivots 82, 83 (refer to FIG. 2). The support brackets 308*a*, 308*b* are similar to the support brackets 108*a*, 108*b* of the pipe handler 100, except that the support brackets 308*a*, 308*b* are fixedly attached to the rig floor 16. The pivots 82, 83 can form a plane 144 that can be angled relative to the rig floor 16 by an angle A1. The angle A1 can determine the access of the pipe handler 300 along the rig floor 16 and the vertical distance below the rig floor 16 that is accessible by the pipe handler 300.

The rig 10, in FIG. 19, is configured such that the derrick 14 and the rig floor 16 are positioned over the well A location having a tubular string 66*a* in a wellbore 50*a*. The pipe handler 300 is extended over the horizontal storage area 30 such that the gripper (e.g., gripper 130*b*) that is farthest away from the rig floor is spaced a distance L10 from the center axis 312*a*. The tubular 60 is positioned in a pickup location in the horizontal storage area 30 with the end of the tubular 60 (in this example the pin end of the tubular 60) being farthest away from the rig floor 16 at a distance L11 from the center axis 312*a*. This provides a distance L12 between the gripper 130*b* and the pin end of the tubular 60. The distance L12 can be the desired distance between the gripper 130*b* and the pin end when the pipe handler 300 engages and lifts the tubular 60 from the pickup location in the horizontal storage area 30.

It should be understood that parameters of the tubular 60 and the horizontal storage area can be communicated to the pipe handler controller 210 (or the rig controller 200) and used to autonomously control the pipe handler 300 to adapt the position of the grippers 130*a*, 130*b* on the tubular 60 to provide the distance L12 from the gripper 130*b* to the pin end of the tubular 60. For example, if the tubular 60 is positioned closer to the rig floor 16 in the horizontal storage area 30 than a previous tubular 60, then the pipe handler controller 210 can autonomously control the pipe handler 300 to engage the tubular 60 such that the distance L11 is less to allow for the desired distance L12 to remain constant. It is not a requirement that the distance L12 remain constant, but it may be preferred, since the distance L12 determines the height needed to raise the tubular 60 in a vertical orientation over the stickup 18*a* at well center 58*a* when the pipe handler 300 delivers the tubular 60 to the well center 58*a* when delivering the tubular 60 to well center 58*a*.

It should be understood that the desired distance L12 can be communicated to the controller 210 (or the rig controller 200) and can be different for each tubular 60 or object to be engaged by one or more grippers 130*a*, 130*b* of the pipe handler 300. The controller 210 knows the position of the rig floor (whether over well A location or well B location) and the position of the horizontal storage area 30, and adapts the pipe handler 300 through manipulation of the beams 112*a*, 112*b*, 114*a*, 114*b* and the arms 118, 120 to adapt to the variable distance L11 from the center axis 312*a* or 312*b* to the end of the object (e.g., tubular 60).

As can be seen, if the horizontal storage area 30 were vertically lower than shown in FIG. 19 (i.e., distance L4 being longer or the horizontal storage area 30 being lower), then the maximum distance L10 supported by the pipe handler 300 can be reduced since it would have to rotate the pipe handler mechanism 303 further down to engage the tubular 60. It should be understood, similar to the pipe handler 100, that the pipe handler 300 can autonomously adapt to horizontal storage areas 30 that are at varying vertical heights relative to the rig floor 16, as well as horizontal storage areas 30 that are at varying horizontal distances from the well center.

Figure 20:
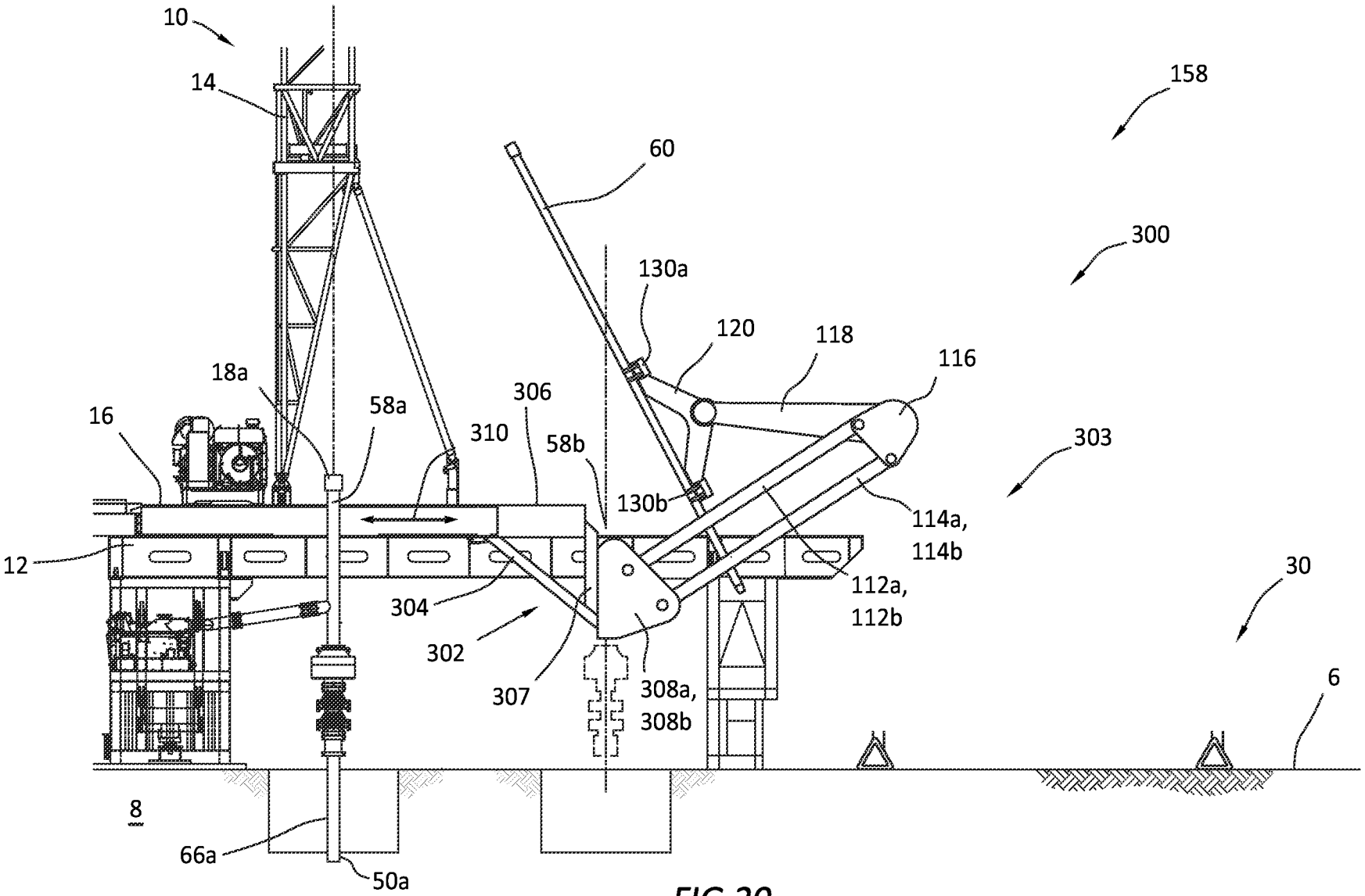

Referring to FIG. 20, the pipe handler mechanism 303 has engaged the tubular 60 via the grippers 130*a*, 130*b* and rotated the tubular 60 from the pickup location (e.g., the horizontal storage area 30) at least partially through a horizontal space between the beams 112*a*, 112*b* and a horizontal space between the beams 114*a*, 114*b*. The beams 112*a*, 112*b*, 114*a*, 114*b* have been rotated up toward the rig floor 16, with the arms 118, 120 controlled to manipulate the tubular 60 such that the box end of the tubular 60 avoids the support brackets 308*a*, 308*b* as it is picked up from the horizontal storage area 30 and lifted through the spaces between the beams 112*a*, 112*b* and the beams 114*a*, 114*b*. It should be understood that only one pair of beams (e.g., 112*a*, 112*b*) can be used in the pipe handler 300, similar to the pipe handler 100 in FIG. 18.

Figure 21:
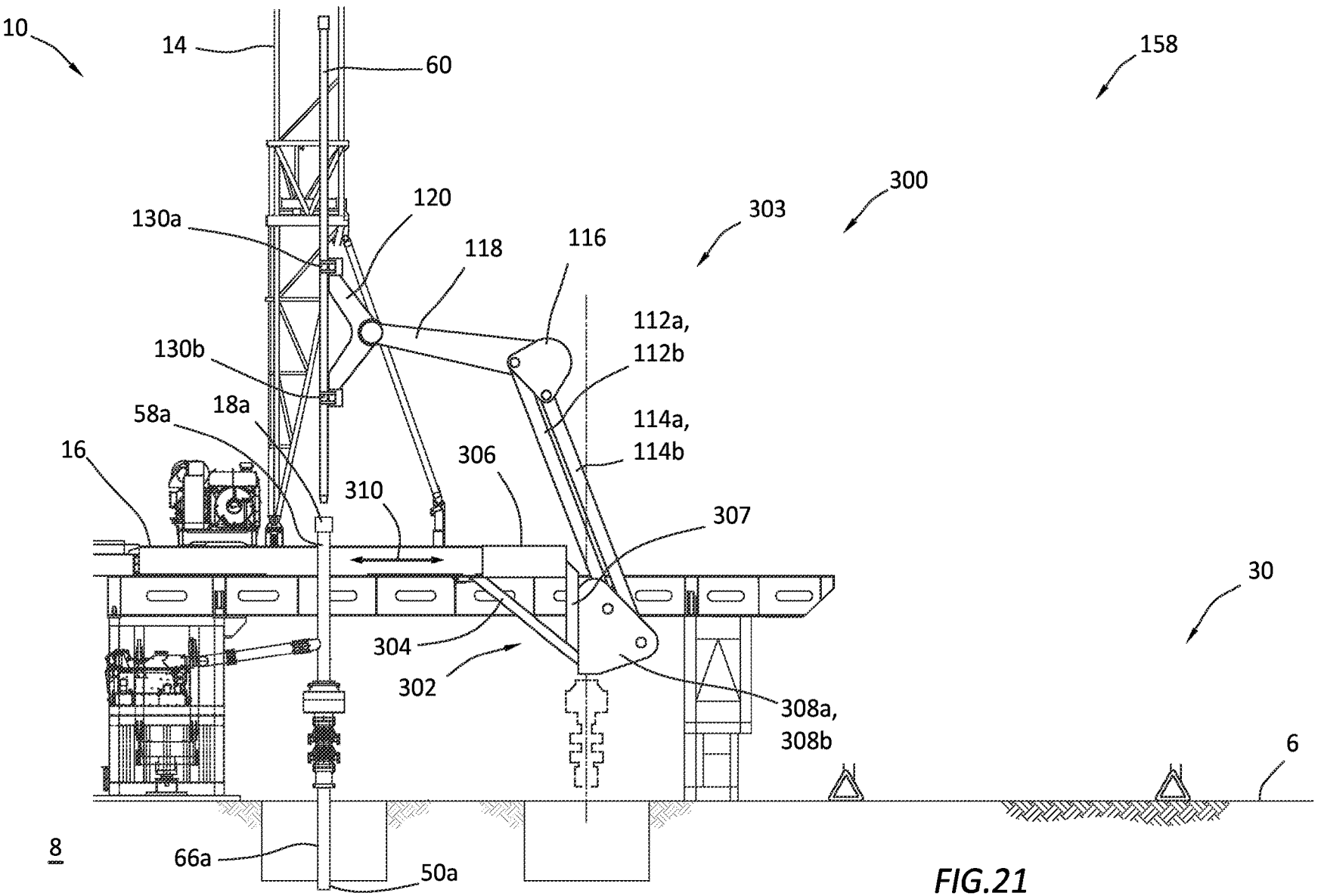

Referring to FIG. 21, the pipe handler mechanism 303 has engaged the tubular 60 via the grippers 130*a*, 130*b* and rotated the tubular 60 from the pickup location (e.g., the horizontal storage area 30) through the space between the beams 112*a*, 112*b* and the space between the beams 114*a*, 114*b*, and presented the tubular 60 in a vertical orientation above the stickup 18*a* at the well center 58*a*. The beams 112*a*, 112*b*, 114*a*, 114*b* have been rotated toward the rig floor 16, with the arms 118, 120 controlled to manipulate the tubular 60 such that the box end of the tubular 60 avoids the derrick 14 and any other obstacles near the transport path of the tubular 60 as it is lifted to the vertical orientation. The controller 210 can then operate the components of the pipe handler 300 to maintain the vertical orientation of the tubular 60 while lowering the tubular 60 into engagement with the tubular string 66*a* stickup 18*a* at the well center 58*a*, and spinning the pin end of the tubular 60 into the box end of the tubular string 66*a*.

It should be understood that the sequence of operations depicted in FIGS. 19-21 can be performed in reverse, as when the tubular 66*a* at well center 58*a* is being tripped out of the wellbore 50*a*. The controller 210 can autonomously engage the vertically oriented tubular 60 at the well center 58*a*, spin the tubular 60 out of connection with the tubular string 66*a*, and transport the tubular 60 through the spaces in the beams 112*a*, 112*b* and the beams 114*a*, 114*b* to deliver the tubular 60 to the horizontal storage area 30.

Figure 22:
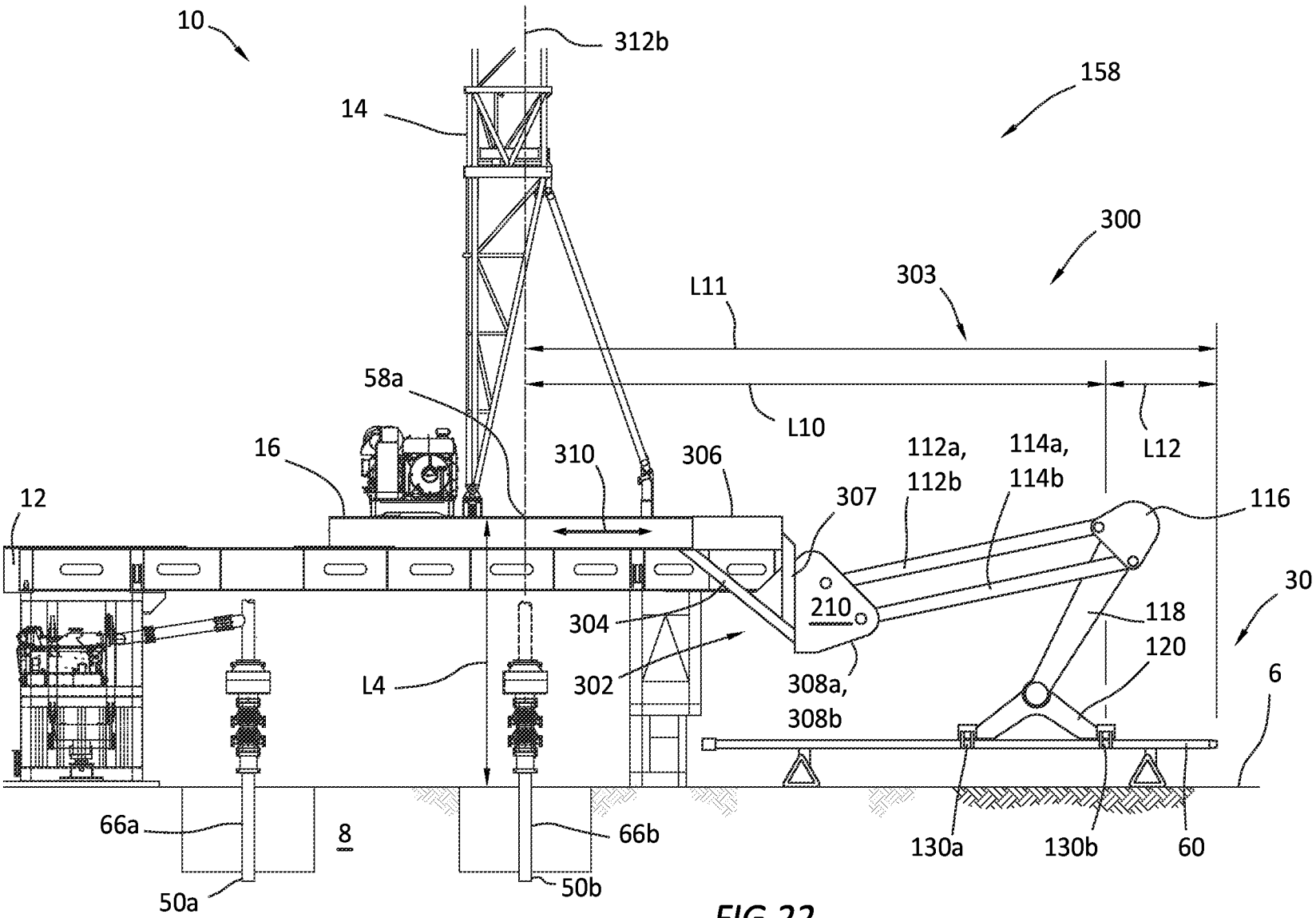

FIG. 22 is a representative side view of a pipe handler 300 attached to a rig 10, the pipe handler 300 being in a deployed position 158 shown over a horizontal storage area 30. The rig 10 in this configuration can include a platform 12 that supports a derrick 14 with a moveable rig floor 16 that can move along the platform 12 between two spaced apart well centers 58*a*, 58*b*. The rig floor 16 can move laterally (arrows 310) along a top surface of the platform 12 between well center 58*a* (i.e., well A with center axis 312*a*) and well center 58*b* (i.e., well B with center axis 312*b*) as needed to perform subterranean operations on wells A and B. The pipe handler 300, being attached to a side of the rig floor 16 via a support 302, can move with the rig floor 16 relative to the platform 12. The pipe handler 300 is configured to access the stationary horizontal storage area 30 from either of the well A or well B locations.

The pipe handler 300 can be attached to the rig floor 16 via the support 302, which can include a pair of support brackets 308*a*, 308*b*, a coupling 306, and a vertical end support 307, and one or more angled braces 304 to stabilize the end support 307 to the coupling 306 or the rig floor 16. The pair of support brackets 308*a*, 308*b* can be fixedly attached to the end support 307 and rotationally attached to one end of the upper beams 112*a*, 112*b*, and to one end of the lower beams 114*a*, 114*b* at respective pivots 82, 83 (refer to FIG. 2). The support brackets 308*a*, 308*b* are similar to the support brackets 108*a*, 108*b* of the pipe handler 100, except that the support brackets 308*a*, 308*b* are fixedly attached to the rig floor 16.

The rig 10, in FIG. 22, is configured such that the derrick 14 and the rig floor 16 are positioned over the well B location having a tubular string 66*b* in a wellbore 50*b*. The pipe handler 300 is extended over the horizontal storage area 30 such that the gripper (e.g., gripper 130*b*) that is farthest away from the rig floor is spaced a distance L10 from the center axis 312*b*. The tubular 60 is positioned in a pickup location in the horizontal storage area 30 with the end of the tubular 60 (in this example the pin end of the tubular 60) being farthest away from the rig floor 16 at a distance L11 from the center axis 312*b*. This provides a distance L12 between the gripper 130*b* and the pin end of the tubular 60. The distance L12 can be the desired distance between the gripper 130*b* and the pin end when the pipe handler 300 engages and lifts the tubular 60 from the pickup location in the horizontal storage area 30. As can be seen when comparing FIGS. 19 and 22, the pipe handler 300 can adapt to the various horizontal distances of the horizontal storage area 30 from the well center 58*a*, or well center 58*b*.

It should be understood that parameters of the tubular 60 and the horizontal storage area can be communicated to the pipe handler controller 210 (or the rig controller 200) and used to autonomously control the pipe handler 300 to adapt the position of the grippers 130*a*, 130*b* on the tubular 60 to provide the distance L12 from the gripper 130*b* to the pin end of the tubular 60. For example, if the tubular 60 is positioned closer to the rig floor 16 in the horizontal storage area 30 than a previous tubular 60, then the pipe handler controller 210 can autonomously control the pipe handler 300 to engage the tubular 60 such that the distance L11 is less to allow for the desired distance L12 to remain constant. It is not a requirement that the distance L12 remain constant, but it may be preferred, since the distance L12 determines the height needed to raise the tubular 60 in a vertical orientation over the stickup 18*b* at well center 58*b* when the pipe handler 300 delivers the tubular 60 to the well center 58*b* when delivering the tubular 60 to well center 58*b*.

It should be understood that the desired distance L12 can be communicated to the controller 210 (or the rig controller 200) and can be different for each tubular 60 or object to be engaged by one or more grippers 130*a*, 130*b* of the pipe handler 300. The controller 210 knows the position of the rig floor 16 (whether over well A location or well B location) and the position of the horizontal storage area 30, and adapts the pipe handler 300 through manipulation of the beams 112*a*, 112*b*, 114*a*, 114*b* and the arms 118, 120 to adapt to the variable distance L11 from the center axis 312*a* or 312*b* to the end of the object (e.g., tubular 60).

As can be seen, if the horizontal storage area 30 were vertically lower than shown in FIG. 22 (i.e., distance L4 being longer or the horizontal storage area 30 being lower), then the maximum distance L10 supported by the pipe handler 300 can be reduced since it would have to rotate the pipe handler mechanism 303 further down to engage the tubular 60. It should be understood, similar to the pipe handler 100, that the pipe handler 300 can autonomously adapt to horizontal storage areas 30 that are at varying vertical heights relative to the rig floor 16, as well as horizontal storage areas 30 that are at varying horizontal distances from the well center.

Figure 23:
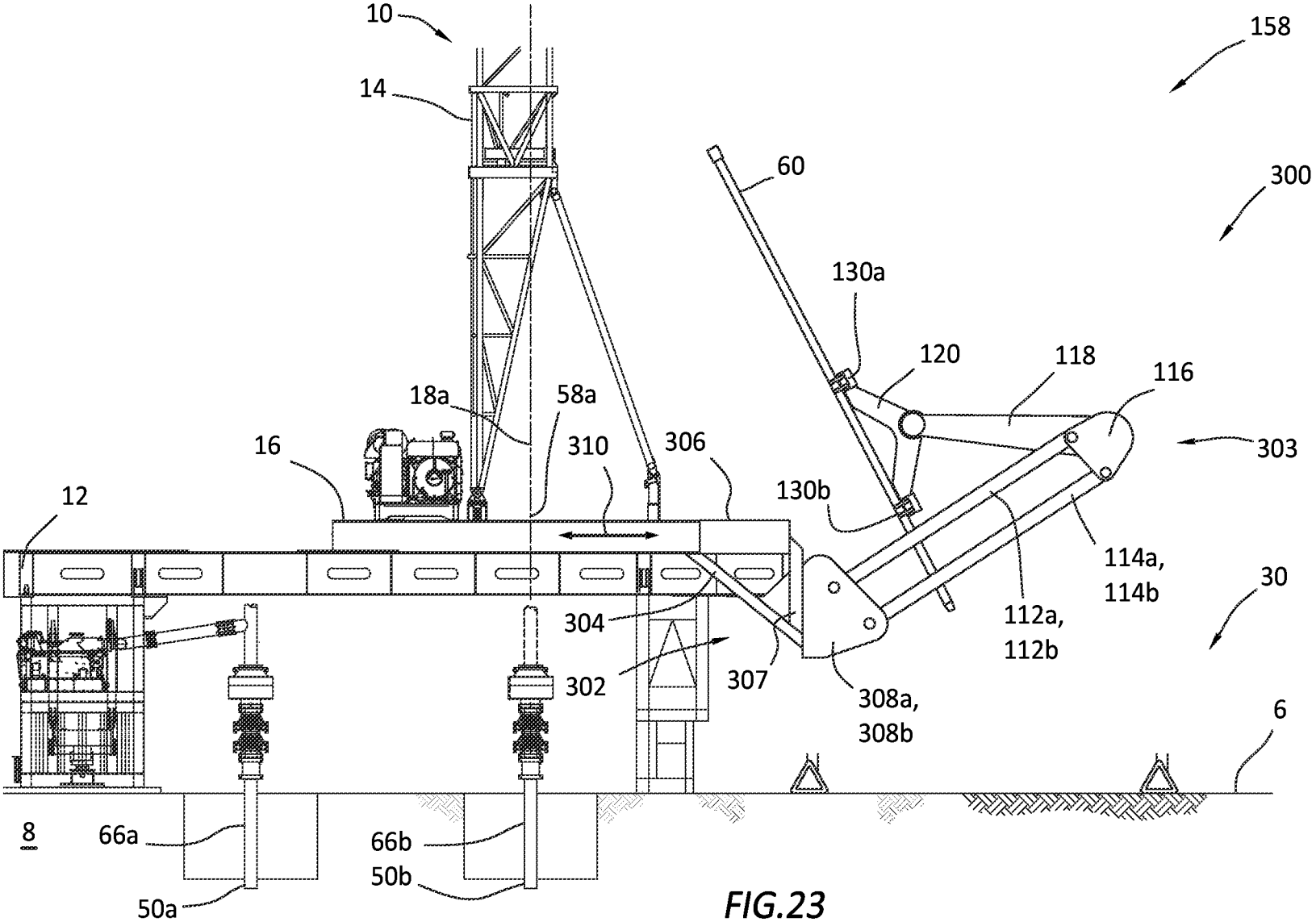

Referring to FIG. 23, the pipe handler mechanism 303 has engaged the tubular 60 via the grippers 130*a*, 130*b* and rotated the tubular 60 from the pickup location (e.g., the horizontal storage area 30) at least partially through a horizontal space between the beams 112*a*, 112*b* and a horizontal space between the beams 114*a*, 114*b*. The beams 112*a*, 112*b*, 114*a*, 114*b* have been rotated up toward the rig floor 16, with the arms 118, 120 controlled to manipulate the tubular 60 such that the box end of the tubular 60 avoids the support brackets 308*a*, 308*b* as it is picked up from the horizontal storage area 30 and lifted through the spaces between the beams 112*a*, 112*b* and the beams 114*a*, 114*b*. It should be understood that only one pair of beams (e.g., 112*a*, 112*b*) can be used in the pipe handler 300, similar to the pipe handler 100 in FIG. 18.

Figure 24:
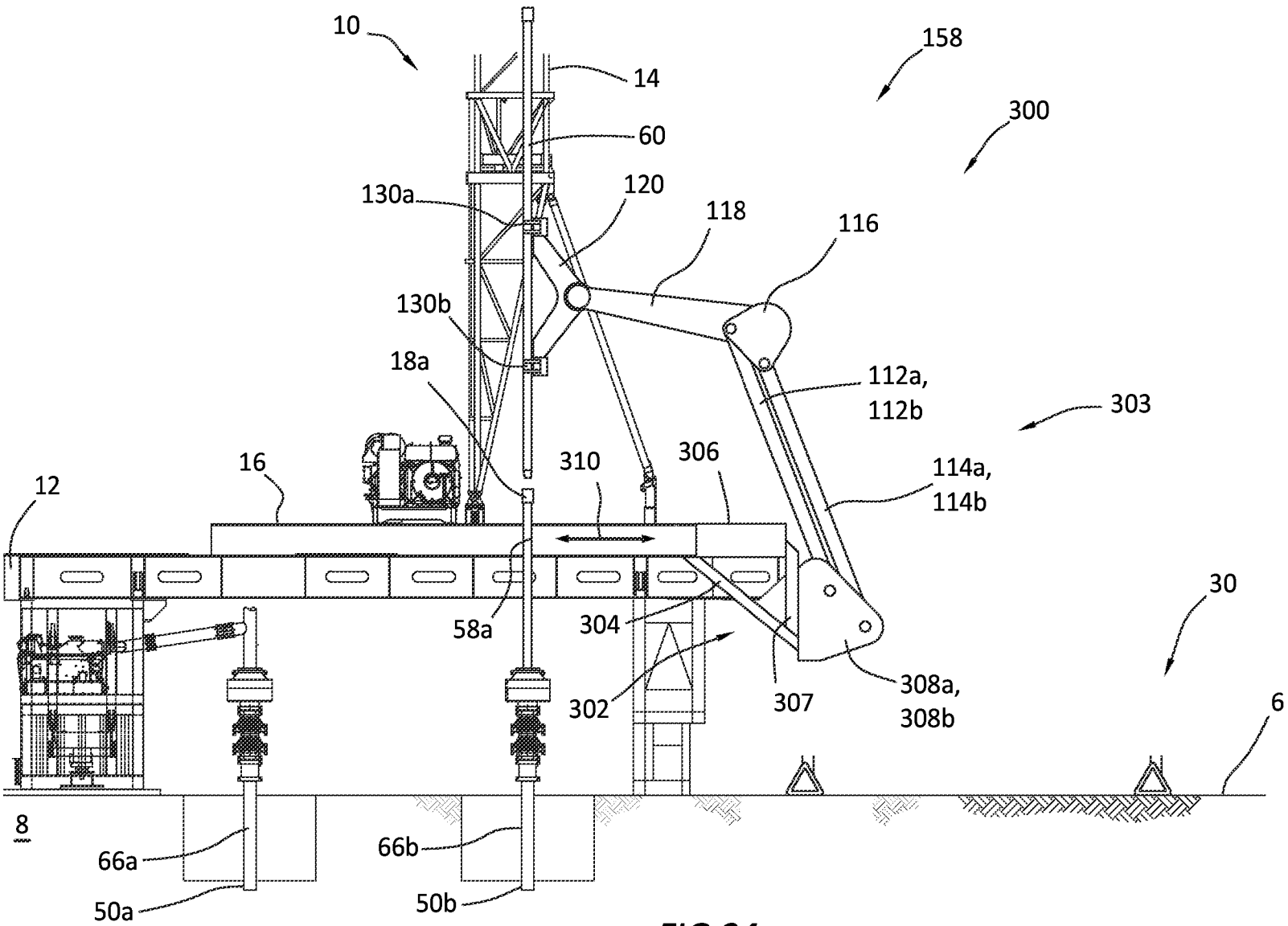

Referring to FIG. 24, the pipe handler mechanism 303 has engaged the tubular 60 via the grippers 130*a*, 130*b* and rotated the tubular 60 from the pickup location (e.g., the horizontal storage area 30) through the space between the beams 112*a*, 112*b* and the space between the beams 114*a*, 114*b*, and presented the tubular 60 in a vertical orientation above the stickup 18*b* at the well center 58*b*. The beams 112*a*, 112*b*, 114*a*, 114*b* have been rotated toward the rig floor 16, with the arms 118, 120 controlled to manipulate the tubular 60 such that the box end of the tubular 60 avoids the derrick 14 and any other obstacles near the transport path of the tubular 60 as it is lifted to the vertical orientation. The controller 210 can then operate the components of the pipe handler 300 to maintain the vertical orientation of the tubular 60 while lowering the tubular 60 into engagement with the tubular string 66*a* stickup 18*a* at the well center 58*a*, and spinning the pin end of the tubular 60 into the box end of the tubular string 66*a*. The derrick is omitted in FIG. 24 for clarity and the edge of the derrick 14 is indicated by the dashed lines for reference of the relative position of the derrick 14 in the well B location.

It should be understood that the sequence of operations depicted in FIGS. 22-24 can be performed in reverse, as when the tubular 66*b* at well center 58*b* is being tripped out of the wellbore 50*b*. The controller 210 can autonomously engage the vertically oriented tubular 60 at the well center 58*b*, spin the tubular 60 out of connection with the tubular string 66*b*, and transport the tubular 60 through the spaces in the beams 112*a*, 112*b* and the beams 114*a*, 114*b* to deliver the tubular 60 to the horizontal storage area 30.

Figure 25:
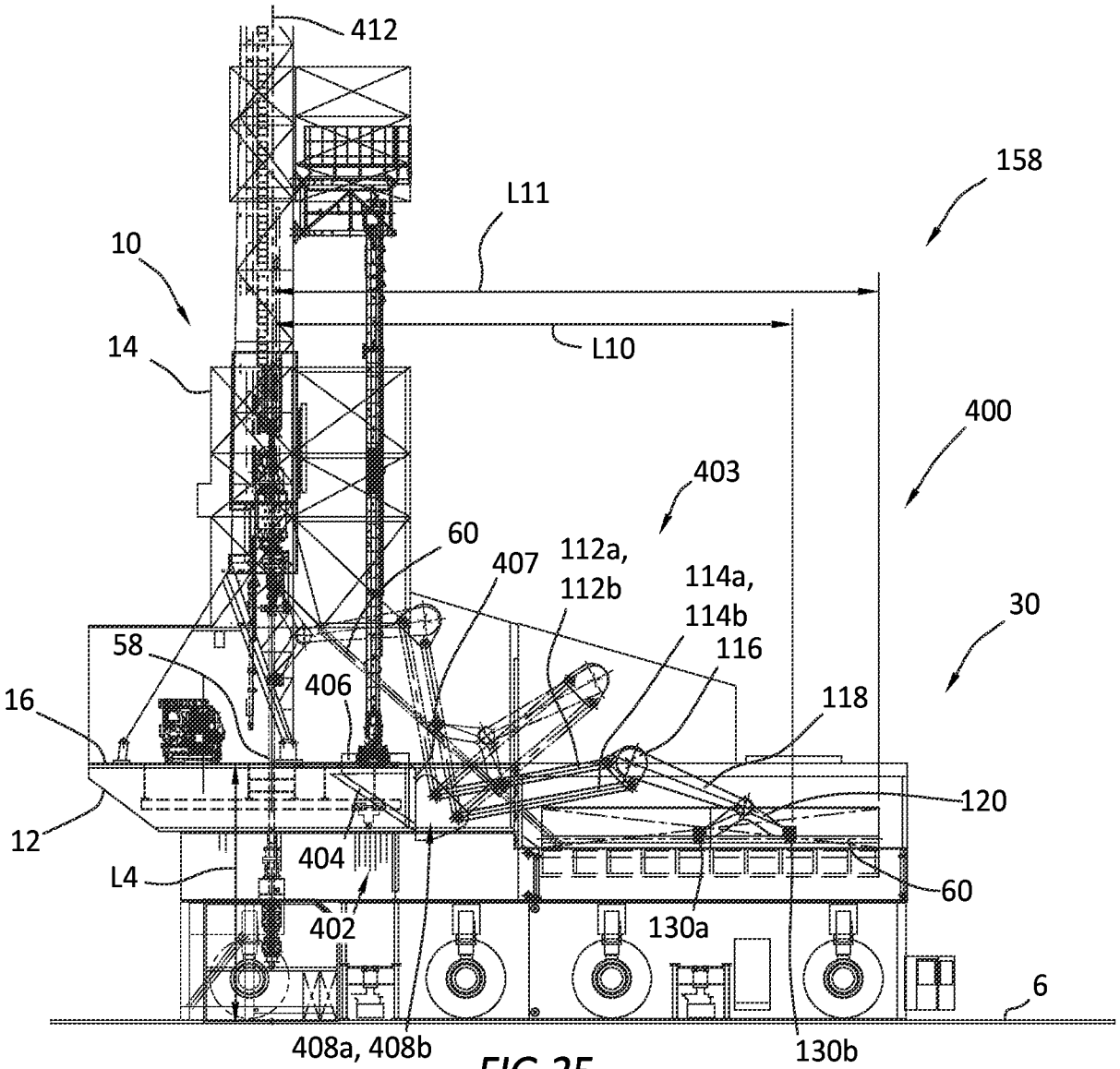
FIG. 25 is a representative side view of another pipe handler at a rig, the pipe handler being shown in various deployed positions transporting a tubular, in accordance with certain embodiments.

FIG. 25 is a representative side view of another pipe handler 400 at a rig 10, pipe handler mechanism 403 of the pipe handler 400 being shown in various deployed positions 158 transporting a tubular 60 between a pickup location (e.g., a horizontal storage area 30) and a delivery location (e.g., a well center 58.

The pipe handler 400 can be attached to the rig floor 16 via the support 402 (which is very similar to support 302 of FIG. 19), which can include a pair of support brackets 408*a*, 408*b*, a coupling 406, and a vertical end support 407, and one or more angled braces 404 to stabilize the end support 407 to the coupling 406 or the rig floor 16. The pair of support brackets 408*a*, 408*b* can be fixedly attached to the end support 407 and rotationally attached to one end of the upper beams 112*a*, 112*b*, and to one end of the lower beams 114*a*, 114*b* at respective pivots 82, 83 (refer to FIG. 2). The support brackets 408*a*, 408*b* are similar to the support brackets 108*a*, 108*b* of the pipe handler 100, except that the support brackets 408*a*, 408*b* are fixedly attached to the rig floor 16. The pivots 82, 83 can form a plane 144 that can be angled relative to the rig floor 16 by an angle A1 (similarly as in FIG. 19). The angle A1 can determine the access of the pipe handler 400 along the rig floor 16 and the vertical distance below the rig floor 16 that is accessible by the pipe handler 400.

The rig 10 in this example is a rig that has multiple sections (or modules) that can be transported separately or together between well sites. The derrick 14 module with platform 12 can include the pipe handler 400 attached to the rig floor 16 that moves with the derrick 14 section (or module). Characterizing the objects to be manipulated by the pipe handler 400 can be performed in the horizontal storage area 30 or in other locations. The data measured, collected from vendor reports, or otherwise determined can be communicated to the controller 210 (or rig controller 200) so the pipe handler 400 can autonomously determine transport paths for the object when it is transported by the pipe handler 400. It should be understood that the pipe handler 400 operates in much the same way as the other pipe handlers 100, 300 for safely transporting objects between pickup and delivery locations.

Figure 26A:
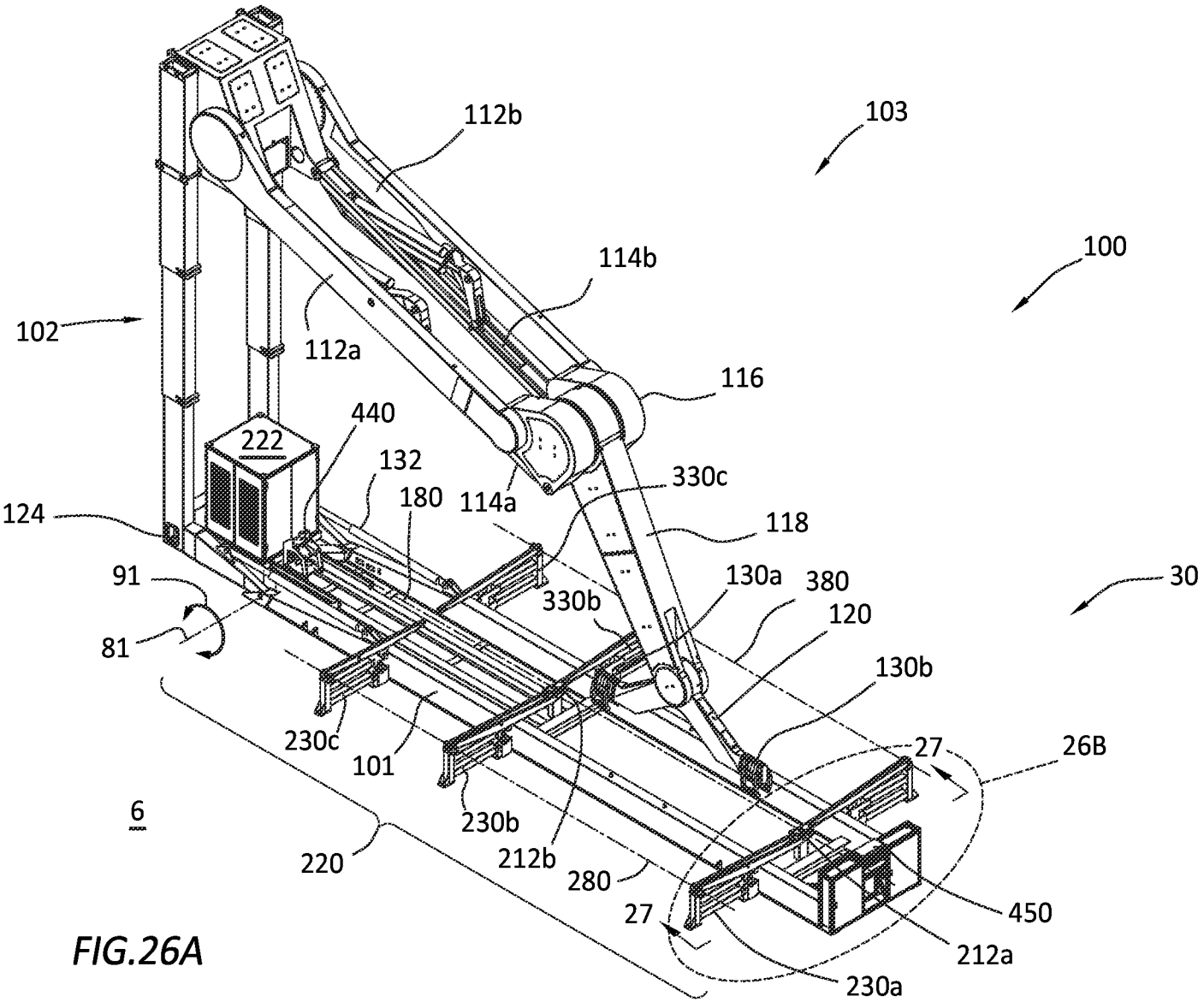
FIG. 26A is a representative perspective view of a pipe handler that interacts with a horizontal pipe handler for managing tubulars in a horizontal storage area, in accordance with certain embodiments.

FIG. 26A is a representative perspective view of a pipe handler 100 that can interact with a horizontal pipe handler (HPH) 220 for managing tubulars in a horizontal storage area 30. The pipe handler 100 can operate much the same way as the previously described pipe handlers 100, 300, 400 with upper beams 112*a*, 112*b* cooperating with lower beams 114*a*, 114*b* to lift the coupling structure 116, which is rotatably attached to the arm 118. The arm 118 can be rotatably attached to the arm 120, which can include a gripper 130*a*, 130*b* at each end of the arm 120. The grippers 130*a*, 130*b* can grip and carry tubulars through a space formed between the left and right upper beams 112*a*, 112*b* as the pipe handler 100 moves the tubular from a pickup location (e.g., horizontal storage area 30, another pipe handler, etc.) to a delivery location (e.g., a well center, another pipe handler, etc.). The pipe handler 100 of FIG. 26A is at least different from other previously described pipe handlers 100, 300, 400 in that the pivot point (axis 81) of rotation (arrows 91) between the base 101 and the support 102 is spaced away from the bottom end 124 of support 102. Therefore, when the support 102 is rotated to a stowed position via actuators 132, then the controller 222 housing can be rotated with the support 102 to the stowed position over the base 101.

The horizontal pipe handler 220 can include multiple left horizontal pipe handlers (LHPHs) 230*a-c* positioned on the left side of the base 101 (as viewed from line 27-27) as well as right horizontal pipe handlers (RHPHs) 330*a-c* positioned on the right side of the base 101 (as viewed from line 27-27). The LHPHs 230*a-c* and RHPHs 330*a-c* can be used to manipulate horizontally oriented tubulars toward and away from the cradles 212*a*, 212*b* at the center of the base 101. Three LHPHs 230*a-c* and three RHPHs 330*a-c* are shown, but it should be understood that more or fewer of these horizontal pipe handlers 230*a-c*, 330*a-c* can be used in keeping with the principles of this disclosure. For example, there may be only two LHPHs 230*a-b* on the left side and possibly three RHPHs 330*a-c* (or less) on the right side to manipulate horizontally oriented tubulars. Additionally, there may be four LHPHs on the left side and three RHPHs 330*a-c* (or less) on the right side to manipulate horizontally oriented tubulars toward and away from the cradle 212*a*, 212*b* at the center of the base 101. Please note that the HPH 220, in the non-limiting embodiment of FIG. 26A, may not include a cradle 212*c* or the LHPH 230*c* and RHPH 330*c* may not include respective feeder arms 240*c*, 340*c* to provide clearance for the doping device 440 to travel axially along the base 101 toward the doping device 450 past the LHPH 230*c* and the RHPH 330*c* to engage shorter tubulars. The following non-limiting embodiments may not include a cradle 212*c* or arms 240*c*, 340*c*, but they can be included if desired.

In this non-limiting embodiment, three LHPHs 230*a-c* and three RHPHs 330*a-c* are provided with each set positioned on opposite sides (right and left) of the base 101. The LHPHs 230*a-c* can include arms that rotate about a common axis 280 such that when similar arms in each of the LHPHs 230*a-c* rotate together, they can rotate synchronously about the common axis 280 and raise or lower a tubular in a horizontal orientation. It should be understood that the rotational axis of the arms for each of the LHPHs 230*a-c* can be substantially aligned with the common axis 280. The RHPHs 330*a-c* can include arms that rotate about a common axis 380 such that when similar arms in each of the RHPHs 330*a-c* rotate together, they can rotate synchronously about the common axis 280 and raise or lower a tubular in a horizontal orientation. It should be understood that the rotational axis of the arms for each of the RHPHs 330*a-c* can be substantially aligned with the common axis 380.

Figure 26B:
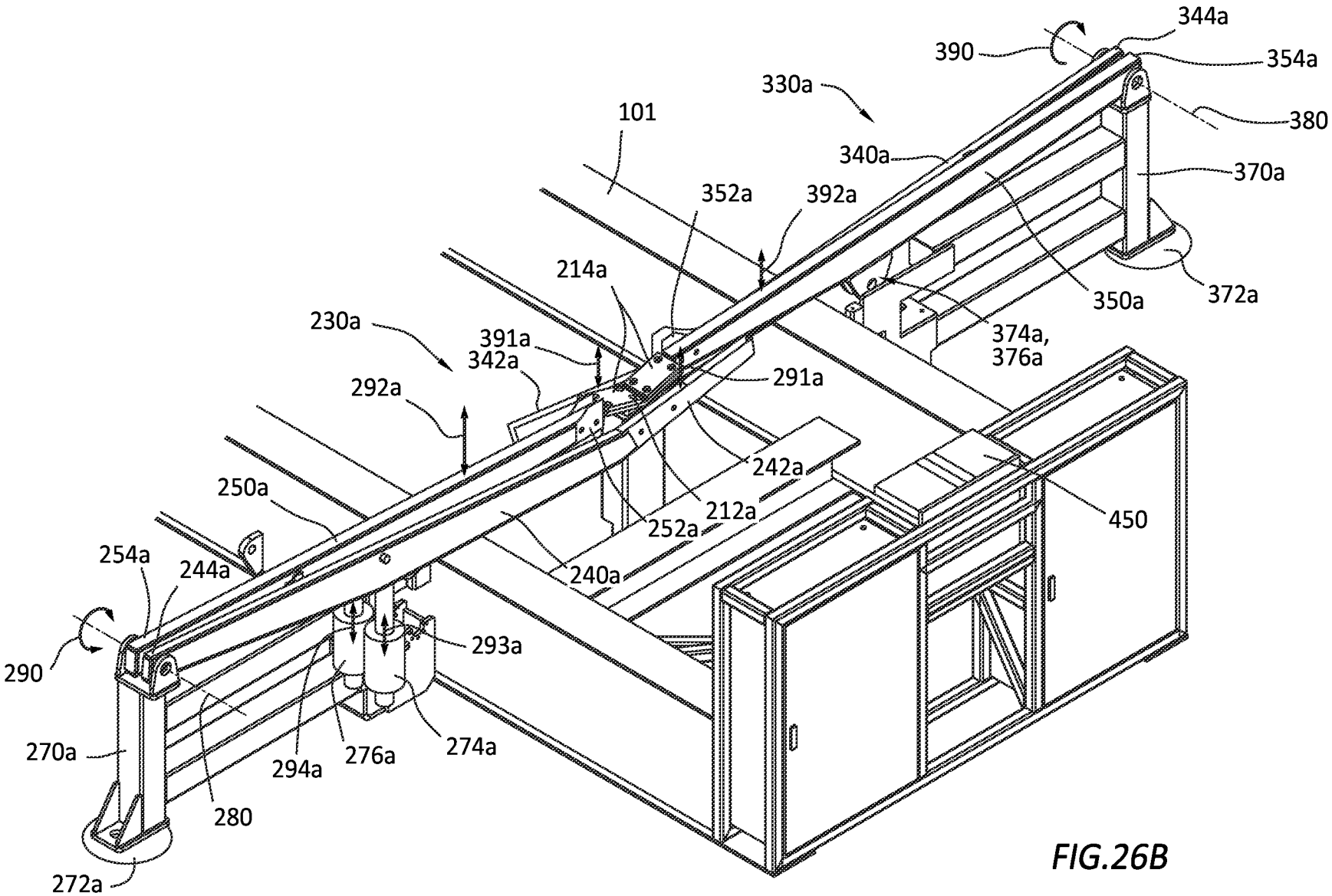
FIG. 26B is a representative detailed perspective view of an end of the horizontal pipe handler for managing tubulars in a horizontal storage area, in accordance with certain embodiments.

FIG. 26B is a representative detailed perspective view of an end of the horizontal pipe handler 220 (i.e., region 26B in FIG. 26A) for managing tubulars in a horizontal storage area 30. One LHPH 230*a* and one RHPH 330*a* are shown. Operation of the components of the other LHPHs and RHPHs (e.g., LHPHs 230*b-c* and RHPHs 330*b-c*) can be similar to the following description of the operation of the components of the LHPH 230*a* and the RHPH 330*a*.

The LHPH 230*a* can include a support leg 270*a* attached to the base 101. The support leg 270*a* can be used to adjust a height of the base 101 off the surface 6 via the adjuster 272*a*. A feeder arm 240*a* and a ramp arm 250*a* can be rotationally attached to the support leg 270*a* at axis 280 by respective ends 244*a* and 254*a*. The feeder arm 240*a* and the ramp arm 250*a* can independently rotate (arrows 290) about the axis 280. The feeder arm 240*a* can be rotated (arrows 290) about the axis 280 by extending/retracting an actuator 274*a* (arrows 293*a*). Extension of the actuator 274*a* can raise an end 242*a* of the feeder arm 240*a* (arrows 291*a*) relative to the cradle 212*a*, and retraction of the actuator 274*a* can lower the end 242*a* of the feeder arm 240*a* (arrows 291*a*) relative to the cradle 212*a*. The ramp arm 250*a* can be rotated (arrows 290) about the axis 280 by extending/retracting an actuator 276*a* (arrows 294*a*). Extension of the actuator 276*a* can raise an end 252*a* of the ramp arm 250*a* (arrows 292*a*) relative to the cradle 212*a*, and retraction of the actuator 276*a* can lower the end 252*a* of the ramp arm 250*a* (arrows 292*a*) relative to the cradle 212*a*.

The RHPH 330*a* can include a support leg 370*a* attached to the base 101. The support leg 370*a* can be used to adjust a height of the base 101 off the surface 6 via the adjuster 372*a*. A feeder arm 340*a* and a ramp arm 350*a* can be rotationally attached to the support leg 370*a* at axis 380 by respective ends 344*a* and 354*a*. The feeder arm 340*a* and the ramp arm 350*a* can independently rotate (arrows 390) about the axis 380. The feeder arm 340*a* can be rotated (arrows 390) about the axis 380 by extending/retracting an actuator 374*a*. Extension of the actuator 374*a* can raise an end 342*a* of the feeder arm 340*a* (arrows 391*a*) relative to the cradle 212*a*, and retraction of the actuator 374*a* can lower the end 342*a* of the feeder arm 340*a* (arrows 391*a*) relative to the cradle 212*a*. The ramp arm 350*a* can be rotated (arrows 390) about the axis 380 by extending/retracting an actuator 376*a*. Extension of the actuator 376*a* can raise an end 352*a* of the ramp arm 350*a* (arrows 392*a*) relative to the cradle 212*a*, and retraction of the actuator 376*a* can lower the end 352*a* of the ramp arm 350*a* (arrows 392*a*) relative to the cradle 212*a*.

Operation of the feeder arms 240*a*, 340*a* and the ramp arms 250*a*, 350*a* in cooperation with the respective other feeder arms (e.g., feeder arms 240*b-c*, 340*b-c*) and other ramp arms (e.g., ramp arms 250*b-c*, 350*b-c*) can facilitate moving horizontally oriented tubulars to and from the cradles 212*a-b*. The pipe handler 100 can access the cradles 212*a-b* to deliver tubulars to or retrieve tubulars from the horizontal storage area 30. The HPH 220 can be used to position a tubular in the cradles 212*a-b* for removal by the pipe handler 100 or move a tubular away from the cradles 212*a-b* after the pipe handler 100 has deposited the tubular there. Of course, the HPH 220 can also move the tubulars to the cradles 212*a-b* and away from the cradles 212*a-b* without interaction of the pipe handler 100. The cradles 212*a-b* can include sensors (e.g., sensors 214*a*) to detect a characteristic (e.g., weight, diameter, etc.) of a tubular that is resting in the cradles 212*a-b*.

Figure 27A:
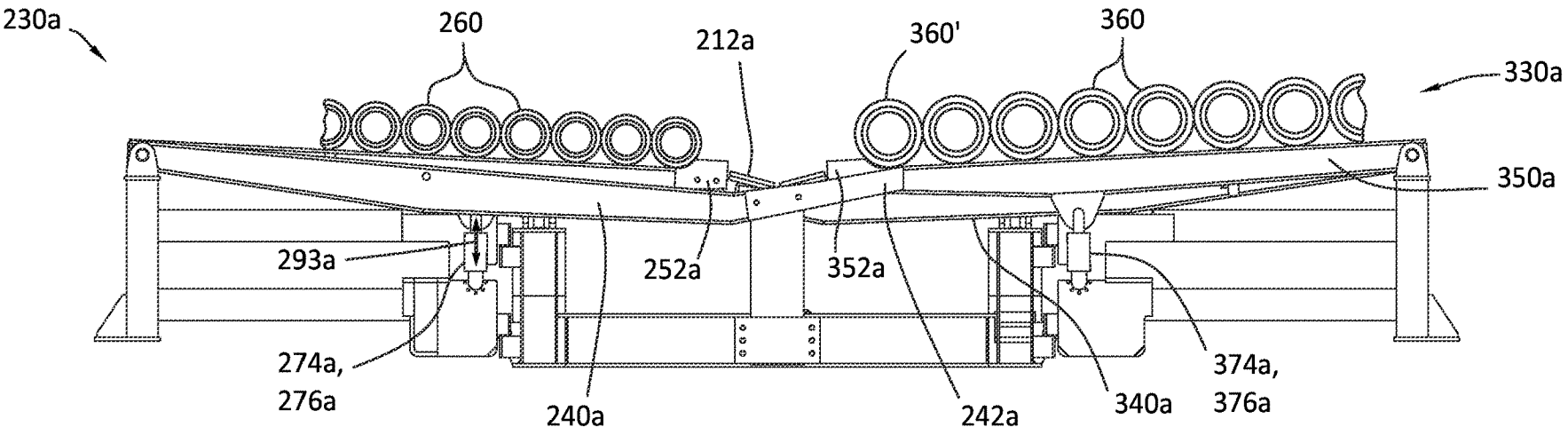
FIGS. 27A-27C are representative detailed front views of the horizontal pipe handler of FIG. 26A from cross-section line 27-27, in accordance with certain embodiments.
Figure 27B:
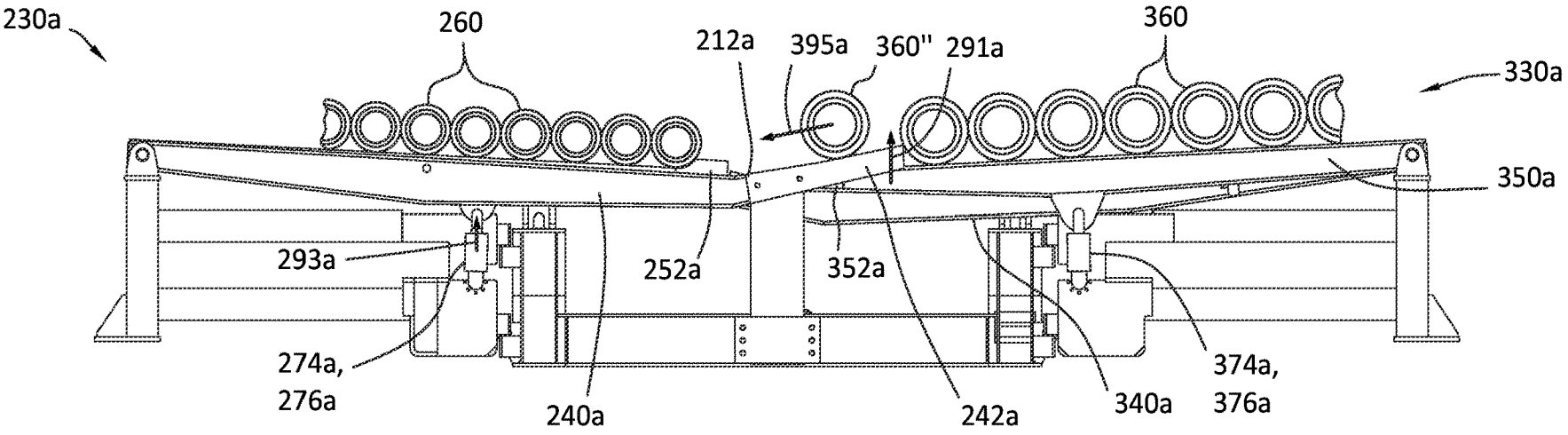
Figure 27C:
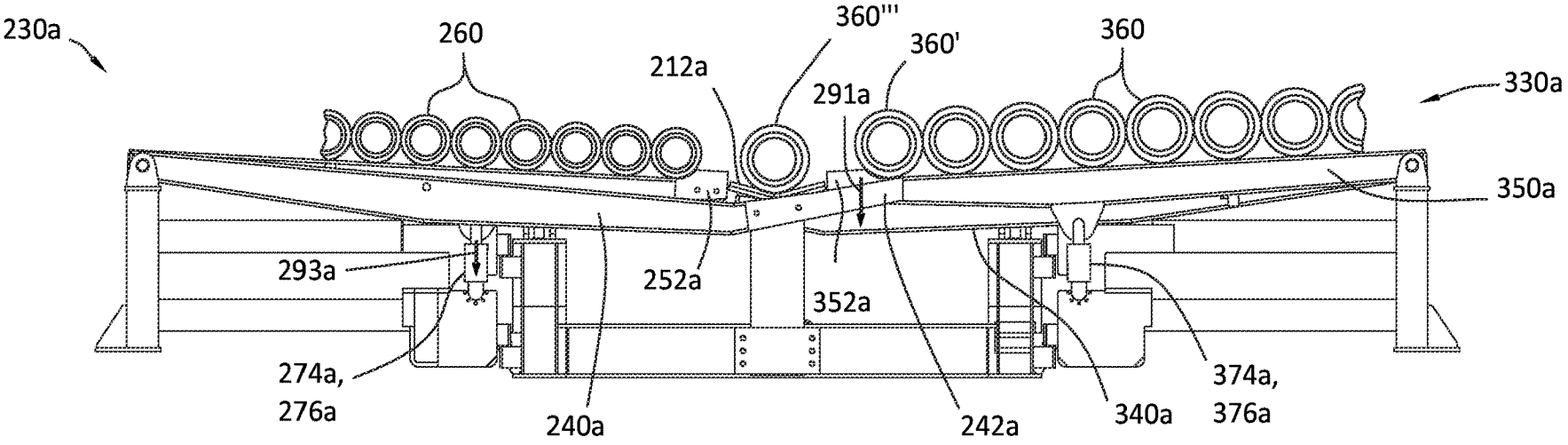

FIGS. 27A-27C are representative detailed front views of the horizontal pipe handler 220 of FIG. 26A as viewed from line 27-27, loading a tubular 360 into the cradle 212*a*. The cradle 212*a* (as well as corresponding cradle 212*b*) can have two surfaces that form a V-shape, with the low point of the V-shape positioned substantially at the center of the cradle 212*a*, such that a tubular 360 (in a horizontal orientation that is substantially parallel to a longitudinal axis 180 of the base 101) is placed on either surface, it will tend to roll toward the center of the cradle 212*a*.

FIG. 27A shows the LHPH 230*a* with a plurality of tubulars 260 laid side-by-side in a horizontal orientation on the ramp arm 250*a*. The tubulars 260 can extend toward the other LHPHs 230*b-c* and can be supported by one or both of the LHPHs 230*b-c* in the horizontal orientation. The tubulars 260 can rest on the ramp arm 250*a*, and the ramp arm 250*a*, shown in a rest position, can be inclined as shown toward the cradle 212*a*. With the other ramp arms 250*b-c* of the other LHPHs 230*b-c* similarly inclined and in rest positions, the tubulars 260 will tend to roll toward the cradle 212*a* and stop at the end 252*a*, which can be turned up as shown to halt movement of the tubulars 260 toward the cradle 212*a*.

As stated previously, the actuator 274*a* can be extended/retracted to rotate the feeder arm 240*a* about the axis 280, thereby raising/lowering the end 242*a* of the feeder arm 240*a*. The actuator 276*a* can be extended/retracted to rotate the ramp arm 250*a* about the axis 280, thereby raising/lowering the end 252*a* of the ramp arm 250*a*. The feeder arms 240*a*, 340*a* and ramp arms 250*a*, 350*a* are shown in a rest positions. The actuators 274*a*, 276*a*, 374*a*, 376*a* can raise the respective arms 240*a*, 250*a*, 340*a*, 350*a* from the rest position to an inclined position or at least a position rotated away from the rest position.

FIG. 27A shows the RHPH 330*a* with a plurality of tubulars 360 laid side-by-side in a horizontal orientation on the ramp arm 350*a*. The tubulars 360 can extend toward the other RHPHs 330*b-c* and can be supported by one or both of the RHPHs 330*b-c* in the horizontal orientation. The tubulars 360 can rest on the ramp arm 350*a*, which can be inclined as shown toward the cradle 212*a*. With the other ramp arms 350*b-c* of the other RHPHs 330*b-c* similarly inclined, the tubulars 360 will tend to roll toward the cradle 212*a* and stop at the end 352*a*, which can be turned up as shown to halt movement of the tubulars 360 toward the cradle 212*a*.

As stated previously, the actuator 374*a* can be extended/retracted to rotate the feeder arm 340*a* about the axis 380, thereby raising/lowering the end 342*a* of the feeder arm 340*a*. The actuator 376*a* can be extended/retracted to rotate the ramp arm 350*a* about the axis 380, thereby raising/lowering the end 352*a* of the ramp arm 350*a*.

In FIG. 27B, the actuator 274*a* can be extended (arrows 293*a*) to raise the end 242*a* (arrows 291*a*) to engage the tubular 360, which can be in an initial position 360' (FIG. 27A) where the tubular 360 is abutting the turned-up portion of the ramp arm end 352*a*. The feeder arm end 242*a* can lift the tubular 360 up from the ramp arm 350*a* such that the tubular 360 can roll past the turned-up portion of the ramp arm end 352*a* (arrows 395*a*) toward the cradle 212*a* (position 360") due to the incline of the end 242*a*. When the tubular 360 rolls past the turned up portion of the end 352*a*, the actuator 274*a* can be retracted (arrows 293*a*) as seen in FIG. 27C to lower the end 242*a* (arrows 291*a*) and disengage the end 242*a* from the tubular 360. The tubular 360 can then roll to the center of the V-shaped cradle 212*a* to position 360'". The pipe handler 100 can collect the tubular 360 from the cradles 212*a-b* and transport the tubular 360 to a delivery location (e.g., well center, another pipe handler, etc.). Therefore, the left feeder arms 240*a-c* can be used to feed a tubular 360 from the right side of the HPH 220 to the cradles 212*a-b*, where the tubular 360 can rest in the V-shape of the cradles 212*a-b* awaiting pickup by the pipe handler 100 or ejection by the HPH 220.

Similarly, the right feeder arms 340*a-c* can be used to feed a tubular 260 from the left side of the HPH 220 to the cradles 212*a-b* by extending the actuator 374*a* to raise the end 342*a* of the feeder arm 340*a* and thereby raise the tubular 260 from the end 252*a* of the ramp arm 250*a*, roll the tubular 260 past the turned-up portion of the end 252*a*, lower the end 342*a* by retracting the actuator 374*a*, and let the tubular 260 roll to the center of the V-shaped cradle 212*a*. The other LHPHs 230*b-c* and RHPHs 330*b-c* can operate synchronously with the respective LHPH 230*a* and RHPH 330*a* to manipulate the horizontally oriented tubulars 360 or 260 to be feed to the cradles 212*a-b* or removed from the cradles 212*a-b*.

Figure 28:
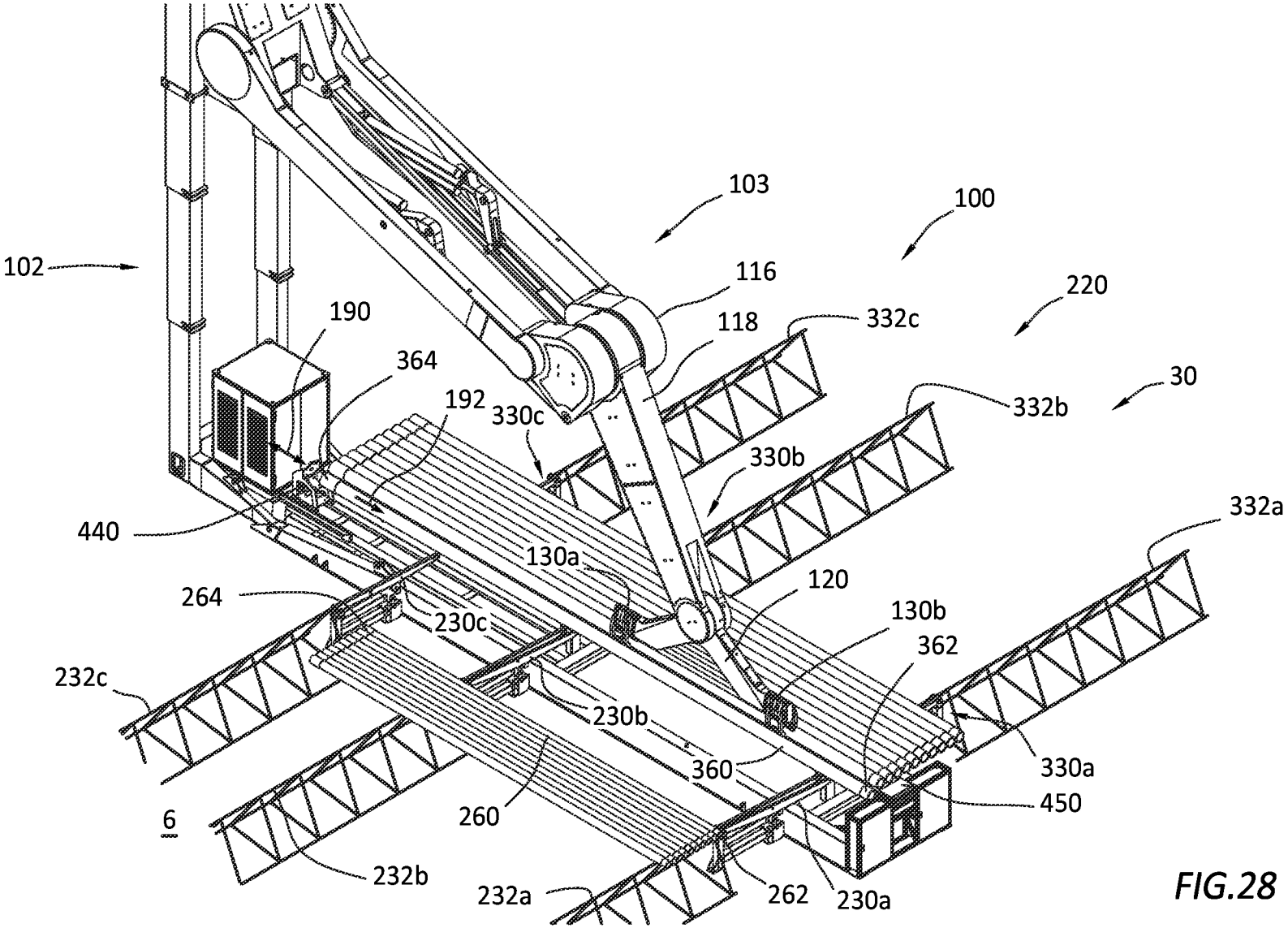
FIGS. 28-29 are representative perspective views of a pipe handler retrieving tubulars from a horizontal pipe handler in a horizontal storage area, in accordance with certain embodiments.
Figure 29:
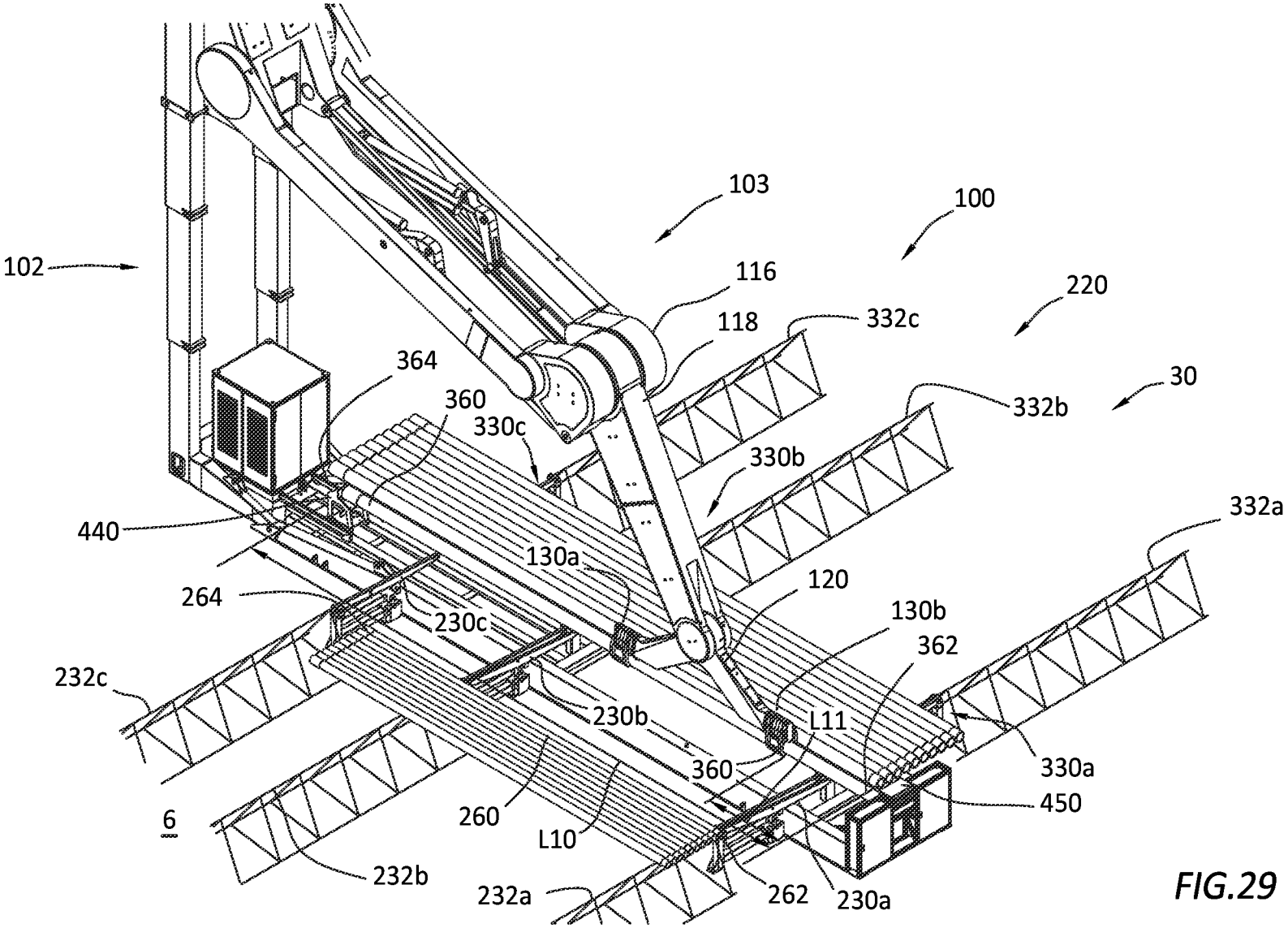

FIGS. 28-29 are representative perspective views of a pipe handler 100 retrieving tubulars 360 from a horizontal pipe handler 220 in a horizontal storage area 30. The HPH 220 can include left rails 232*a-c* extending from the respective LHPHs 230*a-c* on the left side of the HPH 220, and right rails 332*a-c* extending from the respective RHPHs 330*a-c* on the right side of the HPH 220. The left rails 232*a-c* can provide horizontal storage for multiple tubulars 260, each with a pin end 262 and a box end 264. Multiple tubulars 260 can be positioned on the inclined ramp arms 250*a-c* of the LHPHs 230*a-c*. It should be noted that in this non-limiting embodiment the tubulars 260 are shorter than the tubulars 360 and do not extend to the third LHPH 230*c*. Therefore, it is not a requirement that the tubulars 260 or 360 extend to all LHPHs 230*a-c* or RHPHs 330*a-c* in keeping with the principles of the current disclosure.

The right rails 332*a-c* can provide horizontal storage for multiple tubulars 360, each with a pin end 362 and a box end 364. Multiple tubulars 360 can be positioned on the inclined ramp arms 350*a-c* of the RHPHs 330*a-c*. As explained above, the feeder arms 240*a-c* can be used to feed tubulars 360 from the RHPHs 330*a-c* to the cradles 212*a-b* which can be positioned at a center location between the LHPHs 230*a-b* and the respective RHPHs 330*a-b*.

When a tubular 360 is moved to rest in the cradles 212*a-b*, the doping device 440 can be moved axially (arrows 190) into engagement with the box end 364 of the tubular 360 that is resting in the cradles 212*a-b*. When the doping device 440 engages the box end 364, the doping device 440 can continue to move axially (arrows 190) thereby moving the tubular 360 axially (arrows 192) toward the doping device 450 until the pin end 362 of the tubular 360 engages the doping device 450. With the box end 364 engaged with the doping device 440 and the pin end 362 engaged with the doping device 450, the length L10 (see FIG. 29) of the tubular 360 can be determined by a controller (e.g., 200, 210, 222), since the position of the doping device 440 relative to the doping device 450 is known. For the non-limiting embodiment when tubulars 260 are moved to the cradles 212*a-b*, the doping device 440 can move past the LHPH 230*c* and RHPH 330*c* to engage the box end 264 of the tubulars 260 when the tubulars 260 do not extend past the LHPH 230*c* and RHPH 330*c*.

Additionally, sensors 214*a-b* in the respective cradles 212*a-b* can be used to determine at least one characteristic (e.g., actual weight, actual diameter, etc.) of the tubular 360 when the tubular 360 is not yet engaged with the doping devices 440, 450. When the tubular 360 rests in the cradles 212*a-b* and is engaged with the doping devices 440, 450, the sensors 214*a-b* in the respective cradles 212*a-b* and the sensors in the doping devices 440, 450 can be used by a controller (e.g., 200, 210, 222) to determine at least one characteristic (e.g., actual weight, actual diameter, etc.) of the tubular 360.

As seen in FIG. 29, the pipe handler 100 can be engaged with the tubular 360 via grippers 130*a*, 130*b*. With the pin end 362 of the tubular 360 engaged with (or at least in close proximity to) the doping device 450, the pipe handler 100 can consistently engage the tubular 360 with the gripper 130*b* at a distance L11 from the pin end 362 of the tubular 360. This is not a requirement since the pipe handler 100 can selectively engage the tubular 360 at other locations along the tubular 360. However, it may be preferred to consistently position the gripper 130*b* at a distance L11 from the pin end 362 for consistent positioning at well center 58 or when handing a tubular 360 off to another pipe handler (e.g., iron roughneck, vertical pipe handler, drill floor robot, etc.).

When the pipe handler 100 grips the tubular 360, the pipe handler 100 can rotate the tubular 360 while the doping devices 440, 450 (separately or simultaneously) clean, dry, and apply dope to the pin and box ends 362, 364 of the tubular 360. With the ends 362, 364 are doped, the pipe handler 100 may then transport the tubular 360 to the well center 58, another pipe handler (e.g., vertical pipe handler for managing vertical pipe storage or stand building), etc.

Figure 30:
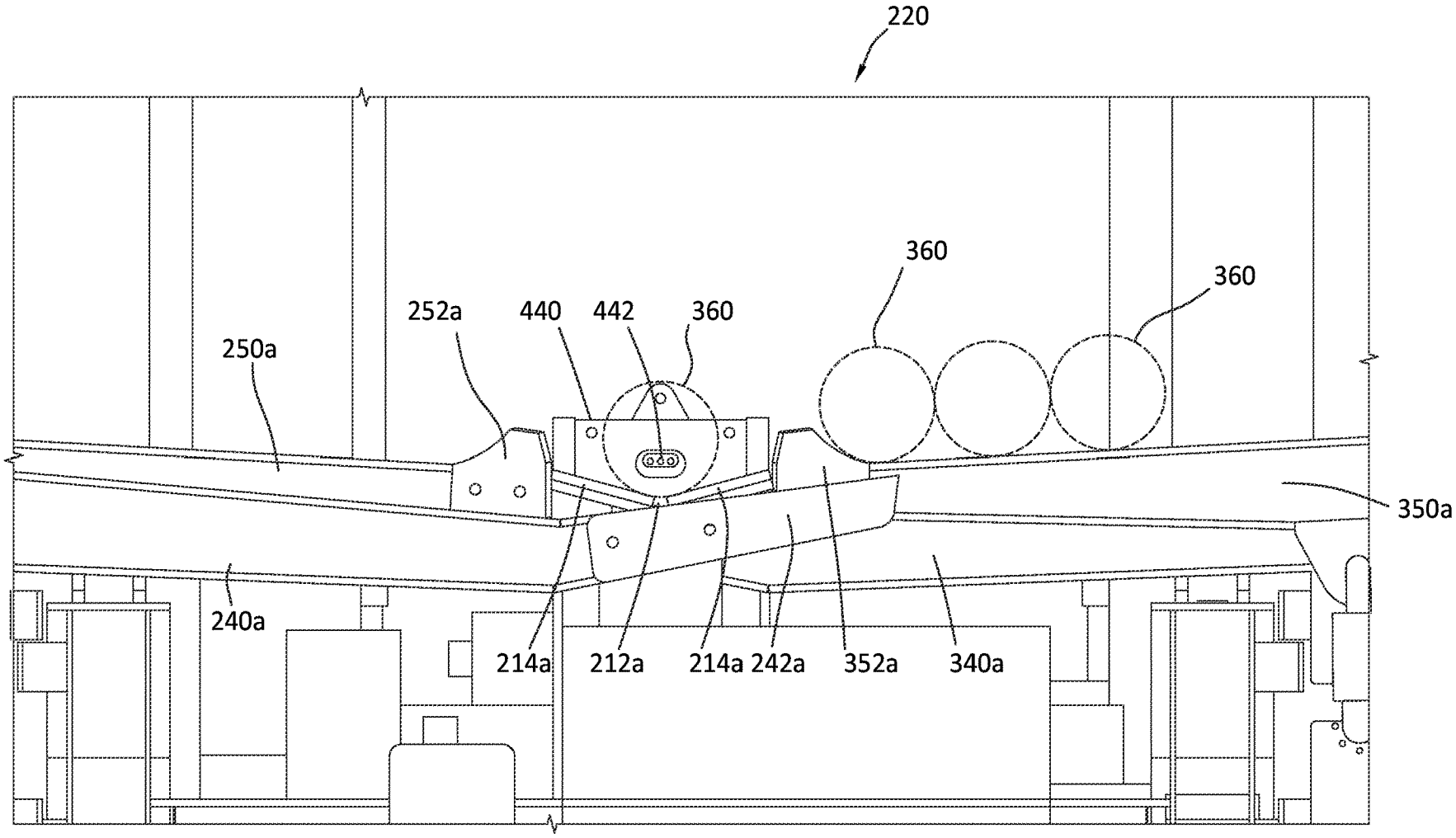
FIG. 30 is a representative front view of a horizontal pipe handler for managing tubulars in a horizontal storage area, the horizontal pipe handler including a doping device for doping a box end of a tubular, in accordance with certain embodiments.

FIG. 30 is representative detailed front view of a portion of a horizontal pipe handler 220 for managing tubulars 260, 360 in a horizontal storage area 30. The horizontal pipe handler 220 can include a doping device 440 for doping a box end of a tubular 360 (or tubular 260), while the pipe handler 100 rotates the tubular 360 (or 260). Before the pipe handler 100 engages the tubular 360, the sensors 214*a* disposed in the cradle 212*a* can provide sensor data to the controller (e.g., 200, 210, 222) for determining at least one characteristic of the tubular 360. With the tubular 360 engaged by the grippers 130*a*, 130*b* of the pipe handler 100, the pipe handler 100 can rotate the tubular 360 which can be positioned above the cradles 212*a-b* (only cradle 212*a* shown here). As the tubular 360 is rotated, the nozzles 442 of the doping device 440 (which can be directed toward internal threads of the box end 364 of the tubular 360) can clean, dry, and apply dope to the internal threads.

Figure 31:
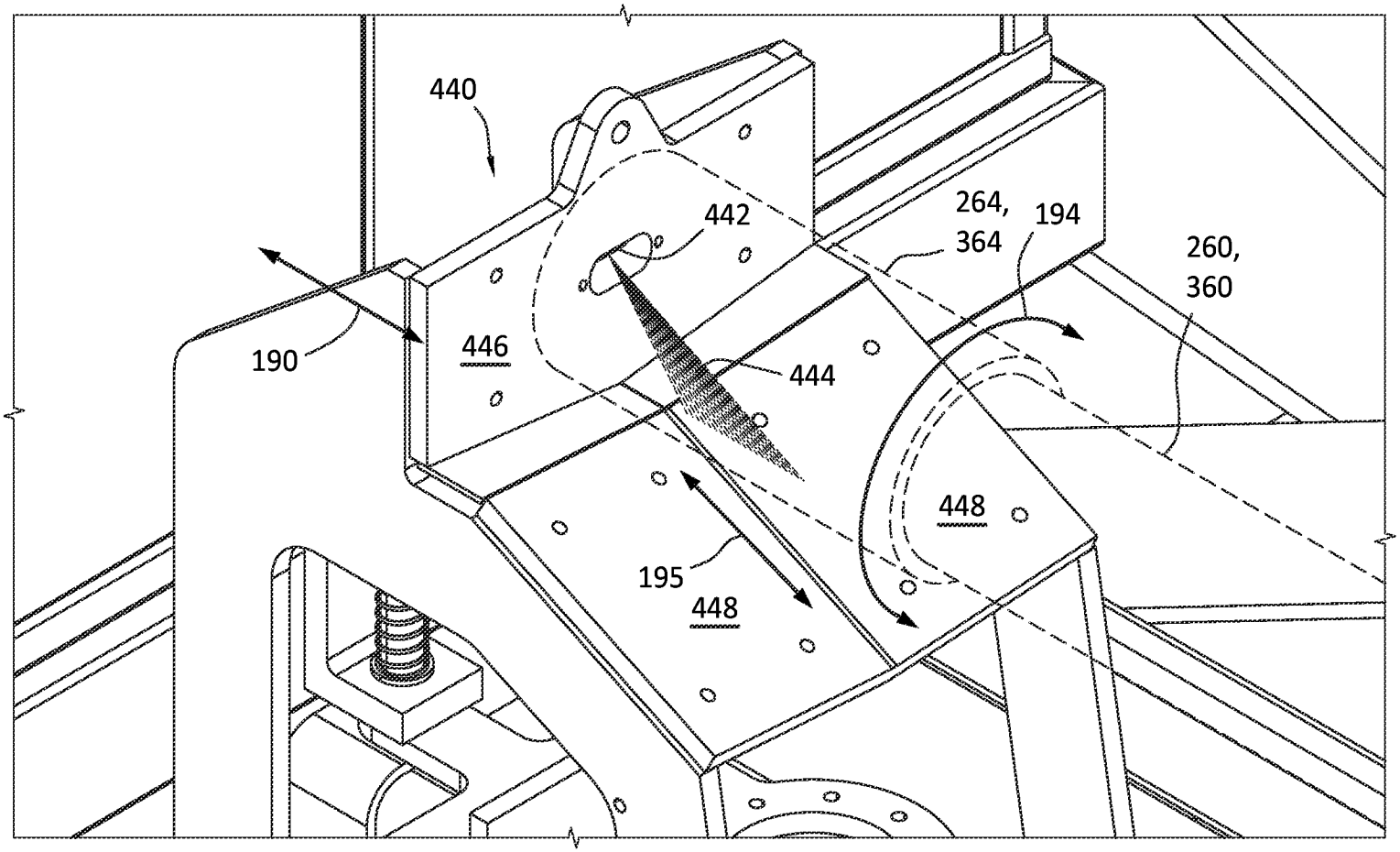
FIG. 31 is representative perspective view of a doping device for doping a box end of a tubular, in accordance with certain embodiments.

FIG. 31 is representative perspective view of a doping device 440 for doping a box end 264, 364 of a respective tubular 260, 360. Sensors 448 can be used to direct the box end 264, 364 up an incline (arrows 195) formed by the sensors 448 to align and position the box end 264, 364 in front of the engagement surface 446 and nozzles 442. The pipe handler 100 can rotate the box end 264, 364 (arrows 194) relative to the nozzles 442. While rotating the box end 264, 364, one or more of the nozzles 442 can project a spray pattern 444 that can be used to clean, dry, or apply dope to the internal threads of the box end 264, 364.

Figure 32:
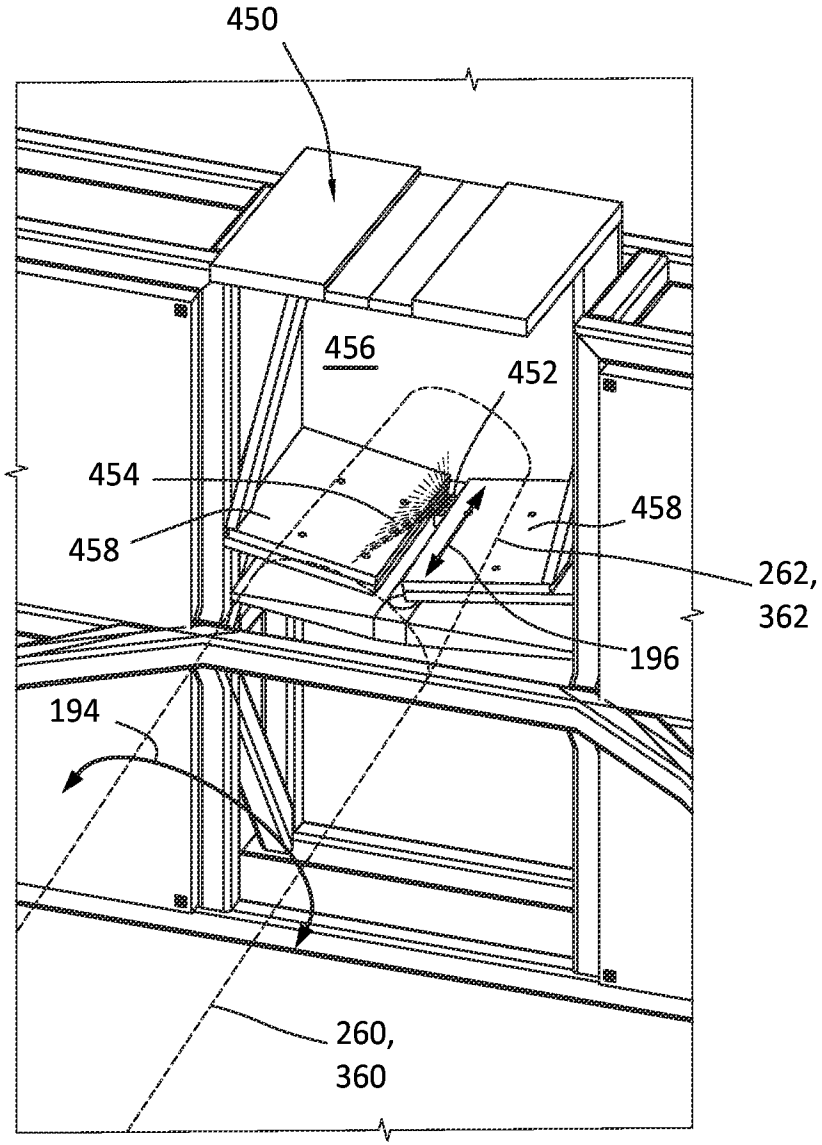
FIG. 32 is representative perspective view of a doping device for doping a pin end of a tubular, in accordance with certain embodiments.

FIG. 32 is representative perspective view of a doping device 450 for doping a pin end 262, 362 of a respective tubular 260, 360. Sensors 458 can be used to direct the pin end 262, 362 up an incline (arrows 196) formed by the sensors 458 to align and position the pin end 262, 362 in front of the engagement surface 456 and nozzles 452. The pipe handler 100 can rotate the pin end 262, 362 (arrows 194) relative to the nozzles 452. While rotating the pin end 262, 362, one or more of the nozzles 452 can project a spray pattern 454 that can be used to clean, dry, or apply dope to the external threads of the pin end 262, 362.

Figure 33:
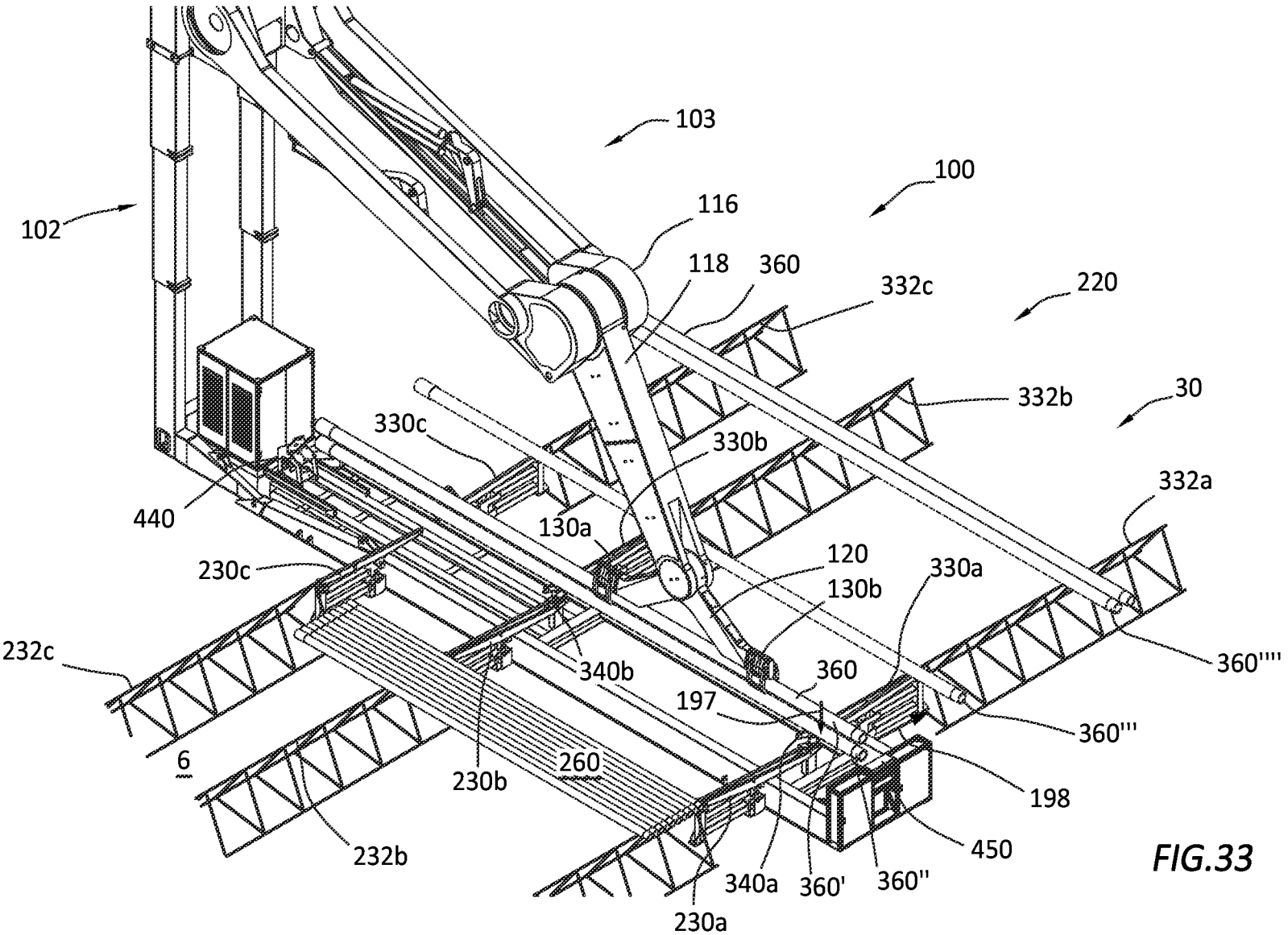
FIG. 33 is a representative perspective view of a pipe handler delivering tubulars to a horizontal pipe handler in a horizontal storage area, in accordance with certain embodiments.

FIG. 33 is a representative perspective view of a pipe handler 100 delivering a tubular 360 to a horizontal pipe handler 220 in a horizontal storage area 30. Tubulars 360 are being received by the HPH 220 and moved to the rails 332*a-c*. However, it should be understood that the pipe handler 100 can also deliver the tubulars 360 to the HPH 220 which can move them to the rails 232*a-c*. The pipe handler 100 can also deliver tubulars 260 to the HPH 220 and move them to either set of the rails 232*a-c* or 332*a-c*. Therefore, this discussion regarding FIG. 33 is similarly applicable to receiving and moving tubulars 260 or 360 to the rails 232*a-c* or rails 332*a-c*.

In a non-limiting embodiment, when the pipe handler 100 delivers a tubular 360 to the HPH 220, the pipe handler 100 can position the tubular 360 directly above the cradles 212*a-b* (or intermediate storage location). However, before the pipe handler 100 lowers the tubular 360 to the cradles 212*a-b*, the HPH 220 can raise the feeder arms 340*a-c* above the cradles 212*a-b* to an inclined position and above the turned-up portions of the ramp arm ends 352*a-c*. Therefore, when the pipe handler 100 moves the tubular 360 from position 360' to position 360" (arrows 197), the pipe handler 100 can release the tubular 360 onto the feeder arms 340*a-c*. Since the feeder arms 340*a-c* are raised to a position inclined toward the rails 332*a-c*, the tubular 360 can roll toward the rails 332*a-c* (arrows 198) from position 360" to position 360'". Once the tubular 360 has rolled to the rails 332*a-c*, operators can manipulate the tubular 360 to a position 360"" on the rails 332*a-c*. This process can be repeated for each tubular 360 received by the HPH 220 from the pipe handler 100. Alternatively, the feeder arms 240*a-c* can be raised to an inclined position. When the inclined feeder arms 240*a-c* receive the tubular 360 (or 260), the tubular 360 (or 260) can be rolled toward the rails 232*a-c* for storage (in this non-limiting example shorter tubulars 260 may only extend over the rails 232*a-b*, and not extend to the rail 232*c*). The left storage area shows a plurality of tubulars 260, but tubulars 360 can also be stored on the rails 232*a-c*. It should be understood that this process can also be used to remove a tubular 260, 360 that has already been placed on the cradles 212*a-b*. By raising either of the sets of feeder arms 240*a-c* or 340*a-c*, the tubular 260, 360 placed on the cradles 212*a-b* can be lifted from the cradles 212*a-b* and rolled away from the cradles 212*a-b* by the inclined set of feeder arms 240*a-c* or 340*a-c*.

Figure 34:
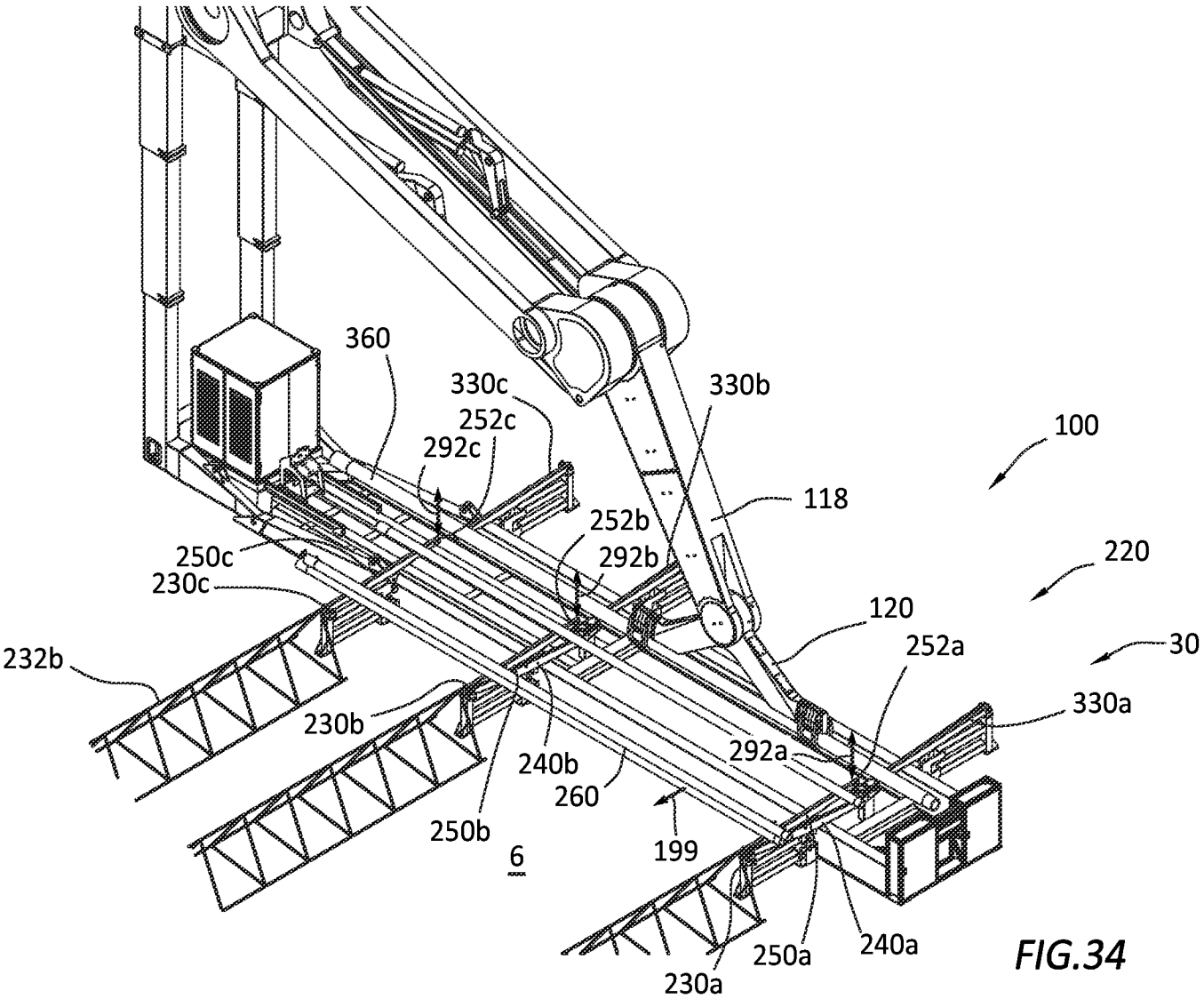
FIG. 34 is a representative perspective view of a horizontal pipe handler in a horizontal storage area clearing tubulars from the horizontal pipe handler, in accordance with certain embodiments.

FIG. 34 is a representative perspective view of a horizontal pipe handler 220 in a horizontal storage area 30 clearing tubulars 260 from the horizontal pipe handler 220. Another feature provided by the novel HPH 220 is the ability to clear tubulars from the ramp arms 250*a-c* or 350*a-c* after these ramp arms have been loaded with tubulars 260, 360 in a horizontal orientation. For the non-limiting embodiment shown in FIG. 34, tubulars 260 (in this example long tubulars 260) have been loaded onto ramp arms 250*a-c*. For whatever reason, it may be desirable to clear the tubulars 260 from the ramp arms 250*a-c*. The HPH 220 can provide the ability to raise (arrows 292*a-c*) the ramp arms 250*a-c* from a rest position to a position inclined away from the cradles 212*a-b*. This can urge the tubulars 260 to roll away from the cradles 212*a-b* and toward the rails 232*a-c* (arrows 199). Operators can roll the tubulars 260 further away from the LHPHs 230*a-c* by rolling them along the rails 232*a-c*.

Figure 35:
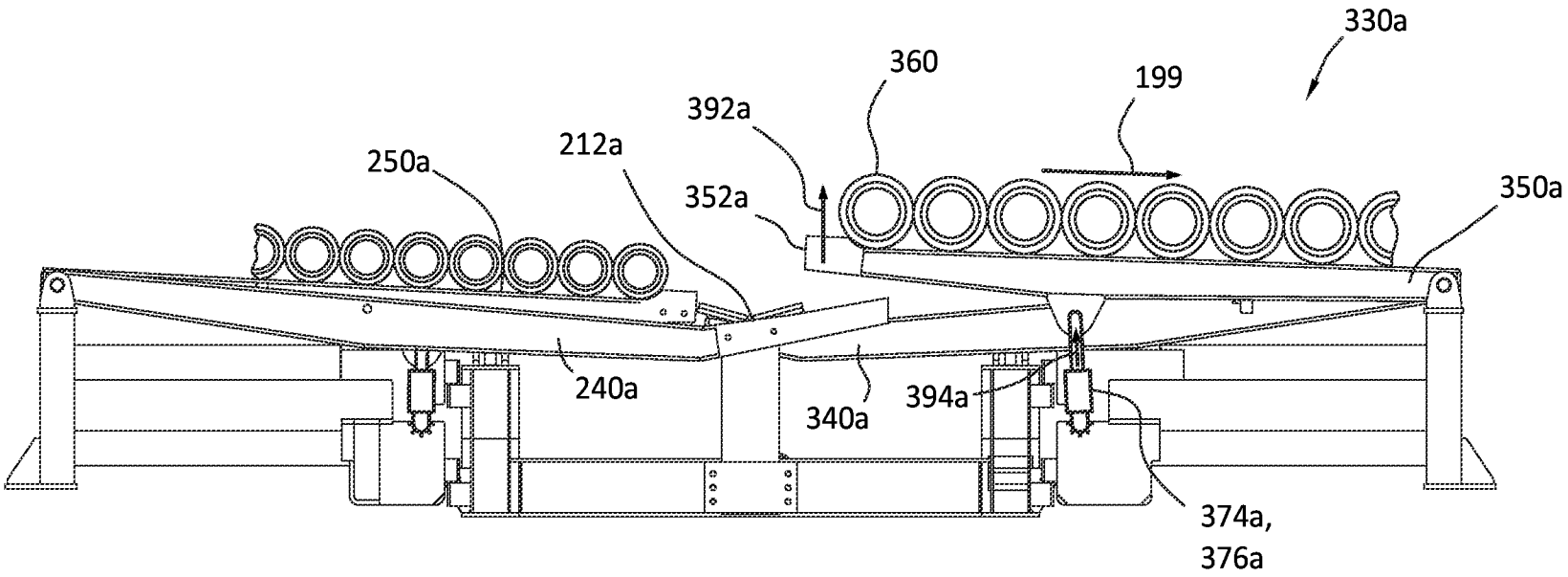
FIG. 35 is a representative front detailed view of a horizontal pipe handler in a horizontal storage area clearing tubulars from the horizontal pipe handler, in accordance with certain embodiments.

FIG. 35 is a representative front detailed view of a portion of the HPH 220 in a horizontal storage area 30 clearing tubulars 360 from the HPH 220. In this non-limiting example, tubulars 360 have been loaded onto the ramp arms 350*a-c*. To clear the tubulars 360 from the RHPH 330*a*, the actuator 376*a* can be extended (arrows 394*a*) to raise the ramp arm 350*a* (arrows 392*a*) until tubulars 360 are urged to roll away from the cradle 212*a*. The ramp arms 250*a-c*, 350*a-c* are designed to handle the weight of multiple tubulars 260, 360, where the feeder arms 240*a-c*, 340*a-c* may be designed for lighter loads (e.g., one tubular 260, 360).

Figure 36:
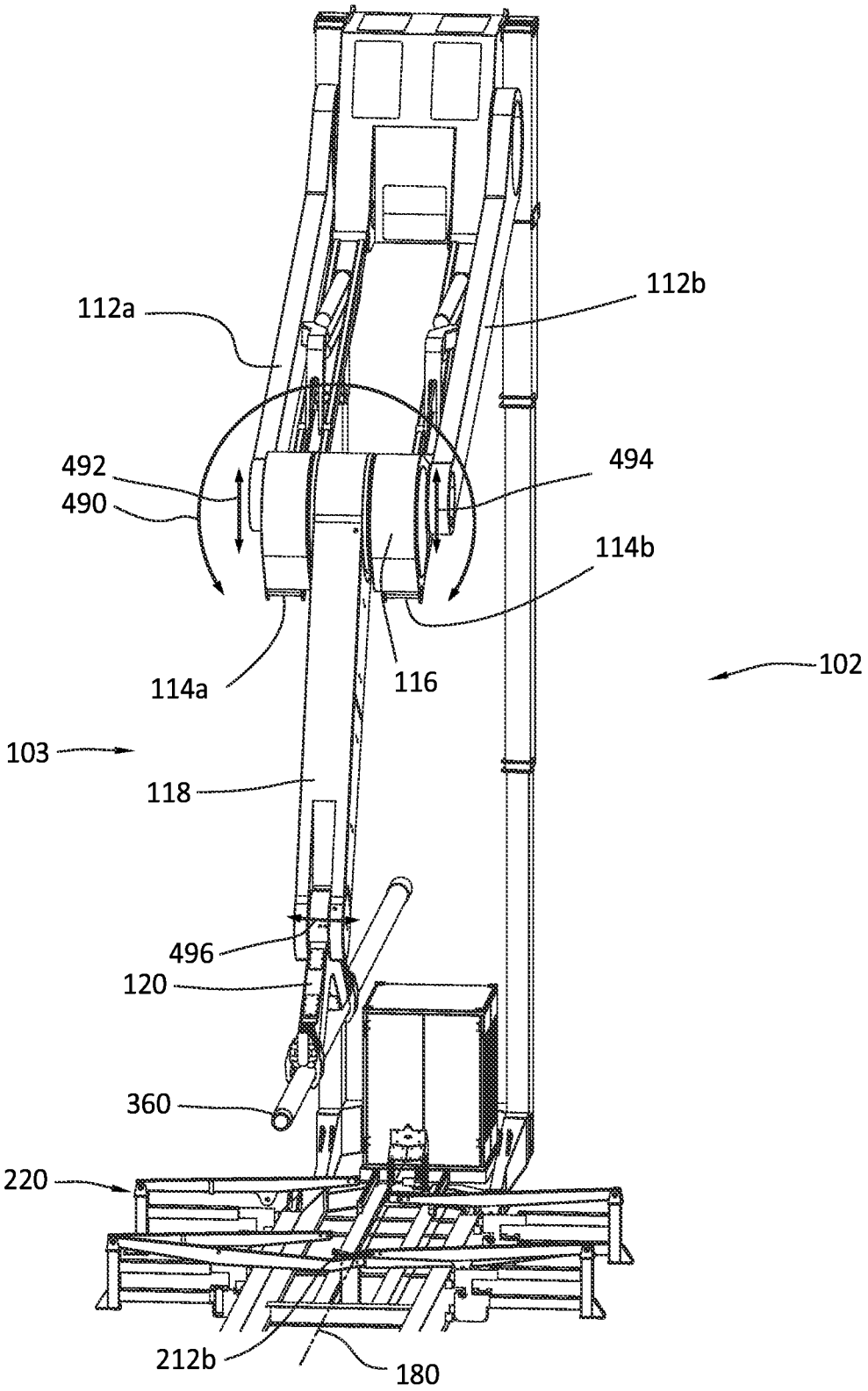
FIGS. 36-37 are representative perspective views of a pipe handler calibrating its alignment to other structures, in accordance with certain embodiments.

FIG. 36 is a representative perspective view of a pipe handler 100 calibrating an alignment of the tubular 360 with the cradles 212*a-b* (only cradle 212*b* is shown). To adjust a position of the tubular 360 in a longitudinal direction along a longitudinal axis 180 of the base 101, the pipe handler 100 can rotate the upper and lower beams 112*a-b*, 114*a-b* synchronously about the support 102, rotate the arm 118 about the coupling structure 116, and rotate the arm 120 relative to the arm 118 as needed to position the tubular in the desired longitudinal position along a longitudinal axis 180. However, if a position of the tubular 360 needs adjusting in a direction that is substantially perpendicular to the longitudinal axis 180, then the pipe handler 100 can operate the upper beams 112*a-b* and the lower beams 114*a-b* differently than described above to provide the perpendicular position adjustment.

With the pipe handler 100 in a deployed position as shown in FIG. 36, raising the beams 112*a*, 114*a* (arrows 492) relative to the beams 112*b*, 114*b* can rotate the coupling structure 116 (arrows 490) and swing the arm 120 in a left direction (arrows 496). Raising the beams 112*b*, 114*b* (arrows 494) relative to the beams 112*a*, 114*a* can rotate the coupling structure 116 (arrows 490) and swing the arm 120 in a right direction (arrows 496). Additionally, the beams 112*a*, 114*a* (arrows 492) can be moved in an opposite direction relative to the beams 112*b*, 114*b* while the beams 112*b*, 114*b* are also being moved, which can rotate the coupling structure 116 (arrows 490) and swing the arm 120 in a left or right direction (arrows 496) as desired to align the tubular 360.

When the proper left-right position of the arm 120 (and thus the tubular 360) is determined, a controller (200, 210, 222) can store the adjustments needed to repeatedly place the tubular 360 in the cradles 212*a-b* or retrieve the tubular 360 from the cradles 212*a-b*. Therefore, each time the pipe handler 100 interacts with the HPH 220, the adjustments can be applied to properly align the pipe handler 100 with the HPH 220. This calibration of the left-right positioning of the tubular 360 can be performed at installation or as needed after installation. The calibration can be performed via interactive human control, or via autonomous control of the pipe handler 100 via the controller 200, 210, or 222.

Figure 37:
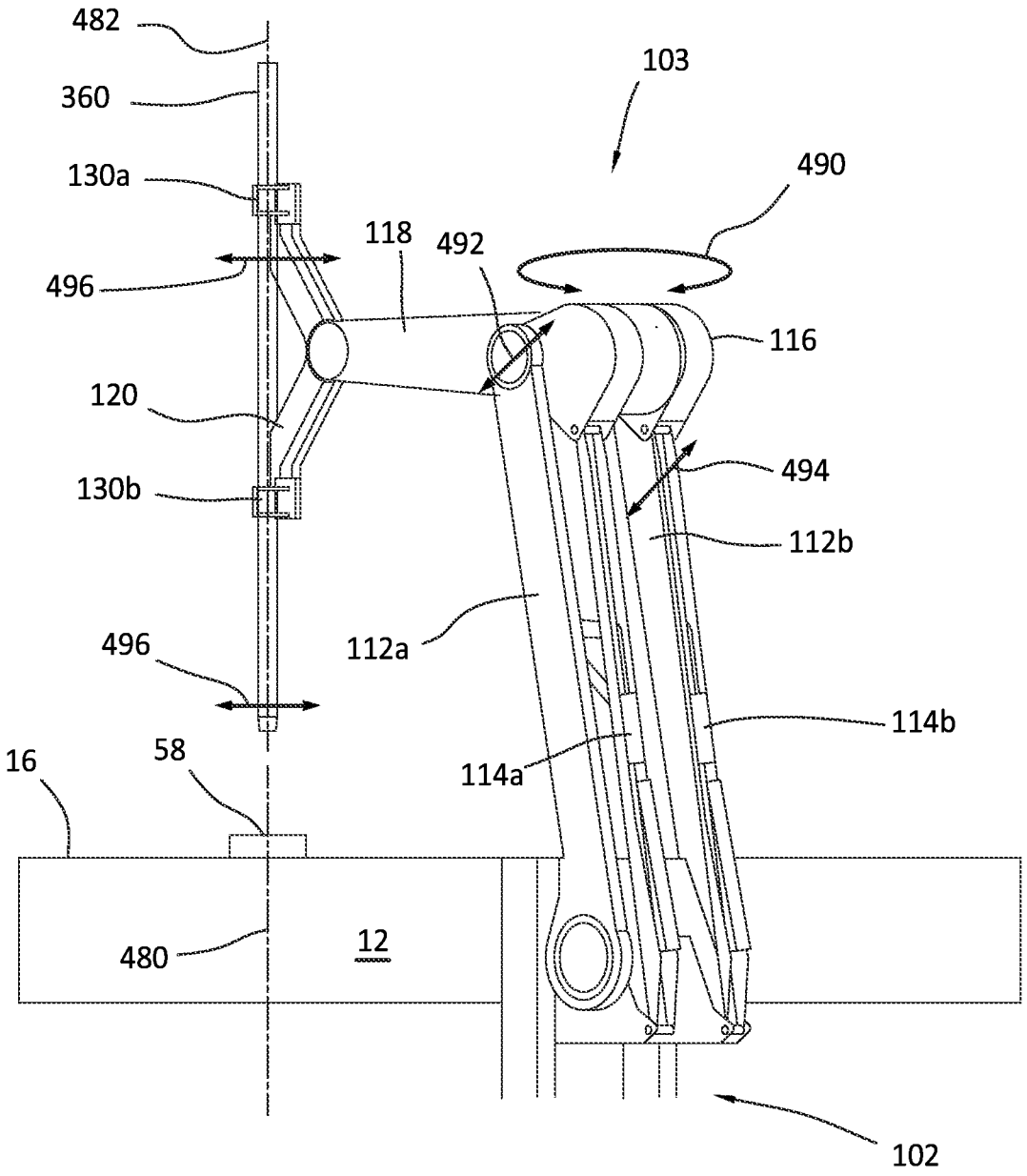

FIG. 37 is a representative perspective view of a pipe handler 100 calibrating an alignment of the tubular 360 with the well center 58. To adjust a position of the tubular 360 in a longitudinal direction (which in this configuration refers to the direction from the pipe handler support 102 to the well center 58), the pipe handler 100 can rotate the upper and lower beams 112*a-b*, 114*a-b* synchronously about the support 102, rotate the arm 118 about the coupling structure 116, and rotate the arm 120 relative to the arm 118 as needed to position the tubular 360 in the desired longitudinal position above the well center 58. However, if a position of the tubular 360 needs adjusting in a direction that is substantially perpendicular to the longitudinal direction, then the pipe handler 100 can operate the upper beams 112*a-b* and the lower beams 114*a-b* similarly as described above regarding FIG. 36 to provide the perpendicular (or left-to-right) position adjustment (arrows 496).

With the pipe handler 100 in a deployed position as shown in FIG. 37, moving the beams 112*a*, 114*a* (arrows 492) relative to the beams 112*b*, 114*b* can rotate the coupling structure 116 (arrows 490) and swing the arm 120 in a left or right direction (arrows 496). Alternatively, or in addition to, moving the beams 112*b*, 114*b* (arrows 494) relative to the beams 112*a*, 114*a*, can rotate the coupling structure 116 (arrows 490) and swing the arm 120 in a left or right direction (arrows 496).

When the proper left-right position of the arm 120 (and thus the tubular 360) is determined (i.e., the longitudinal axis 482 of the tubular 360 is substantially aligned with the center axis 480 of the well center 58), the controller (200, 210, 222) can store the adjustments needed to repeatedly place the tubular 360 in alignment with well center 58. Therefore, each time the pipe handler 100 interacts with the well center 58, the adjustments can be applied to properly align the tubular 360 with the well center 58. This calibration of the left-right and longitudinal positioning of the tubular 360 can be performed at installation or as needed after installation. The calibration can be performed via interactive human control, or via autonomous control of the pipe handler 100 by the controller 200, 210, or 222.

Figure 38B:
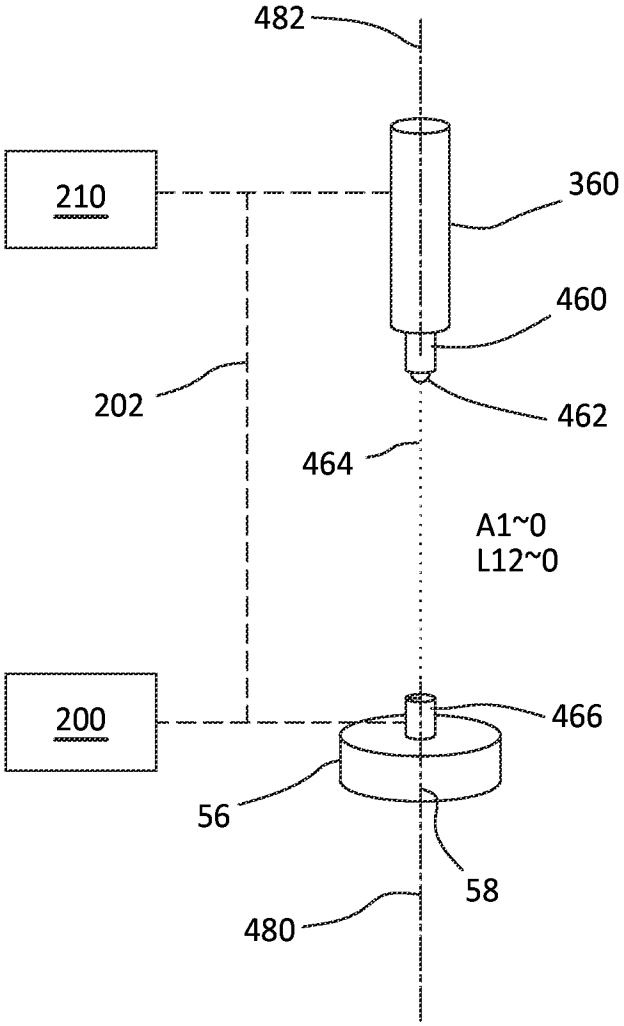
FIGS. 38A-38B are representative functional block diagrams of a pipe handler calibrating its alignment to well center, in accordance with certain embodiments.
Figure 38A:
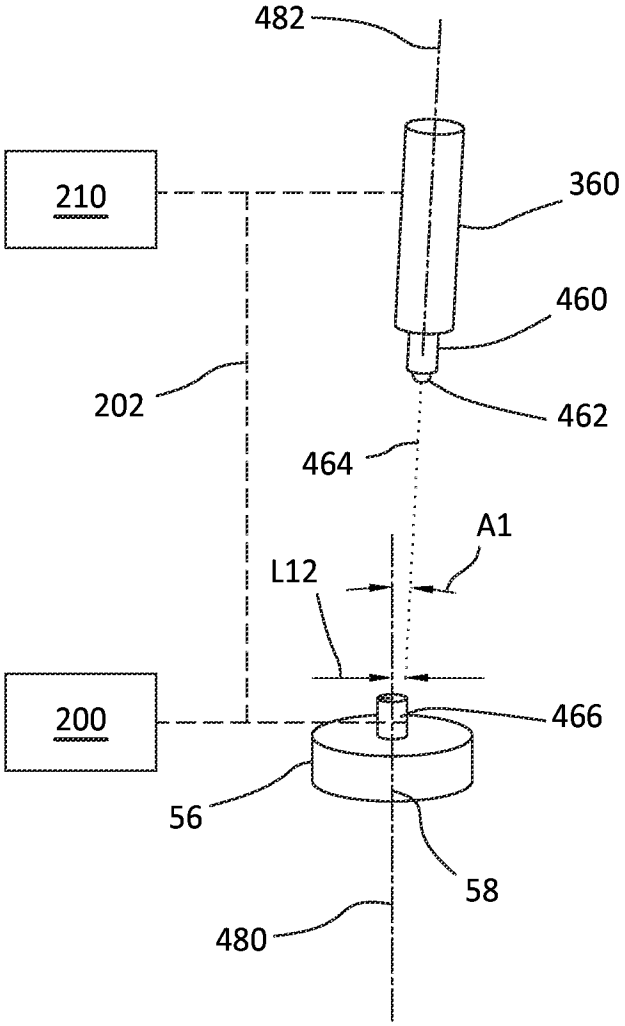

FIGS. 38A-38B are representative functional block diagrams of a pipe handler 100 calibrating its alignment of a tubular 360 to a well center 58. The rig controller 200 can be communicatively coupled to the pipe handler controller 210 via a wired or wireless network 202, which can also communicatively couple the controllers 200, 210 to the pipe handler 100 that is gripping a tubular 360 and to a sensor 466 at well center 58. The tubular 360 can include a light transmitter 460 mounted to an end of the tubular 360, the transmitter 460 having a light source 462 that can project a light beam 464 from the light source 462. After the pipe handler 100 is installed at the rig site (or during operation of the rig 10) the pipe handler 100 can perform an alignment calibration of the pipe handler 100 to the well center 58. The pipe handler 100 can pickup a tubular 360 with the light transmitter 460 attached to one end (such as the pin end 362). The pipe handler 100 can manipulate the tubular 360 such that the light transmitter 460 is positioned to transmit the light beam 464 toward the well center 58. The light beam 464 can be aligned with the longitudinal axis 482 of the tubular 360.

As the pipe handler 100 manipulates the tubular 360, the direction of the light beam 464 can be adjusted to compensate for the angle A1 by which the axis 482 is angled away from the center axis 480, and for the distance L12 that the light beam 464 is spaced away from the center axis 480. As the controllers 200, 210 receive the sensor data from the sensor 466, which is sensitive to the intensity of the received light beam as well as a direction from which the light beam is received, the sensor 466 can provide sensor data to the controllers 200, 210. By adjusting the position of the tubular 360 as described above regarding FIG. 37, the pipe handler 100 can cause the light beam 464 (and thus the axis 482 of the tubular 360) to be aligned with the center axis 480 (i.e., angle A1 and distance L1 approximately equal to "0") as indicated in FIG. 38B. The controller (200, 210) can store the adjustments needed to align the light beam 464 with the center axis 480, and the controller 200, 210 can apply these adjustments when the pipe handler 100 is interacting with a tubular (e.g., 260, 360) at well center 58.

Various Embodiments

Embodiment 1. A system for performing a subterranean operation, the system comprising:

- a pipe handler comprising:
  - a base;
  - a support rotatably attached to the base at one end of the support;
  - a first actuator configured to telescopically extend the support into engagement with a rig; and
  - a pipe handler mechanism rotatably attached to the support proximate an opposite end of the support, the pipe handler mechanism being configured to grip and transport an object from a pick-up location to a delivery location.

Embodiment 2. The system of embodiment 1, wherein the pipe handler is configured to engage a first rig floor and to access, via the pipe handler mechanism, a first horizontal storage area that is at a first vertical distance from the first rig floor, and wherein the pipe handler is configured to engage a second rig floor and to adapt to access, via the pipe handler mechanism, a second horizontal storage area when the second rig floor is at a second vertical distance from the second horizontal storage area.

Embodiment 3. The system of embodiment 1, wherein the first actuator is configured to telescopically retract the support to disengage the support from the rig.

Embodiment 4. The system of embodiment 1, wherein the pick-up location is one of a well center, a rig floor, a vertical storage area, another pipe handler, and horizontal storage area.

Embodiment 5. The system of embodiment 1, wherein the delivery location is one of a well center, a rig floor, a vertical storage area, another pipe handler, and horizontal storage area.

Embodiment 6. The system of embodiment 1, wherein the support is configured to remain engaged with the rig while the pipe handler mechanism transports the object from the pick-up location to the delivery location.

Embodiment 7. The system of embodiment 6, wherein the support is configured to remain in a substantially vertical orientation relative to the base while the pipe handler mechanism transports the object from the pick-up location to the delivery location.

Embodiment 8. The system of embodiment 1, wherein the object comprises a tubular, a tool, a bottom hole assembly (BHA), or a sub.

Embodiment 9. The system of embodiment 1, wherein the pipe handler mechanism comprises first and second beams rotatably attached to the support proximate the opposite end of the support, and rotatably coupled to a first arm at an opposite end of the first and second beams, wherein the first and second beams are separated from each other by a horizontal space.

Embodiment 10. The system of embodiment 9, wherein the first and second beams are rotationally attached to a coupling structure, and the coupling structure is rotationally attached to the first arm, with the first arm being rotationally attached to a second arm with a gripper attached to each end of the second arm.

Embodiment 11. The system of embodiment 9, wherein the first arm is configured to rotate through the horizontal space between the first and second beams when transporting the object between the pick-up location and the delivery location.

Embodiment 12. The system of embodiment 9, wherein the first beam comprises a first upper beam and a first lower beam, wherein the first upper beam and the first lower beam are vertically aligned with each other and are separated by a first space therebetween.

Embodiment 13. The system of embodiment 12, wherein the first space varies in size as the first upper beam and the first lower beam are rotated between various deployed positions of the pipe handler mechanism.

Embodiment 14. The system of embodiment 12, wherein the first upper beam and the first lower beam are parallel to each other.

Embodiment 15. The system of embodiment 14, wherein one end of the first upper beam is rotationally connected to a first upper pivot on a first support bracket disposed proximate the opposite end of the support, and wherein one end of the first lower beam is rotationally connected to a first lower pivot on the first support bracket.

Embodiment 16. The system of embodiment 15, wherein an opposite end of the first upper beam is rotationally connected to a third upper pivot on a coupling structure, and wherein an opposite end of the first lower beam is rotationally connected to a third lower pivot on the coupling structure, and wherein the coupling structure is rotationally coupled to an arm that is rotationally coupled to first and second grippers, which are configured to engage and hold the object.

Embodiment 17. The system of embodiment 16, wherein the first support bracket, the first upper beam, the first lower beam, and the coupling structure form a first parallelogram that is a four-bar linkage configuration.

Embodiment 18. The system of embodiment 17, wherein the second beam comprises a second upper beam and a second lower beam, wherein the second upper beam and the second lower beam are vertically aligned with each other and are separated by a second space therebetween.

Embodiment 19. The system of embodiment 18, wherein the second space varies in size as the second upper beam and the second lower beam are rotated between various deployed positions of the pipe handler mechanism.

Embodiment 20. The system of embodiment 18, wherein the second upper beam and the second lower beam are parallel to each other.

Embodiment 21. The system of embodiment 20, wherein one end of the second upper beam is rotationally connected to a second upper pivot on a second support bracket disposed proximate the opposite end of the support and horizontally spaced away from the first support bracket, and wherein one end of the second lower beam is rotationally connected to a second lower pivot on the second support bracket.

Embodiment 22. The system of embodiment 21, wherein an opposite end of the second upper beam is rotationally connected to a fourth upper pivot on the coupling structure, and wherein an opposite end of the second lower beam is rotationally connected to a fourth lower pivot on the coupling structure.

Embodiment 23. The system of embodiment 22, wherein the second support bracket, the second upper beam, the second lower beam, and the coupling structure form a second parallelogram that is a four-bar linkage configuration.

Embodiment 24. The system of embodiment 23, wherein the first parallelogram forms a first vertical plane and the second parallelogram forms a second vertical plane which is parallel to the first vertical plane and horizontally spaced apart from the first vertical plane.

Embodiment 25. The system of embodiment 1, wherein the support comprises: upper supports and lower supports, with the upper supports slidably coupled to the lower supports, wherein the first actuator slides the upper supports relative to the lower supports to telescopically extend or retract the upper supports relative to the lower supports.

Embodiment 26. The system of embodiment 25, wherein the upper supports comprise an upper end that is configured to engage an engagement means on the rig when the upper supports are extended into engagement with the rig.

Embodiment 27. The system of embodiment 1, further comprising a second actuator that extends to rotate the support toward a deployed position that is substantially vertical relative to the base or retracts to rotate the support toward a stowed position on the base.

Embodiment 28. The system of embodiment 1, wherein the pipe handler is configured to be transported to and from a well site on a conveyance, with the pipe handler in a stowed position.

Embodiment 29. The system of embodiment 28, wherein the conveyance comprises a tractor trailer vehicle.

Embodiment 30. The system of embodiment 1, wherein the pipe handler mechanism comprises a first arm with one end rotationally coupled to the support and another end rotationally attached to a center of a second arm, wherein the second arm comprises first and second portions that extend from the center at an obtuse angle to each other with a gripper attached at an end of each of the first and second portions.

Embodiment 31. A system for performing a subterranean operation, the system comprising:

a base;

a support rotatably attached to the base at one end and configured to engage a rig at an opposite end;

a pipe handler mechanism rotatably attached to the support proximate the opposite end of the support, the pipe handler mechanism comprising:

a first arm rotationally coupled to one or more grippers; and a plurality of lift beams rotationally coupled at one end to the support and rotationally coupled at an opposite end to the first arm, wherein the first arm is configured to rotate independently of the plurality of lift beams.

Embodiment 32. The system of embodiment 31, wherein the opposite end of the plurality of lift beams are rotationally attached to a coupling structure and the coupling structure is rotationally attached to the first arm, with the first arm rotationally attached to a center of a second arm.

Embodiment 33. The system of embodiment 32, wherein the second arm comprises first and second portions that extend from the center at an obtuse angle to each other with a gripper attached at an end of each of the first and second portions.

Embodiment 34. The system of embodiment 31, wherein the plurality of lift beams comprises at least a first lift beam and a second lift beam, with the first lift beam and the second lift beam being separated from each other by a horizontal space, and wherein the pipe handler mechanism is configured to grip and transport an object from a pick-up location to a delivery location with the object being transported through the horizontal space.

Embodiment 35. The system of embodiment 31, further comprising a first actuator configured to telescopically extend the support into engagement with a rig or telescopically retract the support to disengage the support from the rig.

Embodiment 36. A method for performing a subterranean operation, the method comprising:

rotating a support, via a first actuator, from a stowed position on a base to a vertical position relative to the base;

vertically extending the support, via a second actuator, into engagement with a first rig; and rotating a pipe handler mechanism relative to the support from a stowed position to a deployed position, the pipe handler mechanism being rotationally coupled to the support and being configured to grip and transport an object from a pick-up location to a delivery location.

Embodiment 37. The method of embodiment 36, further comprising:

gripping an object, via one or more grippers of the pipe handler mechanism, at the pick-up location;

transporting the object toward the delivery location by rotating a plurality of lift beams of the pipe handler mechanism and rotating at least one arm coupled the one or more grippers;

transporting the object through a space formed between the plurality of lift beams; and delivering the object to the delivery location.

Embodiment 38. The method of embodiment 37, further comprising:

rotating the pipe handler mechanism to deployed positions from the pick-up location to the delivery location, while the support remains stationary in the vertical position.

Embodiment 39. The method of embodiment 37, wherein the object is a tubular with the method further comprising:

while transporting the tubular toward the delivery location, inserting an end of the tubular in a doping bucket; and cleaning, drying, and applying a layer of dope to threads on the end of the tubular while the pipe handler mechanism is rotating the tubular relative to the doping bucket and the doping bucket remains stationary relative to a first rig floor of the first rig.

Embodiment 40. The method of embodiment 36, further comprising:

rotating the pipe handler mechanism relative to the support from the deployed position to the stowed position;

vertically retracting the support, via the second actuator, from engagement with the first rig;

rotating the support from the vertical position to the stowed position on the base; transporting the base, the support, and the pipe handler mechanism in a stowed position from the first rig to a second rig via a conveyance; and positioning the base proximate the second rig, where a second rig floor of the second rig is at a different height from a surface on which the base is resting when compared to a height of a first rig floor of the first rig from the surface on which the base was resting when positioned proximate the first rig.

Embodiment 41. The method of embodiment 40, further comprising:

rotating the support, via the first actuator, from the stowed position on the base to the vertical position relative to the base;

vertically extending the support, via the second actuator, into engagement with an engagement means of the second rig; and rotating the pipe handler mechanism relative to the support from the stowed position to the deployed position.

Embodiment 42. A system for performing a subterranean operation, the system comprising:

a pipe handler comprising:

a support fixedly mounted to a rig floor; and a pipe handler mechanism rotatably attached to the support, the pipe handler mechanism being configured to grip and transport an object from a pick-up location to a delivery location.

Embodiment 43. The system of embodiment 42, wherein the pipe handler is configured to access, via the pipe handler mechanism, a horizontal storage area that is at a first horizontal distance from the rig floor, and wherein the pipe handler is configured to adapt to access, via the pipe handler mechanism, the horizontal storage area when the rig floor is at a second horizontal distance from the rig floor.

Embodiment 44. The system of embodiment 43, wherein the rig floor is configured to move laterally along a platform from a first well center to a second well center, wherein the rig floor is at the first horizontal distance from the horizontal storage area at the first well center, and the rig floor is at the second horizontal distance from the horizontal storage area at the second well center.

Embodiment 45. The system of embodiment 42, wherein the pick-up location is one of a well center, a rig floor, a vertical storage area, another pipe handler, and horizontal storage area.

Embodiment 46. The system of embodiment 42, wherein the delivery location is one of a well center, a rig floor, a vertical storage area, another pipe handler, and horizontal storage area.

Embodiment 47. The system of embodiment 42, wherein the object comprises a tubular, a tool, a bottom hole assembly (BHA), or a sub.

Embodiment 48. The system of embodiment 42, wherein the pipe handler mechanism comprises first and second beams rotatably attached to the support, and rotatably coupled to a first arm at an opposite end of the first and second beams, wherein the first and second beams are separated from each other by a horizontal space.

Embodiment 49. A method of operating any one of the embodiments of the pipe handler described in this disclosure to manipulate tubulars to/from a horizontal storage area.

Embodiment 50. Any one or more of the pipe handler embodiments described in this disclosure.

Embodiment 51. A tubular handling system comprising:
- a pipe handler comprising:
  - a base;
  - a support rotatably attached to the base at one end of the support;
  - a first actuator configured to telescopically extend the support into engagement with a structure; and
  - a pipe handler mechanism rotatably attached to the support proximate an opposite end of the support, the pipe handler mechanism being configured to grip and transport an object from a pick-up location to a delivery location.

Embodiment 52. The system of embodiment 51, wherein the structure is a first structure, wherein the pipe handler is configured to engage the first structure and to access, via the pipe handler mechanism, a first horizontal storage area that is at a first vertical distance below the first structure, and wherein the pipe handler is configured to engage a second structure and to adapt to access, via the pipe handler mechanism, a second horizontal storage area when the second structure is at a second vertical distance below the second horizontal storage area, with the first vertical distance being different than the second vertical distance.

Embodiment 53. The system of embodiment 51, wherein the pick-up location is one of a well center, a rig floor, a vertical storage area, another pipe handler, and horizontal storage area, and wherein the delivery location is another one of the well center, the rig floor, the vertical storage area, the another pipe handler, and the horizontal storage area.

Embodiment 54. The system of embodiment 51, wherein the pipe handler mechanism comprises first and second beams rotatably attached to the support proximate the opposite end of the support, and rotatably coupled to a first arm at an opposite end of the first and second beams, wherein the first and second beams are separated from each other by a horizontal space.

Embodiment 55. The system of embodiment 54, wherein the first arm is configured to rotate in a first direction through the horizontal space between the first and second beams when transporting the object between the pick-up location and the delivery location.

Embodiment 56. The system of embodiment 55, wherein the first beam is rotated relative to the second beam and the support, such that the first arm is rotated in a second direction which is substantially perpendicular to the first direction.

Embodiment 57. The system of embodiment 56, wherein grippers coupled to the first arm grip a tubular, and wherein rotation of the first arm in the second direction adjusts an alignment of the tubular to a well center.

Embodiment 58. The system of embodiment 54, wherein the first beam comprises a first upper beam and a first lower beam, wherein the first upper beam and the first lower beam are vertically aligned with each other and are separated by a first space therebetween, and wherein the support, the first upper beam, the first lower beam, and the coupling structure form a first parallelogram that is a four-bar linkage configuration.

Embodiment 59. The system of embodiment 58, wherein the second beam comprises a second upper beam and a second lower beam, wherein the second upper beam and the second lower beam are vertically aligned with each other and are separated by a second space therebetween, and wherein the support, the second upper beam, the second lower beam, and the coupling structure form a second parallelogram that is a four-bar linkage configuration.

Embodiment 60. The system of embodiment 51, wherein the support comprises: upper supports and lower supports, with the upper supports slidably coupled to the lower supports, wherein the first actuator slides the upper supports relative to the lower supports to telescopically extend or retract the upper supports relative to the lower supports.

Embodiment 61. A tubular handling system comprising:
- a base;
- a support rotatably attached to the base at one end and configured to engage a structure at an opposite end;
- a pipe handler mechanism rotatably attached to the support proximate the opposite end of the support, the pipe handler mechanism comprising:
  - a first arm rotationally coupled to one or more grippers; and
  - a plurality of lift beams rotationally coupled at one end to the support and rotationally coupled at an opposite end to the first arm, wherein the first arm is configured to rotate independently of the plurality of lift beams.

Embodiment 62. The system of embodiment 61, wherein the opposite end of the plurality of lift beams are rotationally attached to a coupling structure and the coupling structure is rotationally attached to the first arm, with the first arm rotationally attached to a center of a second arm.

Embodiment 63. The system of embodiment 61, wherein the plurality of lift beams comprises at least a first lift beam and a second lift beam, with the first lift beam and the second lift beam being separated from each other by a horizontal space, and wherein the pipe handler mechanism is configured to grip and transport an object from a pick-up location to a delivery location with the object being transported through the horizontal space.

Embodiment 64. The system of embodiment 61, further comprising a first actuator configured to telescopically extend the support into engagement with the structure or telescopically retract the support to disengage the support from the structure.

Embodiment 65. A method for performing a subterranean operation, the method comprising:
- rotating a support, via a first actuator, from a stowed position on a base to a vertical position relative to the base;
- vertically extending the support, via a second actuator, into engagement with a structure; and
- rotating a pipe handler mechanism relative to the support from a stowed position to a deployed position, the pipe handler mechanism being rotationally coupled to the support and being configured to grip and transport an object from a pick-up location to a delivery location.

Embodiment 66. The method of embodiment 65, further comprising:

gripping an object, via one or more grippers of the pipe handler mechanism, at the pick-up location;

transporting the object toward the delivery location by rotating a plurality of lift beams of the pipe handler mechanism and rotating at least one arm coupled the one or more grippers;

transporting the object through a space formed between the plurality of lift beams; and delivering the object to the delivery location.

Embodiment 67. The method of embodiment 66, further comprising:

rotating the pipe handler mechanism to deployed positions from the pick-up location to the delivery location, while the support remains stationary in the vertical position.

Embodiment 68. The method of embodiment 66, wherein the structure is a first rig and the object is a tubular with the method further comprising:

while transporting the tubular toward the delivery location, inserting an end of the tubular in a doping bucket; and cleaning, drying, and applying a layer of dope to threads on the end of the tubular while the pipe handler mechanism is rotating the tubular relative to the doping bucket and the doping bucket remains stationary relative to a first rig floor of the first rig.

Embodiment 69. The method of embodiment 65, wherein the structure is a first rig, with the method further comprising:

rotating the pipe handler mechanism relative to the support from the deployed position to the stowed position;

vertically retracting the support, via the second actuator, from engagement with the first rig;

rotating the support from the vertical position to the stowed position on the base; transporting the base, the support, and the pipe handler mechanism in a stowed position from the first rig to a second rig via a conveyance; and positioning the base proximate the second rig, where a second rig floor of the second rig is at a different height from a surface on which the base is resting when compared to a height of a first rig floor of the first rig from the surface on which the base was resting when positioned proximate the first rig.

Embodiment 70. The method of embodiment 69, further comprising:

rotating the support, via the first actuator, from the stowed position on the base to the vertical position relative to the base;

vertically extending the support, via the second actuator, into engagement with an engagement means of the second rig; and rotating the pipe handler mechanism relative to the support from the stowed position to the deployed position.

Embodiment 71. A horizontal pipe handling system comprising:

a base with a center longitudinal axis;

an intermediate storage location comprising a cradle attached to the base, wherein the cradle is configured to support a first tubular in a horizontal orientation;

a first horizontal pipe handler with a first feeder arm rotationally attached to the base at a first axis which is disposed on a first side of the center longitudinal axis, wherein the first feeder arm extends from the first axis, past the cradle, and to a second side of the center longitudinal axis, with the first side and the second side being opposite each other relative to the center longitudinal axis; and a second horizontal pipe handler with a first ramp arm rotationally attached to the base at a second axis which is disposed on the second side of the center longitudinal axis, wherein the first ramp arm is configured to support one or more tubulars in the horizontal orientation which is substantially parallel to the center longitudinal axis.

Embodiment 72. The system of embodiment 71, wherein rotation of the first feeder arm about the first axis in a first direction lifts the first tubular off of the first ramp arm and rolls the first tubular toward the cradle.

Embodiment 73. The system of embodiment 72, wherein rotation of the first feeder arm about the first axis in a second direction lowers the first tubular to the cradle.

Embodiment 74. The system of embodiment 73, wherein two top surfaces of the cradle form an up-turned V-shape that urges the first tubular toward a center of the up-turned V-shape when the first tubular is lowered to the cradle.

Embodiment 75. The system of embodiment 71, wherein rotation of the first ramp arm about the second axis in a first direction urges the one or more tubulars to roll away from the center longitudinal axis.

Embodiment 76. The system of embodiment 71, wherein the first ramp arm forms an inclined surface that is inclined toward the center longitudinal axis when the first ramp arm is in a rest position.

Embodiment 77. The system of embodiment 76, wherein the inclined surface is inclined away from the center longitudinal axis when the first ramp arm is rotated in a first direction about the second axis to a raised position.

Embodiment 78. The system of embodiment 76, wherein the first ramp arm has a first end that is rotationally attached to the base at the second axis and a second end that has an up-turned top surface, wherein, when the first ramp arm is in the rest position, the inclined surface urges the one or more tubulars to roll toward the center longitudinal axis until the one or more tubulars engage the up-turned top surface.

Embodiment 79. The system of embodiment 71, wherein the cradle comprises a first cradle and a second cradle, and wherein the second cradle is spaced away from the first cradle along the center longitudinal axis.

Embodiment 80. The system of embodiment 79, further comprising:

a third horizontal pipe handler with a second feeder arm rotationally attached to the base at the first axis, wherein the second feeder arm extends from the first axis, past the second cradle, and to the second side of the center longitudinal axis; and a fourth horizontal pipe handler with a second ramp arm rotationally attached to the base at the second axis, wherein the second ramp arm is configured to support the one or more tubulars in the horizontal orientation.

Embodiment 81. The system of embodiment 80, wherein rotation of the first feeder arm and the second feeder arm about the first axis in a first direction lifts the first tubular off of the first ramp arm and the second ramp arm and rolls the first tubular toward the first cradle and the second cradle.

Embodiment 82. The system of embodiment 81, wherein rotation of the first feeder arm and the second feeder arm about the first axis in a second direction lowers the first tubular to the first cradle and the second cradle.

Embodiment 83. The system of embodiment 82, wherein two top surfaces of the first cradle form a first up-turned V-shape and two top surfaces of the second cradle form a second up-turned V-shape, wherein the first and second up-turned V-shapes urge the first tubular toward a center of the first and second up-turned V-shapes when the first tubular is lowered to the first cradle and the second cradle.

Embodiment 84. The system of embodiment 80, wherein rotation of the first feeder arm and the second feeder arm in a first direction lifts the first tubular from the first cradle and the second cradle and rolls the first tubular away from the center longitudinal axis and toward the first side.

Embodiment 85. The system of embodiment 80, wherein rotation of the first feeder arm and the second feeder arm in a first direction to an inclined position where the first feeder arm and the second feeder arm are inclined away from the center longitudinal axis and toward the first side.

Embodiment 86. The system of embodiment 85, wherein the first feeder arm and the second feeder arm receive a second tubular from a robotic pipe handler in the horizontal orientation, and due to the inclined position, the first feeder arm and the second feeder arm roll the second tubular away from the center longitudinal axis and toward the first side.

Embodiment 87. A method for handling pipes, the method comprising:

storing one or more tubulars in a horizontal storage area;

receiving the one or more tubulars at a horizontal pipe handling system, which comprises a base with a center longitudinal axis and horizontal pipe handlers positioned on either side of the base;

positioning a first tubular of the one or more tubulars on one side of the center longitudinal axis;

lifting the first tubular, via a feeder arm of at least one of the horizontal pipe handlers, the feeder arm extending from an opposite side of the center longitudinal axis;

rolling the first tubular along the feeder arm toward an intermediate storage location at the center longitudinal axis; and positioning the first tubular in the intermediate storage location.

Embodiment 88. The method of embodiment 87, further comprising:

engaging a box end of the first tubular with a moveable doping device;

moving the first tubular, via the moveable doping device, along the center longitudinal axis towards a stationary doping device; and engaging a pin end of the first tubular with the stationary doping device.

Embodiment 89. The method of embodiment 88, further comprising:

determining a length of the first tubular based on a position of the moveable doping device relative to the stationary doping device.

Embodiment 90. The method of embodiment 88, further comprising:

determining a weight of the first tubular based on sensors in the intermediate storage location.

Embodiment 91. The method of embodiment 90, further comprising:

receiving data from the sensors at a controller; and determining, via the controller, an actual weight of the first tubular, wherein the sensors are disposed on one or more cradles that support the first tubular in the intermediate storage location.

Embodiment 92. The method of embodiment 88, further comprising:

engaging the first tubular in the intermediate storage location with grippers of a pipe handler.

Embodiment 93. The method of embodiment 92, further comprising:

rotating the first tubular in a horizontal orientation in the intermediate storage location via the grippers of the pipe handler.

Embodiment 94. The method of embodiment 93, further comprising:

cleaning, drying, and doping internal threads of the box end of the first tubular via the moveable doping device while the first tubular is being rotated.

Embodiment 95. The method of embodiment 93, further comprising:

cleaning, drying, and doping external threads of the pin end of the first tubular via the stationary doping device while the first tubular is being rotated.

Embodiment 96. The method of embodiment 92, further comprising:

lifting the first tubular from the intermediate storage location and transporting the first tubular to a rig floor via the pipe handler.

Embodiment 97. The method of embodiment 87, further comprising:

raising the feeder arm to an inclined position, thereby lifting the first tubular from the intermediate storage location; and rolling the first tubular away from the center longitudinal axis by rolling the first tubular down the feeder arm while the feeder arm is in the inclined position.

Embodiment 98. The method of embodiment 87, further comprising:

transporting a second tubular, via a pipe handler, from a pickup location to a horizontal orientation above the intermediate storage location;

releasing the second tubular from the pipe handler on to the feeder arm while the feeder arm is in an inclined position; and rolling the second tubular away from the center longitudinal axis by rolling the second tubular down the feeder arm while the feeder arm is in the inclined position.

Embodiment 99. The method of embodiment 87, further comprising:

raising a ramp arm, which is positioned on an opposite side of the center longitudinal axis from the feeder arm, to an inclined position; and while the ramp arm is in the inclined position, rolling the one or more tubulars away from the center longitudinal axis.

Embodiment 100. A method for handling pipes, the method comprising:

receiving one or more tubulars at a horizontal pipe handling system, the horizontal pipe handling system comprising:

a base with a center longitudinal axis;

an intermediate storage location disposed along the center longitudinal axis;

a first horizontal pipe handler with a first feeder arm and a first ramp arm rotationally attached to the base at a first axis which is disposed on a first side of the center longitudinal axis;

a second horizontal pipe handler with a second feeder arm and a second ramp arm rotationally attached to the base at the first axis;

a third horizontal pipe handler with a third feeder arm and a third ramp arm rotationally attached to the base at a second axis which is disposed on a second side of the center longitudinal axis, wherein the first side and the second side are opposite each other relative to the center longitudinal axis; and a fourth horizontal pipe handler with a fourth feeder arm and a fourth ramp arm rotationally attached to the base at a second axis.

Embodiment 101. The method of embodiment 100, further comprising:

rotating the first and second feeder arms in a first direction about the first axis, thereby lifting a first tubular of the one or more of the tubulars from the third and fourth ramp arms;

rolling the first tubular toward the center longitudinal axis; and rotating the first and second feeder arms in a second direction, thereby lowering the first tubular into the intermediate storage location.

Embodiment 102. The method of embodiment 100, further comprising:

receiving the one or more tubulars on to the third and fourth ramp arms;

rotating the first and second ramp arms in a first direction about the second axis, thereby raising the first and second ramp arms to an inclined position; and rolling the one or more tubulars away from the center longitudinal axis while the first and second ramp arms in the inclined position.

Embodiment 103. The method of embodiment 100, further comprising:

rotating the first and second feeder arms in a first direction about the first axis, thereby raising the first and second feeder arms to an inclined position;

receiving a second tubular on to the first and second feeder arms in a horizontal orientation from a pipe handler above the intermediate storage location; and rolling the second tubular down the first and second feeder arms and away from the center longitudinal axis while the first and second feeder arms are in the inclined position.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A horizontal pipe handling system comprising:

a base with a center longitudinal axis;

an intermediate storage location comprising a cradle attached to the base along the center longitudinal axis, wherein the cradle is configured to support a first tubular in a horizontal orientation;

a first horizontal pipe handler with a first feeder arm rotationally attached to a first support leg at a first axis, wherein the first support leg is positioned on a first side of the center longitudinal axis, and horizontally spaced away from the base and the center longitudinal axis, wherein the first feeder arm extends from the first axis, past the cradle, and to a second side of the center longitudinal axis, with the first side and the second side being opposite each other relative to the center longitudinal axis; and a second horizontal pipe handler with a first ramp arm rotationally attached to a second support leg at a second axis, wherein the second support leg is positioned on the second side of the center longitudinal axis, and horizontally spaced away from the base and the center longitudinal axis, wherein the first ramp arm is configured to support one or more tubulars in the horizontal orientation which is substantially parallel to the center longitudinal axis.

2. The system of claim 1, wherein rotation of the first feeder arm about the first axis in a first direction lifts the first tubular off of the first ramp arm and rolls the first tubular toward the cradle.

3. The system of claim 2, wherein rotation of the first feeder arm about the first axis in a second direction lowers the first tubular to the cradle.

4. The system of claim 3, wherein two top surfaces of the cradle form an up-turned V-shape that urges the first tubular toward a center of the up-turned V-shape when the first tubular is lowered to the cradle.

5. The system of claim 1, wherein rotation of the first ramp arm about the second axis in a first direction urges the one or more tubulars to roll away from the center longitudinal axis.

6. The system of claim 1, wherein the first ramp arm forms an inclined surface that is inclined toward the center longitudinal axis when the first ramp arm is in a rest position.

7. The system of claim 6, wherein the inclined surface is inclined away from the center longitudinal axis when the first ramp arm is rotated in a first direction about the second axis to a raised position.

8. The system of claim 6, wherein the first ramp arm has a first end that is rotationally attached to the second support leg at the second axis and a second end that has an up-turned top surface, wherein, when the first ramp arm is in the rest position, the inclined surface urges the one or more tubulars to roll toward the center longitudinal axis until the one or more tubulars engage the up-turned top surface.

9. The system of claim 1, wherein the cradle comprises a first cradle and a second cradle, and wherein the second cradle is spaced away from the first cradle along the center longitudinal axis.

10. The system of claim 9, further comprising:

a third horizontal pipe handler with a second feeder arm rotationally attached to a third support leg at a third axis that is in line with and parallel to the first axis, wherein the second feeder arm extends from the third axis, past the second cradle, and to the second side of the center longitudinal axis; and a fourth horizontal pipe handler with a second ramp arm rotationally attached to a fourth support leg at a fourth axis that is in line with and parallel to the second axis, wherein the second ramp arm is configured to support the one or more tubulars in the horizontal orientation.

11. A method for handling pipes, the method comprising:

storing one or more tubulars in a horizontal storage area;

receiving the one or more tubulars at a horizontal pipe handling system, which comprises a base with a center longitudinal axis and horizontal pipe handlers positioned on either side of the base;

positioning a first tubular of the one or more tubulars on one side of the center longitudinal axis;

lifting the first tubular by rotating a feeder arm of at least one of the horizontal pipe handlers about a first axis on a first support leg disposed on an opposite side of the center longitudinal axis from the first tubular, with the first support leg spaced away from the base, the feeder arm extending from the first axis, past the center longitudinal axis, and underneath the first tubular;

rolling the first tubular along the feeder arm toward an intermediate storage location at the center longitudinal axis; and positioning the first tubular in the intermediate storage location.

12. The method of claim 11, further comprising:

raising the feeder arm to an inclined position, thereby lifting the first tubular from the intermediate storage location; and rolling the first tubular away from the center longitudinal axis by rolling the first tubular down the feeder arm while the feeder arm is in the inclined position.

13. The method of claim 11, further comprising:

transporting a second tubular, via a pipe handler, from a pickup location to a horizontal orientation above the intermediate storage location;

releasing the second tubular from the pipe handler on to the feeder arm while the feeder arm is in an inclined position; and rolling the second tubular away from the center longitudinal axis by rolling the second tubular down the feeder arm while the feeder arm is in the inclined position.

14. The method of claim 11, further comprising:

raising a ramp arm, which is positioned on an opposite side of the center longitudinal axis from the feeder arm, to an inclined position; and while the ramp arm is in the inclined position, rolling the one or more tubulars away from the center longitudinal axis.

15. A method for handling pipes, the method comprising:

storing one or more tubulars in a horizontal storage area;

receiving the one or more tubulars at a horizontal pipe handling system, which comprises a base with a center longitudinal axis and horizontal pipe handlers positioned on either side of the base;

rolling a first tubular of the one or more tubulars toward an intermediate storage location at the center longitudinal axis;

positioning the first tubular in the intermediate storage location;

engaging a box end of the first tubular with a moveable doping device;

moving the first tubular, via the moveable doping device, along the center longitudinal axis towards a stationary doping device; and engaging a pin end of the first tubular with the stationary doping device.

16. The method of claim 15, further comprising:

determining a length of the first tubular based on a position of the moveable doping device relative to the stationary doping device.

17. The method of claim 16, further comprising:

determining a weight of the first tubular based on sensors in the intermediate storage location.

18. The method of claim 17, further comprising:

receiving data from the sensors at a controller; and determining, via the controller, an actual weight of the first tubular, wherein the sensors are disposed on one or more cradles that support the first tubular in the intermediate storage location.

19. The method of claim 15, further comprising:

engaging the first tubular in the intermediate storage location with grippers of a pipe handler; and rotating the first tubular in a horizontal orientation in the intermediate storage location via the grippers of the pipe handler.

20. The method of claim 19, further comprising at least one of:

cleaning, drying, and doping internal threads of the box end of the first tubular via the moveable doping device while the first tubular is being rotated;

cleaning, drying, and doping external threads of the pin end of the first tubular via the stationary doping device while the first tubular is being rotated; or lifting the first tubular from the intermediate storage location and transporting the first tubular to a rig floor via the pipe handler.

* * * * *